US006327850B1

(12) United States Patent
Yasui et al.

(10) Patent No.: US 6,327,850 B1
(45) Date of Patent: Dec. 11, 2001

(54) AIR-FUEL RATIO CONTROL APPARATUS FOR MULTICYLINDER INTERNAL COMBUSTION ENGINE

(75) Inventors: Yuji Yasui; Shusuke Akazaki; Yoshihisa Iwaki, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/680,482

(22) Filed: Oct. 6, 2000

(30) Foreign Application Priority Data

Oct. 8, 1999 (JP) ..... 11-288512

(51) Int. Cl.[7] ..... F01N 3/00
(52) U.S. Cl. ..... 60/285; 60/274; 123/692
(58) Field of Search ..... 60/274, 285; 123/692, 123/691, 674; 701/101, 103, 109

(56) References Cited

U.S. PATENT DOCUMENTS

| | | | | |
|---|---|---|---|---|
| 5,074,113 | * | 12/1991 | Matsuoka | 60/285 |
| 5,233,829 | * | 8/1993 | Komatsu | 60/285 |
| 5,390,489 | * | 2/1995 | Kawai et al. | 60/285 |
| 5,394,691 | * | 3/1995 | Seki | 60/285 |
| 5,485,382 | * | 1/1996 | Seki et al. | 60/285 |
| 5,579,637 | * | 12/1996 | Yamashita et al. | 60/285 |
| 5,694,910 | | 12/1997 | Hasegawa et al. . | |
| 5,706,654 | * | 1/1998 | Nagai | 60/285 |
| 5,784,879 | * | 7/1998 | Dohta et al. | 60/285 |
| 5,806,306 | * | 9/1998 | Okamoto et al. | 60/285 |
| 5,845,490 | | 12/1998 | Yasui et al. . | |
| 5,845,491 | | 12/1998 | Yasui et al. . | |
| 5,852,930 | | 12/1998 | Yasui et al. . | |
| 5,880,952 | | 3/1999 | Yasui et al. . | |
| 5,924,281 | | 7/1999 | Yasui et al. . | |
| 5,937,638 | * | 8/1999 | Akazaki et al. | 60/274 |
| 6,079,205 | | 6/2000 | Yasui et al. . | |
| 6,082,099 | | 7/2000 | Yasui et al. . | |

FOREIGN PATENT DOCUMENTS

| | | |
|---|---|---|
| 5-79374 | 3/1993 | (JP) . |
| 8-21273 | 1/1996 | (JP) . |
| 11-93741 | 4/1999 | (JP) . |
| 11-153051 | 6/1999 | (JP) . |

OTHER PUBLICATIONS

Serial No.: 09/153,300; filed: Sep. 15, 1998; By: Yuji Yasui et al For: Plant Control System.
Serial No.: 09/311,353; filed: May 13, 1999; By: Yuji Yasui et al For: Plant Control System.
Serial No. 09/465,765, filed: Dec. 17, 1999; By: Yuji Yasui et al For: Air–Fuel Ratio Control System for Internal Combustion Engine.
Serial No. 09/465,395, filed: Dec. 17, 1999; By: Yuji Yasui et al For: Plant Control System.
Serial No. 09/465,766, filed: Dec. 17, 1999; By: Yuji Yasui et al For: Plant Control System.
Serial No. 09/499,975, filed: Feb. 8, 2000; By: Yuji Yasui et al For: Air–Fuel Ratio Control System for Internal Combustion Engine.
Serial No. 09/548,931; filed: Apr. 13, 2000; By: Yuji Yasui For: Plant Control System.

* cited by examiner

*Primary Examiner*—Thomas Denion
*Assistant Examiner*—Diem Tran
(74) *Attorney, Agent, or Firm*—Arent Fox Kintner Plotkin & Kahn, PLLC

(57) ABSTRACT

An object system is regarded as being equivalent to a system for generating an output of an $O_2$ sensor or exhaust gas sensor from a target combined air-fuel ratio that is produced by combining target air-fuel ratios KCMD for respective cylinder groups according to a filtering process of the mixed model type. With the equivalent system as an object to be controlled, an air-fuel ratio processing controller determines a target combined air-fuel ratio, and determines a target air-fuel ratio KCMD for each of the cylinder groups from the target combined air-fuel ratio. The air-fuel ratios in the cylinder groups are manipulated into the target air-fuel ratio according to a feed-forward control process.

25 Claims, 15 Drawing Sheets

AIR-FUEL RATIO CONTROL APPARATUS FOR MULTICYLINDER INTERNAL COMBUSTION ENGINE

BACKGROUND OF THE INVENTION

1. Field of the Invention

The present invention relates to an apparatus for controlling the air-fuel ratio of a multicylinder internal combustion engine.

2. Description of the Related Art

Internal combustion engines having a multiplicity of cylinders, such as V-type 6-cylinder engines, V-type 8-cylinder engines, or in-line 6-cylinder engines, suffer structural limitations that make it difficult to combine exhaust gases generated by the combustion of an air-fuel mixture in the cylinders in a region close to the cylinders. Therefore, such multicylinder internal combustion engines generally have an exhaust system including relatively long auxiliary exhaust passages that extend separately from respective cylinder groups into which the cylinders are grouped. The auxiliary exhaust passages have downstream ends joined to a main exhaust passage which is shared by all the cylinders. In the exhaust system, exhaust gases from the cylinders of the cylinder groups are combined and discharged into the auxiliary exhaust passages near the cylinder groups, and then introduced from the auxiliary exhaust passages as combined exhaust gases into the main exhaust passage.

FIGS. 14 through 16 of the accompanying drawings schematically show respective V-type engines 1 each having two cylinder groups 3, 4 disposed one on each side of an output shaft, i.e., crankshaft, 2. Each of the cylinder groups 3, 4 comprises a plurality of cylinders 5 juxtaposed closely to each other in the axial direction of the output shaft 2. If the V-type engine 1 is a V-type 6-cylinder engine, then each of the cylinder groups 3, 4 comprises three cylinders. If the V-type engine 1 is a V-type 8-cylinder engine, then each of the cylinder groups 3, 4 comprises four cylinders.

The V-type engine 1 has an exhaust system including an auxiliary exhaust pipe, i.e., an auxiliary exhaust passage, 6 extending from the cylinder group 3 for receiving exhaust gases produced in the cylinders 5 of the cylinder group 3 and combined by an exhaust manifold near the cylinder group 3, and an auxiliary exhaust pipe, i.e., an auxiliary exhaust passage, 7 extending from the cylinder group 4 for receiving exhaust gases produced in the cylinders 5 of the cylinder group 4 and combined by an exhaust manifold near the cylinder group 4. The auxiliary exhaust pipes 6, 7 have downstream ends connected to a main exhaust pipe, i.e., a main exhaust passage, 8.

FIG. 17 of the accompanying drawings schematically shows an in-line 6-cylinder engine 101 having six cylinders 103 Juxtaposed in the axial direction of an output shaft, i.e., a crankshaft, 102. The cylinders 103 are grouped into a right cylinder group 104 of three closely positioned cylinders 103 and a left cylinder group 105 of three closely positioned cylinders 103. The in-line 6-cylinder engine 101 has an exhaust system including auxiliary exhaust pipes, or auxiliary exhaust passages, 106, 107 extending respectively from the cylinder groups 103, 104. The auxiliary exhaust pipes 106, 107 have downstream ends connected to a main exhaust pipe, i.e., a main exhaust passage, 108.

In the above multicylinder internal combustion engines whose exhaust system includes the auxiliary exhaust passages associated with the respective cylinder groups and the main exhaust passage to which the auxiliary exhaust passages are connected in common, catalytic converters, such as three-way catalytic converters, for purifying exhaust gases are generally arranged in the following layouts:

In FIG. 14, catalytic converters 9, 10 are connected to the respective auxiliary exhaust pipes 6, 7. In FIG. 15, catalytic converters 9, 10, 11 are connected respectively to the auxiliary exhaust pipes 6, 7 and the main exhaust pipe 8. In FIG. 16, a catalytic converter 11 is connected to the main exhaust pipe 8 only.

The above catalytic converter layouts are applicable to not only the exhaust systems of the V-type engines 1 shown in FIGS. 14 through 16, but also the exhaust system of the in-line 6-cylinder engine 101 shown in FIG. 17.

It is more important than ever for exhaust gas purifying systems for use with not only the above multi-cylinder internal combustion engines, but also other internal combustion engines, to have catalytic converters with a reliable exhaust gas purifying capability for effective environmental protection.

In order to achieve a desired exhaust gas purifying capability of a catalytic converter irrespective of deterioration of the catalytic converter, the applicant of the present application has proposed a system having an $O_2$ sensor disposed downstream of the catalytic converter for detecting the concentration of a certain component, e.g., the concentration of oxygen, in exhaust gases that have passed through the catalytic converter. The proposed system controls the air-fuel ratio of a mixture of air and fuel combusted by an internal combustion engine for converging the output of the $O_2$ sensor, i.e., the detected oxygen concentration, to a predetermined target value, i.e., a constant value. See, for example, Japanese laid-open patent publication No. 11-93741 or U.S. Pat. No. 6,082,099, for details.

According to the disclosed arrangement, the $O_2$ sensor is disposed downstream of the catalytic converter in an exhaust system, such as for an in-line 4-cylinder engine, wherein exhaust gases from all the cylinders are combined and introduced into a single exhaust pipe near the engine and the catalytic converter is connected to the single exhaust pipe only. A target air-fuel ratio, more precisely a target value for the air-fuel ratio represented by the oxygen concentration in the exhaust gases in a region where the exhaust gases from all the cylinders are combined, is determined for an air-fuel mixture combusted by the engine in order to converge the output of the $O_2$ sensor to the predetermined target value, and the air-fuel ratio of the air-fuel mixture combusted in the cylinders of the engine is controlled depending on the target air-fuel ratio.

In view of the above technical background, there have been proposed exhaust systems for use with multi-cylinder internal combustion engines having auxiliary exhaust passages associated with respective cylinder groups. Each of the proposed exhaust systems controls the air-fuel ratio of the internal combustion engine in order to achieve a desired purifying capability of catalytic converters connected to the auxiliary exhaust passages and the main exhaust passage. Those proposed exhaust systems will be described below.

If the catalytic converters 9, 10 are connected to the respective auxiliary exhaust pipes 6, 7 as shown in FIG. 14, then in order to achieve a total purifying capability of the catalytic converters 9, 10, an $O_2$ sensor 12 is mounted on the main exhaust pipe 8 near an upstream end thereof where the auxiliary exhaust pipes 6, 7 are joined, and the air-fuel ratios of the air-fuel mixtures combusted in the cylinder groups 3, 4 of the engine 1 are controlled in order to converge the output of the $O_2$ sensor 12 to the predetermined target value.

If the catalytic converters 9, 10, 11 are connected respectively to the auxiliary exhaust pipes 6, 7 and the main exhaust pipe 8, as shown in FIG. 15, then in order to achieve a total purifying capability of the catalytic converters 9, 10, 11, an $O_2$ sensor 12 is mounted on the main exhaust pipe 8 downstream of the catalytic converter 11, and the air-fuel ratio of the air-fuel mixture combusted in the cylinder groups 3, 4 of the engine 1 is controlled in order to converge the output of the $O_2$ sensor 12 to the predetermined target value.

If the catalytic converter 11 is connected to the main exhaust pipe 8 only, as shown in FIG. 16, then in order to achieve a purifying capability of the catalytic converter 11, an $O_2$ sensor 12 is mounted on the main exhaust pipe 8 downstream of the catalytic converter 11, and the air-fuel ratio of the air-fuel mixture combusted in the cylinder groups 3, 4 of the engine 1 is controlled in order to converge the output of the $O_2$ sensor 12 to the predetermined target value.

Generally, due to differences in length and shape between the auxiliary exhaust pipes 6, 7 and also differences in characteristics between the catalytic converters 9, 10 connected to the auxiliary exhaust pipes 6, 7, response characteristics of changes in the output of the $O_2$ sensor 12 with respect to changes in the air-fuel ratio of the air-fuel mixture combusted in the cylinder groups 3, 4 differ between the auxiliary exhaust pipe 6, i.e., the cylinder group 3, and the auxiliary exhaust pipe 7, i.e., the cylinder group 4.

For performing the control process to converge (set) the output of the $O_2$ sensor 12 to the predetermined target value with as high stability as possible, it is desirable to determine target air-fuel ratios for the respective cylinder groups 3, 4 and control the air-fuel ratios of the air-fuel mixtures combusted in the cylinder groups 3, 4 depending on the respective target air-fuel ratios.

To determine target air-fuel ratios for the respective cylinder groups 3, 4, however, it is necessary to recognize an exhaust system, upstream of the $O_2$ sensor 12, which comprises the auxiliary exhaust pipes 6, 7 and the catalytic converters 9, 10, as a 2-input, 1-output system which generates the output of the $O_2$ sensor 12 from the air-fuel ratios of the air-fuel mixtures combusted in the cylinder groups 3, 4. Consequently, determining target air-fuel ratios for the respective cylinder groups 3, 4 requires a complex model and a complex computing algorithm for the 2-input, 1-output system. The complex model and the complex computing algorithm tend to cause a modeling error and accumulated computation errors, which make it difficult to determine appropriate target air-fuel ratios.

SUMMARY OF THE INVENTION

It is therefore an object of the present invention to provide an air-fuel ratio control apparatus for a multicylinder internal combustion engine, which is capable of appropriately controlling air-fuel ratios of respective cylinder groups for converging an output of an $O_2$ sensor that is disposed in a main exhaust passage downstream of a catalytic converter to a predetermined target value according to a relatively simple process without the need for a complex model and a complex algorithm.

Another object of the present invention is to provide an air-fuel ratio control apparatus for a multi-cylinder internal combustion engine, which is capable of performing a control process of converting an output of an exhaust gas sensor to a target value accurately and stably.

To achieve the above objects, there is provided in accordance with the present invention an apparatus for controlling the air-fuel ratio of a multicylinder internal combustion engine having all cylinders divided into a plurality of cylinder groups and an exhaust system including a plurality of auxiliary exhaust passages for discharging exhaust gases produced when an air-fuel mixture of air and fuel is combusted from the cylinder groups, respectively, a main exhaust passage joining the auxiliary exhaust passages together at downstream sides thereof, an exhaust gas sensor mounted in the main exhaust passage for detecting the concentration of a given component in the exhaust gases flowing through the main exhaust passage, and a catalytic converter connected to the auxiliary exhaust passages and/or the main exhaust passage upstream of the exhaust gas sensor, the apparatus comprising target air-fuel ratio data generating means for sequentially generating target air-fuel ratio data representing the air-fuel ratio of the air-fuel mixture combusted in each of the cylinder groups so as to converge an output from the exhaust gas sensor to a predetermined target value, air-fuel ratio manipulating means for manipulating the air-fuel ratio of the air-fuel mixture combusted in each of the cylinder groups depending on the target air-fuel ratio data, the exhaust system including a system which comprises an object exhaust system disposed upstream of the exhaust gas sensor and including the auxiliary exhaust passages and the catalytic converter, the air-fuel ratio manipulating means, and the multicylinder internal combustion engine, the system being equivalent to a system for generating an output of the exhaust gas sensor from a target combined air-fuel ratio determined by combining the values of target air-fuel ratios for all the cylinder groups, respectively, according to a filtering process of the mixed model type, and target combined air-fuel ratio data generating means for sequentially generating target combined air-fuel ratio data representing the target combined air-fuel ratio which is required to converge the output from the exhaust gas sensor to the predetermined target value with the equivalent system serving as an object system to be controlled, the target air-fuel ratio data generating means comprising means for sequentially generating the target air-fuel ratio data from the target combined air-fuel ratio data generated by the target combined air-fuel ratio data generating means according to a predetermined converting process determined based on characteristics of the filtering process of the mixed model type, the target air-fuel ratio of the air-fuel mixture combusted in each of the cylinder groups being shared by the cylinder groups.

With the above arrangement, the target combined air-fuel ratio is introduced which is produced by combining the values of the air-fuel ratios of the air-fuel mixtures combusted in the cylinder groups according to the filtering process of the mixed model type. Therefore, the system (hereinafter referred to as "actual object system") which comprises the object exhaust system disposed upstream of the exhaust gas sensor and including the auxiliary exhaust passages and the catalytic converter, the air-fuel ratio manipulating means, and the multicylinder internal combustion engine, can be regarded as being equivalent to the system (the object system to be controlled) for generating the output of the exhaust gas sensor from the target combined air-fuel ratio. Stated otherwise, the actual object system can be regarded as being equivalent to a 1-input, 1-output system for being supplied with the combined air-fuel ratio as an input quantity and outputting the output of the exhaust gas sensor as an output quantity.

With the system introduced which is equivalent to the actual object system, in order to control the output of the exhaust gas sensor which is the output quantity from the equivalent system at the predetermined target value, the target combined air-fuel ratio may be manipulated as a control input to the object system. According to the present invention, the target combined air-fuel ratio data generating means sequentially generates target combined air-fuel ratio data representing a target combined air-fuel ratio which is required to converge the output from the exhaust gas sensor to the predetermined target value with the system equivalent to the actual object system serving as an object system to be controlled.

The target combined air-fuel ratio data generating means may generate only the target combined air-fuel ratio data as a single control input to the object system. Therefore, the target combined air-fuel ratio data generating means can generate the target combined air-fuel ratio data using the algorithm of a relatively simple feedback control process, e.g., a PID control process, without using a complex model of the object system.

The target combined air-fuel ratio data generated by the target combined air-fuel ratio data generating means may represent the value of the target combined air-fuel ratio itself. However, the target combined air-fuel ratio data may represent the difference between the value of the target combined air-fuel ratio and a predetermined reference air-fuel ratio, e.g., a stoichiometric air-fuel ratio.

When the target combined air-fuel ratio is thus defined, because of the characteristics of the filtering process of the mixed model type, the target air-fuel ratio for each of the cylinder groups may be shared by all the cylinder groups. With the value of the target combined air-fuel ratio being determined, a target air-fuel ratio for each of the cylinder groups can be determined from the target combined air-fuel ratio according to a process that is a reversal of the filtering process.

According to the present invention, the target air-fuel ratio data generating means sequentially generates the target air-fuel ratio data from the target combined air-fuel ratio data generated by the target combined air-fuel ratio data generating means according to a predetermining converting process, which is a process that is a reversal of the filtering process, based on characteristics of the filtering process of the mixed model type, the target air-fuel ratio data representing a target air-fuel ratio for the air-fuel mixture combusted in each of the cylinder groups, the target air-fuel ratio being shared by the cylinder groups.

Therefore, it is possible to obtain a target air-fuel ratio for each of the cylinder groups which is required to converge the output of the exhaust gas sensor to the predetermined target value.

As with the target combined air-fuel ratio data, the target air-fuel ratio data may represent the value of the target air-fuel ratio itself. However, the target air-fuel ratio data may represent the difference between the value of the target air-fuel ratio and a predetermined reference air-fuel ratio, e.g., a stoichiometric air-fuel ratio.

According to the present invention, the air-fuel ratio manipulating means manipulates the air-fuel ratio of the air-fuel mixture combusted in each of the cylinder groups depending on the target air-fuel ratio data generated by the target air-fuel ratio data generating means. Thus, the air-fuel ratio of the air-fuel mixture combusted in each of the cylinder groups can be manipulated so as to converge the output of the exhaust gas sensor to the predetermined target value.

According to the present invention, as described above, the target air-fuel ratio for each of the cylinder groups can appropriately be determined in order to converge the output of the exhaust gas sensor disposed downstream of the catalytic converter to the predetermined target value according to a relatively simple process without the need for a complex model and algorithm. By manipulating the air-fuel ratio of each of the cylinder groups depending on the target air-fuel ratio, the control process of converging the output of the exhaust gas sensor to the predetermined target value can suitably be performed. As a result, the catalytic converter disposed in each of the auxiliary exhaust passages or the main exhaust passage upstream of the exhaust sensor can have a good purifying capability.

For the catalytic converter disposed upstream of the exhaust sensor to have an optimum purifying capability, it is preferable that the exhaust gas sensor comprise an $O_2$ sensor and the target value for the output of the exhaust gas sensor be a constant value.

The filtering process of the mixed model type comprises a filtering process for obtaining the target combined air-fuel ratio in each given control cycle by combining a plurality of time-series values of the target air-fuel ratio for each of the cylinder groups in a control cycle earlier than the control cycle, according to a linear function having the time-series values as components thereof.

The filtering process using the linear function allows a target combined air-fuel ratio to be defined which is suitable for determining the target air-fuel ratio for each of the cylinder groups.

The linear function which has, as its components, a plurality of time-series values of the target air-fuel ratio of the air-fuel mixture combusted in each of the cylinder groups is a linear combination of those time-series values, for example. In this case, the filtering process obtains a weighted mean value of the time-series values as the target combined air-fuel ratio.

When the filtering process of the mixed model type is determined by the linear function, the target combined air-fuel ratio data in each given control cycle is obtained by a linear function which employs time-series data of the target air-fuel ratio data earlier than the control cycle as components of the linear function. Therefore, the target air-fuel ratio data generating means can generate target air-fuel ratio data in each given control cycle from the target combined air-fuel ratio data generated by the target combined air-fuel ratio data generating means, according to a predetermined operating process determined by the linear function.

More specifically, the target air-fuel ratio data in each control cycle may be determined using the target combined air-fuel ratio data in the control cycle and the target air-fuel ratio data in a past control cycle prior to the control cycle.

The air-fuel ratio manipulating means comprises means for manipulating the air-fuel ratio of the air-fuel mixture combusted in each of the cylinder groups according to a feed-forward control process performed on the target air-fuel ratio data generated by the target air-fuel ratio data generating means.

Consequently, the air-fuel ratio of the air-fuel mixture combusted in each of the cylinder groups can be manipulated in order to converge the output of the exhaust gas sensor to the predetermined target value according to a simple process without using a sensor for detecting the air-fuel ratio of the air-fuel mixture combusted in each of the cylinder groups. The effect of an error between the actual air-fuel ratio in each of the cylinder groups and the target air-fuel ratio represented by the target air-fuel ratio data can be absorbed by the target combined air-fuel ratio data generated by the target combined air-fuel ratio data generating means.

The target combined air-fuel ratio data may be generated by a feedback control process, such as a PID control process, which does not need a model of the object to be controlled. However, since the actual object system includes the multicylinder internal combustion engine and the catalytic converter, a change in the output of the exhaust gas sensor which serves as the output quantity to the object system, in response to a change in the input quantity to the object system that is equivalent to the actual object system, is liable to be affected by a response delay caused by the multicylinder internal combustion engine and the catalytic converter.

According to the present invention, therefore, the target combined air-fuel ratio data generating means comprises means for generating the target combined air-fuel ratio data in order to converge the output of the exhaust gas sensor to the predetermined target value according to an algorithm of a feedback control process constructed based on a predetermined model of the object system which is defined as a system for generating data representing the output of the exhaust gas sensor with at least a response delay from the target combined air-fuel ratio data.

By thus generating the target combined air-fuel ratio data using the algorithm of the feedback control process constructed based on the model of the object system in view of the response delay thereof, the effect of the response delay due to the multicylinder internal combustion engine and the catalytic converter included in the actual object system is appropriately compensated for, generating target combined air-fuel ratio data suitable for converting the output of the exhaust gas sensor to the predetermined target value. Inasmuch as the object system is a 1-input, 1-output system, the object system can be constructed of a simple arrangement.

In the above model, the target combined air-fuel ratio data should preferably represent the difference between an actual target combined air-fuel ratio and a predetermined reference air-fuel ratio, and the data representing the output of the exhaust gas sensor should preferably represent the difference between an actual output from the exhaust gas sensor and the predetermined target value for the purposes of increasing the ease with which to construct the algorithm of the feedback control process and the reliability of the target combined air-fuel ratio data generated using the algorithm.

If the algorithm of the feedback control process performed for the target combined air-fuel ratio data generating means to generate the target combined air-fuel ratio data is constructed based on the model of the object system, then the algorithm of the feedback control process should preferably comprise an algorithm of a sliding mode control process.

Particularly, the sliding mode control process should preferably comprise an adaptive sliding mode control process.

Specifically, the sliding mode control process has such characteristics that it generally has high control stability against disturbances. By generating the target combined air-fuel ratio data using the algorithm of the sliding mode control process, the reliability of the target combined air-fuel ratio data is increased, and hence the stability of the control process of converging the output of the exhaust gas sensor to the target value is increased.

The adaptive sliding mode control process incorporates an adaptive control law (adaptive algorithm) for minimizing the effect of a disturbance, in a normal sliding mode control process. Therefore, the target combined air-fuel ratio data is made highly reliable.

More specifically, the sliding mode control process uses a function referred to as a switching function constructed using the difference between a controlled quantity (the output of the exhaust gas sensor in this invention) and its target value, and it is important to converge the value of the switching function to "0". According to the normal sliding mode control process, a control law referred to as a reaching control law is used to converge the value of the switching function to "0". However, due to the effect of a disturbance, it may be difficult in some situations to provide sufficient stability in converging the value of the switching function to "0" only with the reaching control law. According to the adaptive sliding mode control process, in order to converge the value of the switching function to "0" while minimizing the effect of disturbances, the adaptive control law (adaptive algorithm) is used in addition to the reaching control law. By using the algorithm of the adaptive sliding mode control process, it is possible to converge the value of the switching function highly stably to "0", and hence converge the output of the exhaust gas sensor to the predetermined target value with high stability.

As described above, the algorithm of the feedback control process comprises the algorithm of the sliding mode control process (including the adaptive sliding mode control process). Preferably, the algorithm of the sliding mode control process employs, as a switching function for the sliding mode control process, a linear function having, as components, a plurality of time-series data of the difference between the output of the exhaust gas sensor and the predetermined target value.

In the sliding mode control process, the switching function used thereby usually comprises a controlled quantity and a rate of change thereof. The rate of change of the controlled quantity is generally difficult to detect directly, and is often calculated from a detected value of the controlled quantity. The calculated value of the rate of change of the controlled quantity tends to suffer an error.

According to the present invention, the switching function for the sliding mode control process comprises a linear function having, as components, a plurality of time-series data of the difference between the output of the exhaust gas sensor and the predetermined target value. Therefore, the algorithm for generating the target combined air-fuel ratio data can be constructed without the need for the rate of change of the output of the exhaust gas sensor. Consequently, the reliability of the generated target combined air-fuel ratio data is increased.

With the switching function thus constructed, the algorithm of the sliding mode control process generates target combined air-fuel ratio data so as to converge the values of the time-series data of the difference between the output of the exhaust gas sensor and the predetermined target value to "0".

In order to generate target combined air-fuel ratio data as described above, the algorithm of the feedback control process based on the model of the object system including the algorithm of the sliding mode control process is employed. The model should preferably comprise a model which expresses a behavior of the object system with a discrete time system, though it may comprise a model which expresses a behavior of the object system with a continuous time system.

With the behavior of the object system being expressed by the discrete time system, the algorithm of the feedback control process can be constructed easily, and can be made suitable for computer processing.

The model which expresses the behavior of the object system with the discrete time system may comprise a model which expresses data representing the output of the exhaust gas sensor in each given control cycle with data representing the output of the exhaust gas sensor in a past control cycle prior to the control cycle and the combined air-fuel ratio data.

The model thus constructed can appropriately express the behavior of the object system.

The data representing the output of the exhaust gas sensor in the past control cycle is a so-called autoregressive term, and is related to a response delay of the object system.

With the model of the object system comprising the model of the discrete time system, as described above, the apparatus should further comprise identifying means for sequentially identifying a value of a parameter to be set of the model using the target combined air-fuel ratio data generated in the past by the target combined air-fuel ratio data generating means and the data representing the output of the exhaust gas sensor, wherein the algorithm of the feedback control process performed by the target combined air-fuel ratio data generating means comprises an algorithm for generating new target combined air-fuel ratio data using the value of the parameter identified by the identifying means.

The model has parameters to be set to a certain value in describing its behavior. For example, if the model is a model which expresses the data representing the output of the exhaust gas sensor in each given control cycle with data representing the output of the exhaust gas sensor in a past control cycle prior to the control cycle and the target combined air-fuel ratio data, then coefficient parameters relative respectively to the data representing the output of the exhaust gas sensor in the past control cycle and the target combined air-fuel ratio data are included in the parameters of the model.

According to the algorithm of the feedback control process constructed based on the model, the target combined air-fuel ratio data is generated using the parameters of the model. For increasing the reliability of the target combined air-fuel ratio data, it is preferable to identify the values of the parameters of the model on a real-time basis depending on the actual behavior of the object system, which is based on the actual behavioral characteristics of the actual object system and often tends to change with time.

In the model which expresses the object system with the discrete time system, the target combined air-fuel ratio data generated in the past by the target combined air-fuel ratio data generating means and the data representing the output of the exhaust gas sensor are used to sequentially identify the parameters of the model depending on the actual behavior of the object system.

Therefore, the apparatus of the present invention further includes the identifying means. The values of the parameters of the model are sequentially identified by the identifying means, and the target combined air-fuel ratio data is generated using the identified values of the parameters. It is thus possible to generate the target combined air-fuel ratio data depending on the actual behavior of the object system based on the actual behavior, from time to time, of the actual object system. As a result, the reliability of the target combined air-fuel ratio data is increased, making it possible to accurately and stably converge the output of the exhaust gas sensor to the predetermined target value.

If the model is a model which expresses the data representing the output of the exhaust gas sensor in each given control cycle with data representing the output of the exhaust gas sensor in a past control cycle prior to the control cycle and the target combined air-fuel ratio data, then the identifying means identifies at least one of the coefficient parameters, preferably all the coefficient parameters, relative respectively to the data representing the output of the exhaust gas sensor and the target combined air-fuel ratio data.

The identifying means can sequentially identify the values of the parameters according to an algorithm, e.g., an identifying algorithm such as a method of least squares, a method of weighted least squares, a fixed gain method, a degressive gain method, a fixed tracing method, etc., constructed in order to minimize an error between the output of the exhaust gas sensor in the model and the actual output of the exhaust gas sensor.

In the above apparatus with the above identifying means, the air-fuel ratio manipulating means does not always need to manipulate the air-fuel ratio of the air-fuel mixture in each of the cylinder groups according to the target air-fuel ratio represented by the target air-fuel ratio data that is generated by the target combined air-fuel ratio data generating means from the target combined air-fuel ratio data, but may manipulate the air-fuel ratio of the air-fuel mixture in each of the cylinder groups according to a target air-fuel ratio other than the target air-fuel ratio data generated by the target combined air-fuel ratio data generating means, depending on operating conditions of the multicylinder internal combustion engine, e.g., when the internal combustion engine operates with the supply of fuel being cut off or operates to meet a large output power requirement.

If the air-fuel ratio manipulating means comprises means for manipulating the air-fuel ratio of the air-fuel mixture combusted in each of the cylinder groups depending on a target air-fuel ratio other than the target air-fuel ratio represented by the target air-fuel ratio data generated by the target air-fuel ratio data generating means, depending on operating conditions of the multicylinder internal combustion engine, and the identifying means is employed, the apparatus further comprises filter means for sequentially determining actually used target combined air-fuel ratio data as target combined air-fuel ratio data corresponding to an actual target air-fuel ratio by effecting a filtering process identical to the filtering process of the mixed model type on data representing the actual target air-fuel ratio that is actually used by the air-fuel ratio manipulating means to manipulate the air-fuel ratio in each of the cylinder groups. The identifying means comprises means for identifying the value of the parameter of the model using the actually used target combined air-fuel ratio data determined by the filter means instead of the target combined air-fuel ratio data generated by the target combined air-fuel ratio data generating means.

The filter means effects the filtering process identical to the filtering process of the mixed model type on the data representing the actual target air-fuel ratio that is actually used by the air-fuel ratio manipulating means, which may not necessarily be the target air-fuel ratio data generated by the target air-fuel ratio data generating means, for thereby determining the actually used target combined air-fuel ratio data as the target combined air-fuel ratio data corresponding to the target air-fuel ratio that is actually used by the air-fuel ratio manipulating means. By using the actually used target combined air-fuel ratio data instead of the target combined air-fuel ratio data in order to identify the values of the parameters of the model, the identifying means identifies the values of the parameters of the model in view of how the air-fuel ratio in each of the cylinder groups is actually manipulated by the air-fuel ratio manipulating means.

Therefore, the values of the parameters of the model which are identified by the identifying means reflect how the air-fuel ratio in each of the cylinder groups is actually manipulated by the air-fuel ratio manipulating means. Consequently, the reliability of the identified values of the parameters of the model is increased.

In the apparatus for controlling the air-fuel ratio of the multicylinder internal combustion engine according to the present invention, the object system may have a relatively long dead time, i.e., a time required until the value, at each time point, of the target combined air-fuel ratio that is the input quantity to the object system is reflected in the output of the exhaust gas sensor, because of the multicylinder internal combustion engine, the catalytic converter, and the auxiliary exhaust pipes, which are relatively long, in the actual object system. With the object system having such a dead time, then the stability of the control process of converging the output of the exhaust gas sensor to the predetermined target value would tend to be lowered if the target combined air-fuel ratio were generated to manipulate the air-fuel ratio for the cylinder groups without taking the data time into account.

According to the present invention, the apparatus further comprises estimating means for sequentially generating data representing an estimated value of the output of the exhaust gas sensor after a dead time according to an algorithm constructed based on a predetermined model of the object system which is defined as a system for generating data representing the output of the exhaust gas sensor with a response delay and the dead time from the target combined air-fuel ratio data. The target combined air-fuel ratio data generating means comprises means for generating the target combined air-fuel ratio data in order to converge the output of the exhaust gas sensor to the predetermined target value according to an algorithm of a feedback control process constructed using the data generated by the estimating means.

Since the model of the object system is determined in view of the response delay and dead time thereof, the estimating means can sequentially generate data representing an estimated value of the output of the exhaust gas sensor after the dead time according to the algorithm constructed based on the model.

The target combined air-fuel ratio data generating means generates the target combined air-fuel ratio data according to the algorithm of the feedback control process constructed using the data representing the estimated value of the output of the exhaust gas sensor. Therefore, it is possible to generate the target combined air-fuel ratio data suitable for compensating for the effect of the dead time of the object system and converging the output of the exhaust gas sensor stably to the predetermined target value.

In the model of the object system relative to the estimating means, the target combined air-fuel ratio data should preferably represent the difference between an actual target combined air-fuel ratio and a predetermined reference air-fuel ratio, and the data representing the output of the exhaust gas sensor should preferably represent the difference between an actual output from the exhaust gas sensor and the predetermined target value for the purposes of increasing the ease with which to construct the algorithm for generating the data representing the estimated value of the output of the exhaust gas sensor and the reliability of the estimated value of the output of the exhaust gas sensor which is generated using the algorithm. With this arrangement, the data representing the estimated value of the output of the exhaust gas sensor represents the difference between the estimated value of the output of the exhaust gas sensor and the predetermined target value.

With the estimating means being thus provided, the algorithm performed by the estimating means comprises an algorithm for generating the data representing the estimated value of the output of the exhaust gas sensor using the data representing the output of the exhaust gas sensor and the combined air-fuel ratio data generated in the past by the target combined air-fuel ratio data generating means. The algorithm allows the estimating means to sequentially generate the data representing the estimated value of the output of the exhaust gas sensor.

If the air-fuel ratio manipulating means comprises means for manipulating the air-fuel ratio of the air-fuel mixture combusted in each of the cylinder groups depending on a target air-fuel ratio other than the target air-fuel ratio represented by the target air-fuel ratio data generated by the target air-fuel ratio data generating means, depending on operating conditions of the multicylinder internal combustion engine, then the apparatus further comprises filter means for sequentially determining actually used target combined air-fuel ratio data as target combined air-fuel ratio data corresponding to an actual target air-fuel ratio by effecting a filtering process identical to the filtering process of the mixed model type on data representing the actual target air-fuel ratio that is actually used by the air-fuel ratio manipulating means to manipulate the air-fuel ratio in each of the cylinder groups. The estimating means comprises means for generating the data representing the estimated value of the output of the exhaust gas sensor using the actually used target combined air-fuel ratio data determined by the filter means instead of the target combined air-fuel ratio data generated by the target combined air-fuel ratio data generating means.

The filter means determines the actually used target combined air-fuel ratio data from the data representing the target air-fuel ratio actually used by the air-fuel ratio manipulating means. By using the actually used target combined air-fuel ratio data instead of the target combined air-fuel ratio data generated by the target combined air-fuel ratio data generating means, the estimating means generates data representing the estimated value of the output of the exhaust gas sensor. In this manner, the data representing the estimated value of the output of the exhaust gas sensor is generated in view of how the air-fuel ratio in each of the cylinder groups is actually manipulated by the air-fuel ratio manipulating means.

Therefore, the data, generated by the estimating means, representing the estimated value of the output of the exhaust gas sensor reflects how the air-fuel ratio in each of the cylinder groups is actually manipulated by the air-fuel ratio manipulating means. Consequently, the reliability of the data representing the estimated value is increased.

In the apparatus having the estimating means, the algorithm of the estimating means may be constructed such that the model of the object system comprises a model which expresses a behavior of the object system with a continuous time system. However, the model of the object system should preferably comprise a model which expresses a behavior of the object system with a discrete time system.

With the behavior of the object system being expressed by the discrete time system, the algorithm carried out by the estimating means can be constructed easily, and can be made suitable for computer processing.

The model of the object system which expresses the behavior of the object system with the discrete time system may comprise a model which expresses data representing the output of the exhaust gas sensor in each given control cycle with data representing the output of the exhaust gas sensor in a past control cycle prior to the control cycle and the target combined air-fuel ratio data in a control cycle which is earlier than the control cycle by a dead time of the object system.

The model thus constructed can appropriately express the behavior of the object system including its response delay and dead time.

The data representing the output of the exhaust gas sensor in the past control cycle is a so-called autoregressive term, and is related to a response delay of the object system. The dead time of the object system is expressed by the target combined air-fuel ratio data prior to the dead time of the object system.

With the model of the object system being expressed with the discrete time system, the apparatus further comprises identifying means for sequentially identifying values of parameters to be set of the model of the object system, using the target combined air-fuel ratio data determined in the past by the target combined air-fuel ratio data generating means and the data representing the output of the exhaust gas sensor. The algorithm performed by the estimating means comprises an algorithm for using the values of the parameters identified by the identifying means in order to generate the data representing the estimated value of the output of the exhaust gas sensor.

If the air-fuel ratio manipulating means comprises means for manipulating the air-fuel ratio of the air-fuel mixture combusted in each of the cylinder groups depending on a target air-fuel ratio other than the target air-fuel ratio represented by the target air-fuel ratio data generated by the target air-fuel ratio data generating means, and the algorithm of the estimating means uses the actually used target combined air-fuel ratio data sequentially determined by the filter means instead of the target combined air-fuel ratio data, then the apparatus further comprises identifying means for sequentially identifying values of parameters to be set of the model of the object system, using the actually used combined air-fuel ratio data determined in the past by the filter means and the data representing the output of the exhaust gas sensor. The algorithm performed by the estimating means comprises an algorithm for using the values of the parameters identified by the identifying means in order to generate the data representing the estimated value of the output of the exhaust gas sensor.

The model of the object system has parameters to be set to a certain value in describing its behavior. For example, if the model is a model which expresses the data representing the output of the exhaust gas sensor in each given control cycle with data representing the output of the exhaust gas sensor in a past control cycle prior to the control cycle and the target combined air-fuel ratio data in a control cycle which is earlier than the control cycle by a dead time of the object system, then coefficient parameters relative respectively to the data representing the output of the exhaust gas sensor in the past control cycle and the target combined air-fuel ratio data in the control cycle which is earlier than the control cycle by the dead time of the object system are included in the parameters of the model.

Since the algorithm of the estimating means is based on the model of the object system, the data representing the estimated value of the output of the exhaust gas sensor is generated using the parameters of the model. For increasing the reliability of the data representing the estimated value of the output of the exhaust gas sensor, it is preferable to identify the values of the parameters of the model on a real-time basis depending on the actual behavior of the object system.

In the model which expresses the object system with the discrete time system, the target combined air-fuel ratio data generated in the past by the target combined air-fuel ratio data generating means and the data representing the output of the exhaust gas sensor are used to sequentially identify the parameters of the model depending on the actual behavior of the object system.

With the filter means provided for determining the actually used target combined air-fuel ratio data, it is preferable to use the actually used target combined air-fuel ratio data instead of the target combined air-fuel ratio data for identifying the values of the parameters.

In the apparatus with the estimating means, the identifying means sequentially identifies the values of the parameters of the model of the object system, and the estimating means sequentially identifies the data representing the estimated value of the output of the exhaust gas sensor using the identified values of the parameters. It is thus possible to generate the data representing the estimated value of the output of the exhaust gas sensor depending on the actual behavior of the object system based on the actual behavior, from time to time, of the actual object system. As a result, the reliability of the data representing the estimated value can be increased.

If the air-fuel ratio manipulating means comprises means for manipulating the air-fuel ratio of the air-fuel mixture combusted in each of the cylinder groups depending on a target air-fuel ratio other than the target air-fuel ratio represented by the target air-fuel ratio data, then the identifying means uses the actually used target combined air-fuel ratio data rather than the target combined air-fuel ratio data in order to identify the values of the parameters, so that the identified values of the parameters reflect how the air-fuel ratio in each of the cylinder groups is actually manipulated by the air-fuel ratio manipulating means. Therefore, the reliability of the identified values of the parameters is increased, and the reliability of the data representing the estimated value of the output of the exhaust gas sensor which is outputted by the estimating means is further increased.

Consequently, the highly reliable target combined air-fuel ratio data can be generated according to the algorithm of the feedback control process that is constructed using the data representing the estimated value. The control process of converging the output of the exhaust gas sensor to the predetermined target value can be performed accurately and stably.

If the model of the object system is a model which expresses the data representing the output of the exhaust gas sensor in each given control cycle with data representing the output of the exhaust gas sensor in a past control cycle prior to the control cycle and the target combined air-fuel ratio data in a control cycle which is earlier than the control cycle by a dead time of the object system, then the identifying means identifies at least one of the coefficient parameters, preferably all the coefficient parameters, relative respectively to the data representing the output of the exhaust gas sensor and the target combined air-fuel ratio data.

The identifying means can sequentially identify the values of the parameters according to an algorithm, e.g., an identifying algorithm such as a method of least squares, a method of weighted least squares, a fixed gain method, a degressive gain method, a fixed tracing method, etc., constructed in order to minimize an error between the output of the exhaust gas sensor in the model of the object system and the actual output of the exhaust gas sensor.

In the apparatus with the identifying means in addition to the estimating means, the algorithm of the feedback control process for generating the target combined air-fuel ratio data may be constructed based on a model of the object system which is determined separately from the model of the object system in the estimating means. However, the algorithm of the feedback control process which is carried out by the target combined air-fuel ratio data generating means should preferably be an algorithm constructed based on the model of the object system for generating the target combined air-fuel ratio data using the value of the parameters identified by the identifying means.

By constructing the algorithm of the feedback control process based on the model of the object system determined to construct the algorithm of the estimating means, it is easy to construct the algorithm of the feedback control process using the data representative of the estimated value of the output of the exhaust gas sensor which is generated by the estimating means. At the same time, by using the values of the parameters of the object system that are identified by the identifying means according to the algorithm of the feedback control process, the target combined air-fuel ratio data can be generated depending on the actual behavior of the object system. That is, it is possible to generate the target combined air-fuel ratio data which is highly reliable in converging the output of the exhaust gas sensor to the predetermined target value.

In the apparatus with the estimating means, the algorithm of the feedback control process performed by the target combined air-fuel ratio data generating means comprises an algorithm for generating the target combined air-fuel ratio data in order to converge the estimated value of the output of the exhaust gas sensor which is represented by the data generated by the estimating means to the predetermined target value.

According to the above algorithm of the feedback control process, it is possible to appropriately compensate for the effect of the dead time of the object system and to generate the target combined air-fuel ratio data which is highly reliable in converging the output of the exhaust gas sensor to the predetermined target value.

In the apparatus with the estimating means, as with the algorithm of the feedback control process based on the model of the object system, as described above, the algorithm of the feedback control process performed by the target combined air-fuel ratio data generating means comprises an algorithm of a sliding mode control process.

Particularly, the sliding mode control process preferably comprises an adaptive sliding mode control process.

Specifically, the sliding mode control process including the adaptive sliding mode control process has the above-mentioned characteristics. By generating the target combined air-fuel ratio data using the algorithm of the sliding mode control process, particularly the adaptive sliding mode control process, the reliability of the target combined air-fuel ratio data is increased, and hence the stability of the control process of converging the output of the exhaust gas sensor to the target value is increased.

The algorithm of the sliding mode control process employs, as a switching function for the sliding mode control process, a linear function having, as components, a plurality of time-series data of the difference between the estimated value of the output of the exhaust gas sensor which is represented by the data generated by the estimating means and the predetermined target value.

With the switching function for the sliding mode control process being thus constructed, the algorithm for generating the target combined air-fuel ratio data can be constructed without the need for data representing a rate of change of the output of the exhaust gas sensor. Therefore, the reliability of the generated target combined air-fuel ratio data is high.

The algorithm of the sliding mode control process generates the target combined air-fuel ratio data in order to converge the values of a plurality of time-series data of the difference between the estimated value of the output of the exhaust gas sensor and the predetermined target value to "0". Thus, it is possible to appropriately compensate for the dead time of the object system.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

An air-fuel ratio control apparatus according to the present invention will be described below with reference to FIGS. 1 through 13.

Figure 1:
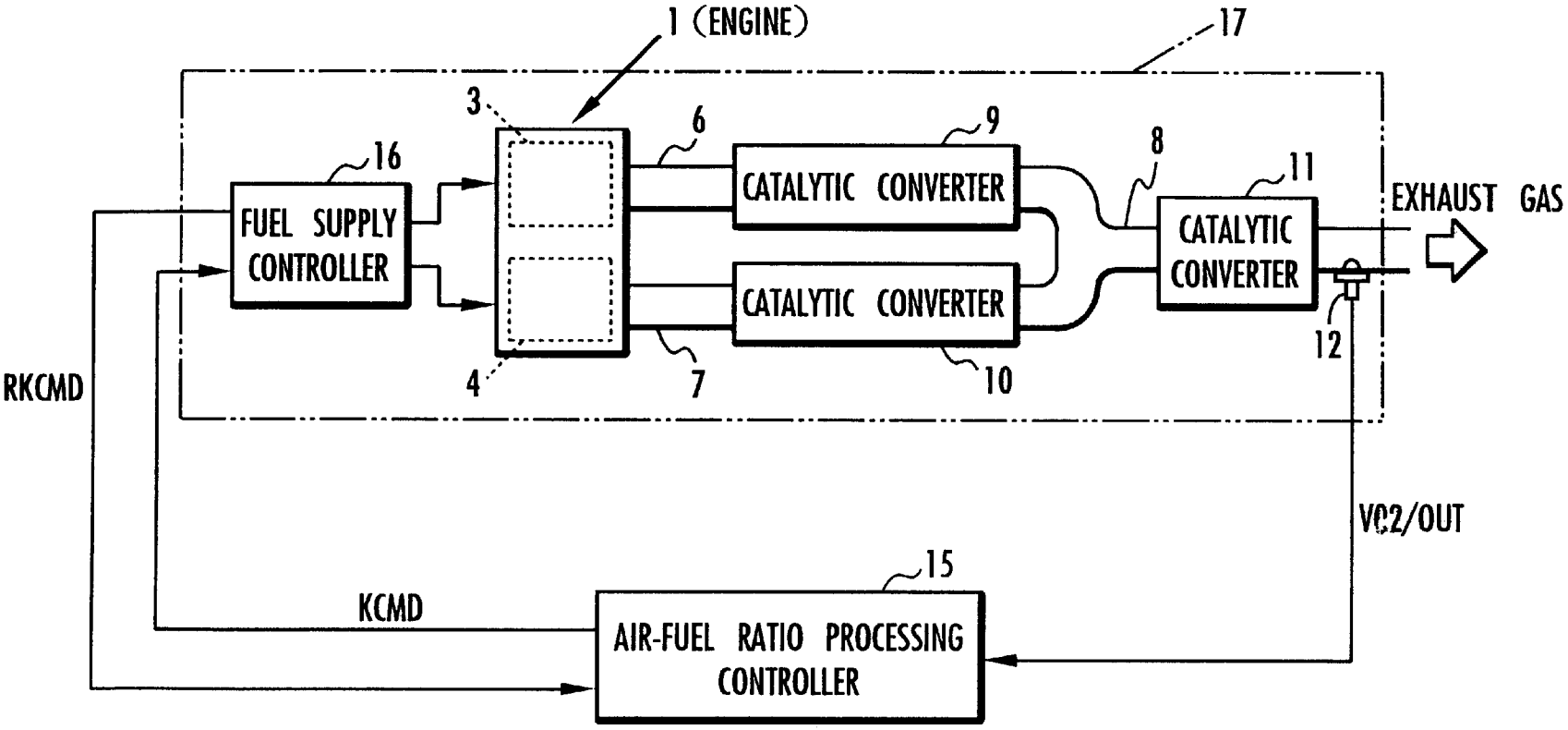
FIG. 1 is a block diagram of an overall system of an air-fuel ratio control apparatus for a multicylinder internal combustion engine according to an embodiment of the present invention.
Figure 2:
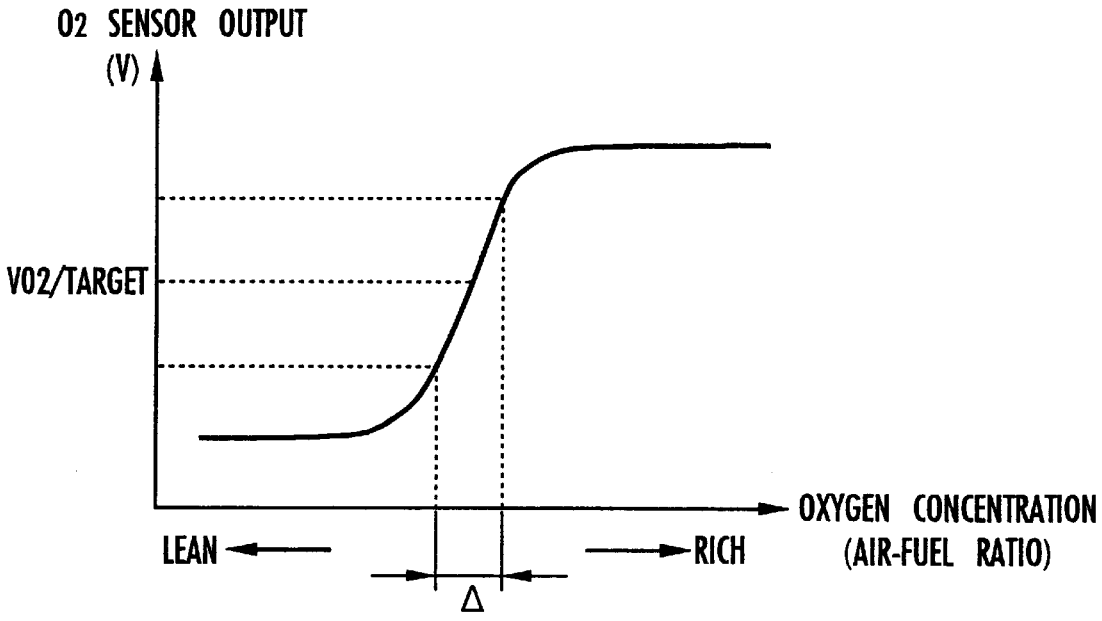
FIG. 2 is a diagram showing output characteristics of an $O_2$ sensor and an air-fuel ratio sensor used in the air-fuel ratio control apparatus shown in FIG. 1.

In FIG. 1, the present invention is applied to an air-fuel ratio control apparatus for a V-type engine 1 (hereinafter referred to as "engine 1") as a multicylinder internal combustion engine having an exhaust system shown in FIG. 16, for example. FIG. 1 shows in block diagram of an overall system of the air-fuel ratio control apparatus.

Figure 16:
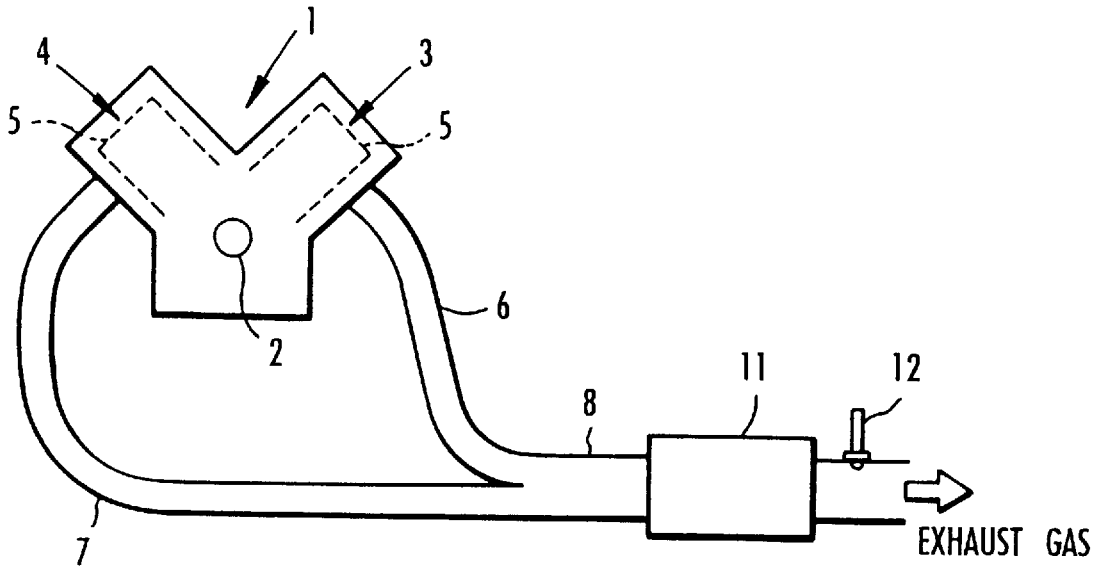
FIG. 16 is a block diagram of still another exhaust system of a V-type engine as a multicylinder internal combustion engine.

As shown in FIG. 1, the engine 1 and its exhaust system are illustrated more simply than in FIG. 16. Specifically, the engine 1 is a V-type 6-cylinder engine mounted as a propulsion source on an automobile or a hybrid vehicle, for example, and has two cylinder groups 3, 4 each comprising three cylinders.

The exhaust system of the engine 1 has auxiliary exhaust pipes, i.e., auxiliary exhaust passages, 6, 7 connected to the respective two cylinder groups 3, 4, a main exhaust pipe, i.e., a main exhaust pipe, 8 to which the auxiliary exhaust pipes 6, 7 are connected in common, and catalytic converters 9, 10, 11 connected respectively to the auxiliary exhaust pipes 6, 7 and the main exhaust pipe 8. Each of the catalytic converters 9, 10, 11 comprises a three-way catalytic converter, for example.

An $O_2$ sensor 12 as an exhaust gas sensor is mounted on the main exhaust pipe 8 downstream of the catalytic converter 11.

The $O_2$ sensor 12 comprises an ordinary $O_2$ sensor for generating an output signal VO2/OUT (representative of a detected value of oxygen concentration) having a level depending on the oxygen concentration in the exhaust gas that has passed through the catalytic converter 11 and flows in the main exhaust pipe 8. The oxygen concentration in the exhaust gas depends on the air-fuel ratio of the air-fuel mixture combusted by the engine 1. The output signal VO2/OUT from the $O_2$ sensor 12 will change with high sensitivity in substantial proportion to the oxygen concentration in the exhaust gas, with the air-fuel ratio corresponding to the oxygen concentration in the exhaust gas being in a range A close to a stoichiometric air-fuel ratio, as indicated by the solid-line curve 1 in FIG. 2. At the oxygen concentration corresponding to the air-fuel ratio outside the range Δ, the output signal VO2/OUT from the $O_2$ sensor 12 is saturated and is of a substantially constant level.

The system according the present embodiment basically performs a control process of manipulating the air-fuel ratios of air-fuel mixtures combusted in the cylinder groups of the engine 1 in order to achieve an optimum purifying capability of an overall exhaust gas purifying apparatus which comprises the catalytic converters 9, 10, 11. When the air-fuel ratios of air-fuel mixtures combusted in the cylinder groups of the engine 1 are controlled in order to converge (set) the output VO2/OUT of the $O_2$ sensor 12 to a predetermined target value VO2/TARGET (see FIG. 2), the overall exhaust gas purifying apparatus which comprises the catalytic converters 9, 10, 11 is allowed to have an optimum purifying capability.

The system according the present embodiment has controllers, described below, for performing a control process of converging (setting) the output VO2/OUT of the $O_2$ sensor 12 to the predetermined target value VO2/TARGET.

Specifically, the system has a controller 15 (hereinafter referred to as "air-fuel ratio processing controller 15") for executing, in predetermined control cycles, a process of sequentially generating a target air-fuel ratio KCMD for the air-fuel mixtures combusted in the cylinder groups 3, 4 (specifically, a target value for an air-fuel ratio for each of the cylinder groups 3, 4 as recognized by the oxygen concentration of exhaust gases that are the sum of exhaust gases from the cylinders of the cylinder groups 3, 4), and a controller 16 (hereinafter referred to as "fuel supply controller 16") as air-fuel ratio manipulating means for manipulating the air-fuel ratios of the air-fuel mixtures combusted in the cylinder groups 3, 4 into the target air-fuel ratio KCMD by executing, in predetermined control cycles, a process of adjusting fuel supply quantities (fuel injection quantities) for the cylinder groups 3, 4 depending on the target air-fuel ratio KCMD determined by the air-fuel ratio processing controller 15.

The fuel supply controller 16 is supplied with the output VO2/OUT of the $O_2$ sensor 12, and also detected output signals from various other sensors for detecting an engine speed, an intake pressure (a pressure in an intake pipe), a coolant temperature, etc. of the engine 1. The air-fuel ratio processing controller 15 and the fuel supply controller 16 can exchange data of the target air-fuel ratio KCMD and other various items of operating condition information.

The controllers 15, 16 comprise a microcomputer, and perform their respective control processes in given control cycles. In the present embodiment, each of the control cycles in which the air-fuel ratio processing controller 15 performs its control process of generating the target air-fuel ratio KCMD has a period, e.g., 30 to 100 ms, predetermined in view of the dead time due to the catalytic converters 9, 10, 11, the processing load, etc.

The control process performed by the fuel supply controller 16 for adjusting the fuel injection quantities is required to be synchronous with the rotational speed of the engine 1 or specifically combustion cycles of the engine 1. Therefore, the control cycles of the control process performed by the fuel supply controller 16 are of a period in synchronism with a crankshaft angle period (so-called TDC) of the engine 1.

The constant period of the control cycles of the air-fuel ratio processing controller 15 is longer than the crankshaft angle period (TDC) of the engine 1.

The control processes performed by the air-fuel ratio processing controller 15 and the fuel supply controller 16 will be described below.

The air-fuel ratio processing controller 15 performs a process of sequentially determining, in given control cycles of a constant period, target air-fuel ratios KCMD for the cylinder groups 3, 4 in order to converge the output VO2/OUT of the $O_2$ sensor 12 to the predetermined target value VO2/TARGET, in view of behavioral characteristics, such as response delay characteristics and dead time, of a system denoted by the reference numeral 17 in FIG. 1 (hereinafter referred to as "object system 17") which is a combination of a portion of the exhaust system of the engine 1 ranging from the engine 1 to the $O_2$ sensor 12, i.e., a portion extending upstream of the $O_2$ sensor 12 and including the auxiliary exhaust pipes 6, 7 and the catalytic converters 9, 10, 11, and the engine 1 and the fuel supply controller 16.

In order to perform the above process, the object system 17 is regarded as being equivalent to a system for generating the output VO2/OUT of the $O_2$ sensor 12 with a response delay and a dead time from a target combined air-fuel ratio (denoted by KCMD/T) that is produced by combining the target air-fuel ratios KCMD for the cylinder groups 3, 4 according to a filtering process (described later on).

Figure 3:
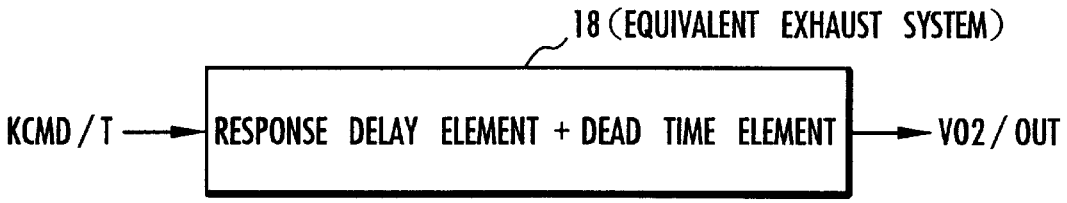
FIG. 3 is a block diagram of a system equivalent to an exhaust system of the multicylinder internal combustion engine shown in FIG. 1.

As shown in FIG. 3, the object system 17 is equivalent to a 1-input, 1-output system 18 for being supplied with the target combined air-fuel ratio KCMD/T as an input quantity and outputting the output VO2/OUT of the $O_2$ sensor 12 as an output quantity. The equivalent system 18 (hereinafter referred to as "object equivalent system 18") is defined as a system comprising a response delay element and a dead time element.

The response delay element of the object equivalent exhaust system 18 is primarily caused by the engine 1 and the catalytic converters 9, 10, 11 of the object system 17. The dead time element of the object equivalent system 18 is primarily caused by the auxiliary exhaust pipes 6, 7 and the catalytic converters 9, 10, 11 of the object system 17.

According to the basic control process carried out by the air-fuel ratio processing controller 15, a target combined air-fuel ratio KCMD/T as a control input for the object equivalent system 18 is sequentially determined in control cycles in order to converge the output VO2/OUT of the $O_2$ sensor 12 as an output quantity of the object equivalent system 18 to the target value VO2/TARGET, according to a feedback control algorithm for controlling the object equivalent system 18. Then, a target air-fuel ratio KCMD for the cylinder groups 3, 4 is determined from the target combined air-fuel ratio KCMD/T. While the target air-fuel ratio KCMD is shared by the cylinder groups 3, 4 in the present embodiment, the target air-fuel ratio for the cylinder group 3 and the target air-fuel ratio for the cylinder group 4 will be described differently from each other and denoted respectively by KCMD/A, KCMD/B.

In order to perform the above control process, a model representing the behavior of the object equivalent system 18 is constructed in advance. For constructing such a mode, the difference between the target combined air-fuel ratio KCMD/T and a predetermined reference air-fuel ratio FLAF/BASE (KCMD/T−FLAF/BASE, hereinafter referred to as "target combined differential air-fuel ratio kcmd/t") is used as the input quantity to the object equivalent system 18, and the difference between the output VO2/OUT of the $O_2$ sensor 12 and the target value VO2/TARGET (=VO2/OUT −VO2/TARGET, hereinafter referred to as "differential output VO2 ") is used as the output quantity from the object equivalent system 18.

In the present embodiment, the reference air-fuel ratio FLAF/BASE is a stoichiometric air-fuel ratio. The target combined differential air-fuel ratio kcmd/t corresponds to target combined air-fuel ratio data, and the differential output VO2 of the $O_2$ sensor 12 corresponds to data representing the output of the $O_2$ sensor 12.

In the present embodiment, a model of the object equivalent system 18 is constructed using the target combined differential air-fuel ratio kcmd/t and the differential output VO2 of the $O_2$ sensor 12 as follows:

The model of the object equivalent system 18 is constructed as a model which expresses the behavior of the object equivalent system 18 with a discrete-time system (more specifically, an autoregressive model having a dead time in the target combined differential air-fuel ratio kcmd/t as the input quantity to the object equivalent system 18) according to the following equation (1):

$$VO2(k+1)=a1\cdot VO2(k)+a2\cdot VO2\ (k-1)+b1\cdot kcmd/t(k-d) \quad (1)$$

where "k" represents an integer indicative of the ordinal number of a discrete-time control cycle of the air-fuel ratio processing controller 15, and "d" the number of control cycles of the air-fuel ratio processing controller 15 which represents the dead time required until the value of the target combined air-fuel ratio KCMD/T or the target combined differential air-fuel ratio kcmd/t in each control cycle is reflected in the output VO2/OUT or the differential output VO2 of the $O_2$ sensor 12. The dead time d is set to a predetermined value (fixed value) as described later on.

The first and second terms on the right side of the equation (1) are autoregressive terms representing respective elements of a response delay of the object equivalent system 18. In the first and second terms, "a1", "a2" represent respective gain coefficients of primary and secondary autoregressive terms. Stated otherwise, these gain coefficients "a1", "a2" are coefficient parameters relative to the differential output VO2 of the $O_2$ sensor 12 as the output quantity from the object equivalent system 18.

The third term on the right side of the equation (1) represents a dead time element of the object equivalent system 18, and more precisely expresses the target combined differential air-fuel ratio kcmd/t as the input quantity to the object equivalent system 18, including the dead time d of the object equivalent system 18. In the third term, "b1" represents a gain coefficient relative to the element, or stated otherwise a coefficient parameter relative to the target combined differential air-fuel ratio kcmd/t as the input quantity to the object equivalent system 18.

The gain coefficients "a1", "a2", "b1" are parameters which are to be set (identified) to certain values in defining the behavior of the equivalent exhaust system 18, and are sequentially identified by an identifier which will be described later on.

In the model of the object equivalent system 18 expressed as the discrete time system according to the equation (1), the differential output VO2(k+1) of the $O_2$ sensor 12 as the output quantity from the object equivalent system 18 in each control cycle of the air-fuel ratio processing controller 15 is expressed by a plurality of (two in this embodiment) differential outputs VO2(k), VO2(k−1) in control cycles prior to the control cycle and a target combined differential air-fuel ratio kcmd/t(k−d) as the input quantity to the object equivalent system 18 in a control cycle prior to the dead time d of the object equivalent system 18.

The target combined air-fuel ratio KCMD/T as the input quantity to the object equivalent system 18 is defined as the target air-fuel ratio ratios KCMD/A, KCMD/B for the cylinder groups 3, 4, as combined with respect to the cylinder groups 3, 4 according to a filtering process of the mixed model type described below. Since the model of the object equivalent system 18 employs the target combined differential air-fuel ratio kcmd/t(=KCMD/T−FLAF/BASE), the target combined differential air-fuel ratio kcmd/t is defined as a combination of the difference kcmd/a (=KCMD/A−FLAF/BASE, hereinafter referred to as "target differential air-fuel ratio kcmd/a") between the target air-fuel ratio KCMD/A for the cylinder group 3 and the reference air-fuel ratio FLAF/BASE and the difference kcmd/b (=KCMD/B−FLAF/BASE, hereinafter referred to as "target differential air-fuel ratio kcmd/b") between the target air-fuel ratio KCMD/B for the cylinder group 4 and the reference air-fuel ratio FLAF/BASE.

In the present embodiment, therefore, the target combined differential air-fuel ratio kcmd/t is defined as the target differential air-fuel ratios kcmd/a, kcmd/b for the cylinder groups 3, 4, as being combined by the filtering process of the mixed model type that is expressed by the following equation (2):

$$kcmd/t(k-d)=A1\cdot kcmd/a(k-dA)+A2\cdot kcmd/a(k-dA-1)+B1\cdot kcmd/b(k-dB)+B2\cdot kcmd/b(k-dB-1) \quad (2)$$

On the right side of the equation (2), "dA" represents the dead time (hereinafter referred to as "cylinder-group-3-side dead time") required until the target air-fuel ratio KCMD/A for the cylinder group 3 in each control cycle of the air-fuel ratio processing controller 15 is reflected in the output VO2/OUT of the $O_2$ sensor 12 via the cylinder group 3 and the auxiliary exhaust pipe 6, in terms of the number of control cycles of the air-fuel ratio processing controller 15, and "dB" represents the dead time (hereinafter referred to as "cylinder-group-4-side dead time") required until the target air-fuel ratio KCMD/B for the cylinder group 4 in each control cycle of the air-fuel ratio processing controller 15 is reflected in the output VO2/OUT of the $O_2$ sensor 12 via the cylinder group 4 and the auxiliary exhaust pipe 7, in terms of the number of control cycles of the air-fuel ratio processing controller 15.

The values of the dead times dA, dB depend on the operating characteristics of the cylinder groups 3, 4, the lengths of the auxiliary exhaust pipes 6,7, the capacities of the catalytic converters 9, 10 connected to the respective auxiliary exhaust pipes 6, 7, and the catalytic converter 11 connected to the main exhaust pipe 8. In the present embodiment, the values of the dead times dA, dB are set to a value (fixed value) predetermined through various experiments and simulation.

The coefficients A1, A2, B1, B2 of the terms on the right side of the equation (2) are preset as described later on.

In the present embodiment, the target combined differential air-fuel ratio kcmd/t(k−d) prior to the dead time d of the object equivalent system 18 is determined according to a linear function which comprises as its components a plurality of (two in the embodiment) time-series data kcmd/a(k−dA), kcmd/a(k−dA−1), prior to the cylindergroup-3-side dead time dA, of the target differential air-fuel ratio kcmd/a for the cylinder group 3, and a plurality of (two in the embodiment) time-series data kcmd/b(k−dB), kcmd/b(k−dB−1), prior to the cylinder-group-3-side dead time dB, of the target differential air-fuel ratio kcmd/b for the cylinder group 4, or more specifically according to a linear combination of these time-series data.

The coefficients A1, A2, B1, B2 relative to the time-series data kcmd/a(k−dA), kcmd/a(k−dA−1), kcmd/b(k−dB), kcmd/b(k−dB−1) are set to such values that A1+A2+B1+B2=1(preferably, A1+A2=B1+B2=0.5) and A1>A2, B1>B2 (e.g., A1=B1=0.4, A2=B2=0.1).

The target combined differential air-fuel ratio kcmd/t thus determined is significant as a weighted mean value of the time-series data kcmd/a(k−dA), kcmd/a(k−dA−1), kcmd/b (k−dB), kcmd/b(k−dB−1).

In order to determine the target combined differential air-fuel ratio kcmd/t, more time-series data of the target differential air-fuel ratios kcmd/a, kcmd/b for the cylinder groups 3, 4 may be employed.

The target combined differential air-fuel ratio kcmd/t thus determined in each control cycle is given by an equation which is obtained by shifting the entire right side of the equation (2) into the future by control cycles corresponding to the dead time d of the object equivalent system 18.

It is assumed that the cylinder-group-3-side dead time dA and the cylinder-group-4-side dead time dB are related to each other by dA≧dB, and their difference (dA−dB) is represented by dD (≧0). If the dead time d of the object equivalent system 18 is equal to the shorter one of the cylinder-group-3-side dead time dA and the cylinder-group-4-side dead time dB, i.e., the cylinder-group-4-side dead time dB, (d=dB), then the following equation (3) is obtained from the equation (2):

$$kcmd/t(k)=A1\cdot kcmd/a(k-dD)+A2\cdot kcmd/a(k-dD-1)+B1\cdot kcmd/b(k)+B2\cdot kcmd/b(k-1) \quad (3)$$

(dD=dA−dB≧0, d=dB)

Therefore, the target combined differential air-fuel ratio kcmd/t(k) in each control cycle is defined as the time-series data kcmd/a(k−dD), kcmd/a(k−dD−1), kcmd/b(k), kcmd/b (k−1) of the target differential air-fuel ratios kcmd/a, kcmd/b for the cylinder groups 3, 4 acquired prior to the control cycle, as processed by the filtering process represented by the equation (3).

By determining the target combined differential air-fuel ratio kcmd/t as the control input to the object equivalent system 18 in order to converge the output VO2/OUT of the $O_2$ sensor 12, the target air-fuel ratios KCMD/A, KCMD/B for the cylinder groups 3, 4 are shared by the cylinder groups 3, 4. If the common target air-fuel ratio for the cylinder groups 3, 4 is represented by KCMD (=KCMD/A=KCMD/B) and the target differential air-fuel ratio (=KCMD−FLAF/BASE) as the difference between the target air-fuel ratio KCMD and the reference air-fuel ratio FLAF/BASE is represented by kcmd (=kcmd/a=kcmd/b), then the equation (3) is rewritten as the following equation (4):

$$kcmd/t(k)=A1\cdot kcmd(k-dD)+A2\cdot kcmd(k-dD-1)+B1\cdot kcmd(k)+B2\cdot kcmd(k-1) \quad (4)$$

Once the target combined air-fuel ratio KCMD/T(k) or the target combined differential air-fuel ratio kcmd/t(k) in each control cycle is determined, a target differential air-fuel ratio kcmd(k) in each control cycle for the cylinder groups 3, 4, and hence a target air-fuel ratio KCMD(k) (=kcmd(k)+FLAF/BASE) can be determined, using the equation (4).

Specifically, depending on whether the difference dD between cylinder-group-3-side dead time dA and the cylinder-group-4-side dead time dB (dD=dA−dB, hereinafter referred to as "cylinder-group dead time difference dD") is dD=0 or dD>0, a target differential air-fuel ratio kcmd(k) in each control cycle can be determined according to the equations (5), (6):

$$kcmd(k)=\frac{1}{B1}\cdot[kcmd/t(k)-A1\cdot kcmd(k-dD)-A2\cdot kcmd(k-dD-1)-B2\cdot kcmd(k-1)] \quad (dD>0) \quad (5)$$

$$kcmd(k)=\frac{1}{A1+B1}\cdot[kcmd/t(k)-(A2+B2)\cdot kcmd(k-1)] \quad (dD=0) \quad (6)$$

Therefore, a target differential air-fuel ratio kcmd(k) in each control cycle for the cylinder groups 3, 4 can be determined from the target combined differential air-fuel ratio kcmd/t(k) determined in the control cycle and target differential air-fuel ratios kcmd(k−dD), kcmd (k−dD−1), kcmd(k−1) (the equation (5)) or kcmd(k−1) (the equation (6)) in past control cycles.

In the present embodiment, the cylinder-group dead time difference dD is dD>0(e.g., dD=2). In this case, the target differential air-fuel ratio kcmd(k) for the cylinder groups 3, 4 corresponding to the target combined differential air-fuel ratio kcmd/t(k) can be determined in each control cycle according to the equation (5).

In the present embodiment, the dead time d of the model of the object equivalent system 18 is set to a value substantially equal to the value of the shorter one of the cylinder-group-3-side dead time dA and the cylindergroup-4-side dead time dB, i.e., the cylinder-group-4-side dead time dB. Since the object system 17 as a basis for the object equivalent system 18 includes the engine 1, the cylinder-group-3-side dead time dA and the cylinder-group-4-side dead time dB are longer as the rotational speed of the engine 1 is lower. Therefore, the cylinder-group-4-side dead time dB to which the dead time d of the model of the object equivalent system 18 is set is of a value substantially equal to the cylinder-group-4-side dead time dB at an idling speed of the engine 1, for example (e.g., d=7 in the present embodiment).

In this embodiment, the target air-fuel ratio KCMD is shared by the cylinder groups 3, 4, and the above equation (4) is used as a basic formula representative of the filtering process of the mixed model type for determining the target combined differential air-fuel ratio kcmd/t with respect to the target differential air-fuel ratio kcmd for the cylinder groups 3, 4.

The target combined differential air-fuel ratio kcmd/t thus determined is significant as a target value for the air-fuel ratio recognized from the oxygen concentration of exhaust gases as the sum of exhaust gases discharged from the cylinder groups 3, 4 and combined near the cylinder groups 3, 4.

The target combined differential air-fuel ratio kcmd/t corresponds to target combined air-fuel ratio data, and the target differential air-fuel ratio kcmd corresponds to target air-fuel ratio data.

The air-fuel ratio processing controller 15 sequentially determines, in each control cycle, the target combined differential air-fuel ratio kcmd/t (the control input to the object equivalent system 18) required to converge the differential output VO2 of the $O_2$ sensor 12 to "0", i.e., to converge the output VO2/OUT of the $O_2$ sensor 12 to the target value VO2/TARGET, according to an algorithm that is constructed on the basis of the model of the object equivalent system 18 and the filtering process of the mixed model type. For determining the target combined differential air-fuel ratio kcmd/t, the air-fuel ratio processing controller 15 compensates for changes in the behavioral characteristics of the object equivalent system 18, and the response delay and data time d of the object equivalent system 18. The air-fuel ratio processing controller 15 then sequentially determines, in each control cycle, the target air-fuel ratio kcmd for the cylinder groups 3, 4 and the target air-fuel ratio KCMD from the determined target combined differential air-fuel ratio kcmd/t, and gives the target air-fuel ratio KCMD to the fuel supply controller 16.

Figure 4:
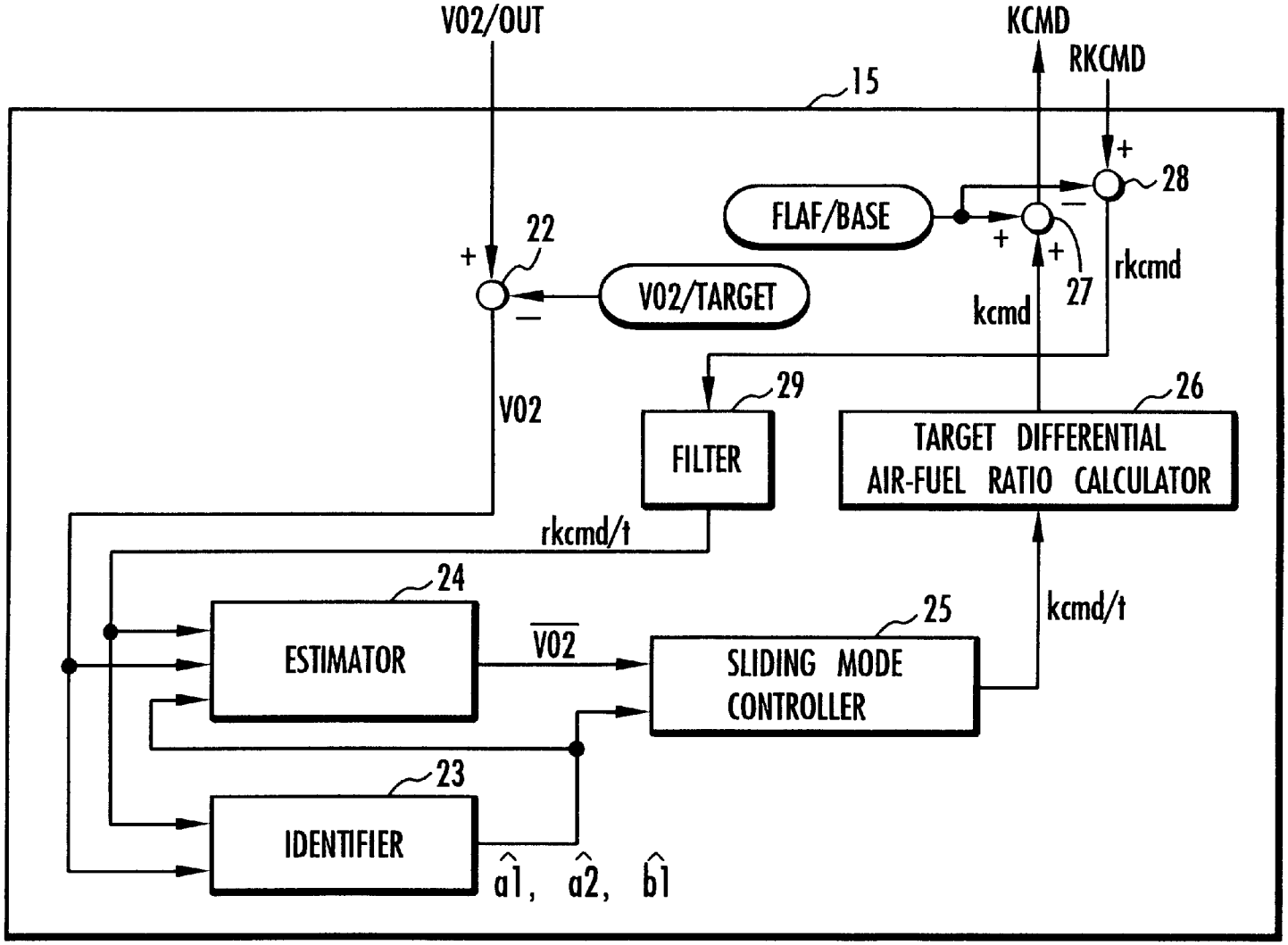
FIG. 4 is a block diagram of a basic arrangement of an exhaust system controller of the air-fuel ratio control apparatus shown in FIG. 1.

In order to perform the above process, the air-fuel ratio processing controller 15 has a functional arrangement as shown in FIG. 4.

Specifically, the air-fuel ratio processing controller 15 has a subtractor 22 for subtracting the target value VO2/TARGET from the output VO2/OUT of the $O_2$ sensor 12 to sequentially determine the differential output VO2, and an identifier 23 (identifying means) for sequentially determining identified values a1 hat, a2 hat, b1 hat of the gain coefficients a1, a2, b1(hereinafter referred to as "identified gain coefficients a1 hat, a2 hat, b1 hat") which are parameters to be set of the model (the equation (1)) of the object equivalent system 18.

The air-fuel ratio processing controller 15 also has an estimator 24 (estimating means) for sequentially determining an estimated value VO2 bar of the differential output VO2 from the $O_2$ sensor 12 (hereinafter referred to as "estimated differential output VO2 bar") as data representing an estimated value of the output VO2/OUT from the $O_2$ sensor 12 after the dead time d of the object equivalent system 18, and a sliding mode controller 25 (target combined air-fuel ratio data generating means) for sequentially determining the target combined differential air-fuel ratio kcmd/t required to converge the output VO2 of the $O_2$ sensor 12 to the target value VO2/TARGET, according to the algorithm of an adaptive sliding mode control process, which is a feedback control process.

The air-fuel ratio processing controller 15 also has a target differential air-fuel ratio calculator 26 (target air-fuel ratio data generating means) for sequentially determining a target differential air-fuel ratio kcmd for the cylinder groups 3, 4 by effecting the calculating process (converting process) according to the equation (5) on the target combined differential air-fuel ratio kcmd/t determined by the sliding mode controller 25, and an adder 27 for adding the reference air-fuel ratio FLAF/BASE to the target differential air-fuel ratio kcmd to sequentially generate a target air-fuel ratio KCMD for the cylinder groups 3, 4.

In the present embodiment, the fuel supply controller 16 occasionally manipulates the air-fuel ratio of the air-fuel mixture actually combusted in the cylinder groups 3, 4, not using the target air-fuel ratio KCMD determined by the air-fuel ratio processing controller 15, but using a target air-fuel ratio that is determined separately from the target air-fuel ratio KCMD, depending on the operating conditions of the engine 1. A target air-fuel ratio, including the above separately determined target air-fuel ratio, actually used by the fuel supply controller 16 in order to manipulate the air-fuel ratios of the cylinder groups 3, 4 will hereinafter referred to as "actually used target air-fuel ratio RKCMD". As will be described in detail later on, the air-fuel ratio processing controller 15 further includes the following functional arrangement in order to reflect the actually used target air-fuel ratio RKCMD in the operating process of the identifier 23 and the estimator 24:

The air-fuel ratio processing controller 15 has a subtractor 28 for subtracting the reference air-fuel ratio FLAF/BASE from the actually used target air-fuel ratio RKCMD supplied from the fuel supply controller 16 for thereby sequentially determining an actually used target differential air-fuel ratio rkcmd (=RKCMD−FLAF/BASE) corresponding to the target differential air-fuel ratio actually used by the fuel supply controller 16, and a filter 29 (filtering means) for effecting the filtering process of the same type as the right side of the equation (4) on an actually used target combined differential air-fuel ratio rkcmd/t (actually used target combined air-fuel ratio data) as a target combined differential air-fuel ratio that forms a basis for the actually used target differential air-fuel ratio rkcmd that is actually used by the fuel supply controller 16.

The filtering process performed by the filter 29 is specifically given by the equation (7) given below, and the actually used target combined differential air-fuel ratio rkcmd/t(k) is determined in each control cycle of the air-fuel ratio processing controller 15 according to the equation (7).

$$rkcmd/t(k)=A1\cdot rkcmd(k-dD)+A2\cdot rkcmd(k-dD-1)+B1\cdot rkcmd(k)+B2\cdot rkcmd(k-1) \quad (7)$$

The actually used target combined differential air-fuel ratio rkcmd/t(k) in each control cycle is calculated by the filtering process according to the equation (7) from time-series data rkcmd(k), rkcmd(k−1), rkcmd (k−dD), rkcmd(k− dD−1) of the actually used target differential air-fuel ratio rkcmd that corresponds to the actually used target air-fuel ratio RKCMD that is being used or was used by the fuel supply controller 16 prior to the control cycle.

The actually used target air-fuel ratio RKCMD(k) actually used by the fuel supply controller 16 in each control cycle of the air-fuel ratio processing controller 15 is usually equal to a target air-fuel ratio KCMD(k−1) that is finally determined by the air-fuel ratio processing controller 15 in the preceding control cycle. Thus, usually, rkcmd(k)=kcmd(k−1). Therefore, the actually used target combined differential air-fuel ratio rkcmd/t(k) determined in each control cycle by the filter 29 corresponds to a preceding value kcmd/t(k−1) of the target combined differential air-fuel ratio kcmd/t that is determined by the sliding mode controller 25 as described later on (usually, rkcmd/t(k)=kcmd/t(k−1)).

The algorithm of a processing sequence to be carried out by the identifier 23, the estimator 24, and the sliding mode controller 25 is constructed as follows:

The identifier 23 sequentially calculates, on a real-time basis, the identified gain coefficients a1 hat, a2 hat, b1 hat in order to minimize a modeling error of the model of the object equivalent system 18.

The identifier 23 determines, in each of the control cycles of the air-fuel ratio processing controller 15, the value of a differential output VO2(k) of the $O_2$ sensor 12 in the present control cycle on the model of the object equivalent system 18 (hereinafter referred to as "identified differential output VO2(k) hat") according to the equation (8) shown below, which is produced by shifting the equation (1) representative of the model of the object equivalent system 18 one control cycle into the past and replacing the gain coefficients a1, a2, b1 with the identified gain coefficients a1(k−1) hat, a2(k−1) hat, b1(k−1) hat determined in the preceding control cycle (present values of the identified gain coefficients).

$$\hat{VO2}(k)=\hat{a}1(k-1)\cdot VO2(k-1)+\hat{a}2(k-1)\cdot VO2(k-2)+\hat{b}1\ (k-1)\cdot kcmd/t(k-d-1) \quad (8)$$

According to the equation (8), the identified differential output VO2(k) hat in each control cycle can basically be determined by calculating the right side of the equation (8) using the identified gain coefficients a1(k−1) hat, a2(k−1) hat, b1 (k−1) hat determined in the preceding control cycle, past values VO2(k−1), VO2 (k−2) of the differential output VO2 from the $O_2$ sensor 12, and a past value kcmd/t(k−d−1) of the target combined differential air-fuel ratio kcmd/t which is determined by the sliding mode controller 25 described later on.

In the present embodiment, as described above, the fuel supply controller 16 occasionally manipulates the air-fuel ratio of the air-fuel mixture actually combusted in the cylinder groups 3, 4, not using the target air-fuel ratio KCMD determined by the air-fuel ratio processing controller 15. Therefore, for identifying the values of the gain coefficients a1, a2, b1 while sequentially reflecting the actual behavior of the object system 17 as a basis for the object equivalent system 18, it is considered preferable to use the actually used target combined differential air-fuel ratio rkcmd/t sequentially determined by the filter 29, rather than the target combined differential air-fuel ratio kcmd/t determined depending on the target air-fuel ratio KCMD generated by the air-fuel ratio processing controller 15.

In the present embodiment, the identified differential output VO2(k) hat in each control cycle is determined using the actually used target combined differential air-fuel ratio rkcmd/t determined by the filter 29, rather than the target combined differential air-fuel ratio kcmd/t on the right side of the equation (8).

In view of the fact that rkcmd/t(k)=rkcmd/t (k−1) usually, the identified differential output VO2(k) hat is determined according to the following equation (9):

$$\begin{aligned}\hat{VO2} &= \hat{a1}(k-1)\cdot VO2(k-1)+\hat{a2}(k-1)\cdot VO2(k-2)+ \\ &\quad \hat{b1}(k-1)\cdot rkcmd/t(k-d) \\ &= \Theta^T(k-1)\cdot \xi(k)\end{aligned} \quad (9)$$

where $\Theta^T(k)=[\hat{a}1(k)\hat{a}2(k)\hat{b}1(k)]$ $\xi(k)=[VO2(k-1)\ VO2(k-2)\ rkcmd/t(k-d)]$ In the present embodiment, therefore, the identifier 23 determines the value of an identified differential output VO2(k) hat in each control cycle according to the equation (9), using the values of the identified gain coefficients a1(k−1) hat, a2(k−1) hat, b1(k−1) hat determined in the preceding control cycle, the data of past values of the differential output VO2 from the $O_2$ sensor 12 as calculated by the subtractor 22 (more specifically, the differential output VO2(k−1) in a 1st control cycle prior to the present control cycle and the differential output VO2(k−2) in a 2nd control cycle prior to the present control cycle), and the data of a past value of the actually used target combined differential air-fuel ratio rkcmd/t as calculated by the filter 29 (more specifically, the actually used target combined differential air-fuel ratio rkcmd/t(k−d) in a control cycle prior to the dead time d of the object equivalent system 18).

The value of the dead time d of the object equivalent system 18 in the third term of the equation (9) represents a preset value (constant value, which is a preset value of the cylinder-group-4-side dead time dB) as described above. In the equation (9), Θ, ξ represent vectors defined therein, and T represents a transposition.

The identifier 23 also determines a difference ID/E(k) between the above identified differential output VO2(k) hat and the present actual differential output VO2(k) from the $O_2$ sensor 12, as representing a modeling error of the model of the object equivalent system 18 according to the following equation (10) (the difference ID/E will hereinafter be referred to as "identified error ID/E"):

$$ID/E(k)=VO2(k)-\hat{VO2}(k) \quad (10)$$

The identifier 23 further determines new identified gain coefficients a1(k) hat, a2(k) hat, b1(k) hat, stated otherwise, a new vector Θ(k) having these identified gain coefficients as elements (hereinafter the new vector Θ(k) will be referred to as "identified gain coefficient vector Θ"), according to an algorithm to minimize the identified error ID/E (more precisely, the absolute value of the identified error ID/E), according to the equation (11) given below.

That is, the identifier 23 varies the identified gain coefficients a1(k−1) hat, a2(k−1) hat, b1(k−1) hat determined in the preceding control cycle by a quantity proportional to the identified error ID/E(k) for thereby determining the new identified gain coefficients a1(k) hat, a2(k) hat, b1(k) hat.

$$\Theta(k)=\Theta(k-1)+Kp(k)\cdot ID/E(k) \quad (11)$$

where Kp(k) represents a cubic vector determined by the following equation (12) in each control cycle, and determines a rate of change (gain) depending on the identified error ID/E of the identified gain coefficients a1 hat, a2 hat, b1 hat:

$$Kp(k) = \frac{P(k-1)\cdot\xi(k)}{1+\xi^T(k)\cdot P(k-1)\cdot\xi(k)} \quad (12)$$

where P(k) represents a cubic square matrix updated in each control cycle by a recursive formula expressed by the following equation (13):

$$P(k) = \frac{1}{\lambda 1}\left[I - \frac{\lambda 2\cdot P(k-1)\cdot\xi(k)\cdot\xi^T(k)}{\lambda 1+\lambda 2\cdot\xi^T(k)\cdot P(k-1)\cdot\xi(k)}\right]\cdot P(k-1) \quad (13)$$

where I represents a unit matrix. In the equation (13), an initial value P(0) of the matrix P(k) represents a diagonal matrix whose each diagonal component is a positive number, and λ1, λ2 are established to satisfy the conditions $0<\lambda 1\leqq 1$ and $0\leqq\lambda 2<2$.

Depending on how λ1, λ2 in the equation (13) are established, any one of various specific algorithms including a method of least squares, a method of weighted least squares, a fixed gain method, a degressive gain method, a fixed tracing method, etc. may be employed. According to the present embodiment, a method of least squares (λ1=λ2=1), for example, is employed.

Basically, the identifier 23 sequentially updates and determines in each control cycle the identified gain coefficients a1 hat, a2 hat, b1 hat in order to minimize the identified error ID/E according to the above algorithm (specifically, the processing sequence of a sequential method of least squares). Through this processing, it is possible to sequentially obtain the identified gain coefficients a1 hat, a2 hat, b1 hat which match the actual behavior of the object equivalent system 18 on a real-time basis.

The above algorithm is the basic algorithm that is carried out by the identifier 23.

The estimator 24 sequentially determines in each control cycle the estimated differential output VO2 bar which is an estimated value of the differential output VO2 from the $O_2$ sensor 12 after the dead time d in order to compensate for the effect of the dead time d of the object equivalent system 18 for the calculation of the target combined differential air-fuel ratio kcmd/t with the sliding mode controller 25 as described in detail later on.

An algorithm for determining the estimated differential output VO2 bar of the $O_2$ sensor is constructed based on the model of the object equivalent system 18 expressed according to the equation (1), as follows:

By using the equation (1), the estimated differential output VO2(k+d) bar which is an estimated value of the differential output VO2(k+d) of the $O_2$ sensor 12 after the dead time d in each control cycle can be expressed using time-series data VO2(k), VO2(k−1) of the differential output VO2 of the $O_2$ sensor 12 and time-series data kcmd/t(k−j) (j=1, 2, . . . , d) of the past values of the target combined differential air-fuel ratio kcmd/t, according to the following equation (14):

$$\overline{VO2}(k+d) = \alpha 1\cdot VO2(k) + \alpha 2\cdot VO2(k-1) + \sum_{j=1}^{d}\beta j\cdot kcmd/t(k-j) \quad (14)$$

where

α1=the first-row, first-column element of $A^d$,

α2=the first-row, second-column element of $A^d$,

βj=the first-row, first-column elements of $A^{j-1}\cdot B$ $$A = \begin{bmatrix} a1 & a2 \\ 1 & 0 \end{bmatrix} \quad B = \begin{bmatrix} b1 \\ 0 \end{bmatrix}$$

In the equation (14), "α1", "α2" represent the first-row, first-column element and the first-row, second-column element, respectively, of the dth power $A_d$(d: total dead time) of the matrix A defined as described above with respect to the equation (14), and "βj" (j=1, 2, . . . , d) represents the first-row elements of the product $A^{j-1}\cdot B$ of the (j−1)th power $A^{j-1}$(j=1, 2, . . . , d) of the matrix A and the vector B defined as described above with respect to the equation (14).

In the equation (14), the time-series data kcmd/t(k−1), . . . , kcmd/t(k−d) of the past values of the target combined differential air-fuel ratio kcmd/t correspond to the actually used target air-fuel ratio RKCMD that is being used or was used by the fuel supply controller 16 in order to manipulate the air-fuel ratios in the cylinder groups 3, 4 of the engine 1. As described above, the fuel supply controller 16 may occasionally use another target air-fuel ratio than the target air-fuel ratio KCMD determined by the air-fuel ratio processing controller 15 for the manipulation of the air-fuel ratios in the cylinder groups 3, 4. Therefore, as with the identifier 23, it is considered preferable for the estimator 24 to use the actually used target combined differential air-fuel ratio rkcmd/t sequentially determined by the filter 29, rather than the target combined differential air-fuel ratio kcmd/t determined depending on the target air-fuel ratio KCMD generated by the air-fuel ratio processing controller 15, for determining the estimated differential output VO2(k+d) bar while sequentially reflecting the actual behavior of the object system 17 as a basis for the object equivalent system 18.

In the present embodiment, in view of the rkcmd/t(k)=rkcmd/t(k−1) usually, the estimator 24 uses time-series data rkcmd/t(k−j+1) (j=1, 2, . . . , d) of present and past values of the actually used target combined differential air-fuel ratio rkcmd/t sequentially determined by the filter 29, instead of the time-series data kcmd/t (k−j) (j=1, 2, . . . , d) of the past values of the target combined differential air-fuel ratio kcmd/t according to the equation (14). The estimated differential output VO2(k+d) bar in each control cycle is determined according to the following equation (15):

$$\overline{VO2}(k+d) = \alpha 1\cdot VO2(k) + \alpha 2\cdot VO2(k-1) + \sum_{j=1}^{d}\beta j\cdot rkcmd/t(k-j+1) \quad (15)$$

In the present embodiment, therefore, the estimator 24 calculates, in each control cycle, the estimated differential output VO2(k+d) bar according to the equation (15), using the time-series data VO2(k), VO2(k−1) of the present and past values of the differential output VO2 of the $O_2$ sensor 12, and the time-series data rkcmd(k−j+1) (j=1, . . . , d) of the present and vast values of the actually used target combined differential air-fuel ratio rkcmd determined by the filter 29.

The coefficients α1, α2, and β(j) (j=1, 2, . . . , d) required to calculate the equation (15) are calculated according to the definition given with respect to the equation (14), from the latest values (the values determined in the present control cycle) of the identified gain coefficients a1 hat, a2 hat, b1 hat determined by the identifier 23. The dead time d of the object equivalent system 18, which is required to calculate the equation (15), is of the value established as described above.

The above processing sequence is the basic algorithm executed by the estimator 24.

The sliding mode controller 25 will be described in detail below.

The sliding mode controller 25 sequentially determines, in each control cycle, the target combined differential air-fuel ratio kcmd/t as a control input to be given to the object equivalent system 18 for converging the VO2/OUT of the $O_2$ sensor 12 to the target value VO2/TARGET, i.e., for converging the differential output VO2 of the $O_2$ sensor 12 to "0", according to the algorithm of an adaptive sliding mode control process which incorporates an adaptive control law (adaptive algorithm) for minimizing the effect of a disturbance, in a normal sliding mode control process. The algorithm for carrying out the adaptive sliding mode control process is constructed as follows:

A switching function required for the algorithm of the adaptive sliding mode control process carried out by the sliding mode controller 25 and a hyperplane defined by the switching function (also referred to as a slip plane) will first be described below.

According to a basic concept of the sliding mode control process carried out by the sliding mode controller 25, a state quantity to be controlled (controlled quantity) is the time-series data of the differential output VO2 of the $O_2$ sensor 12, and a switching function σ for the sliding mode control process is defined according to the following equation (16):

$$\sigma(k) = s1 \cdot VO2(k) + s2 \cdot VO2(k-1) = S \cdot X \tag{16}$$

where $$S = [\,s1 \quad s2\,]$$

$$X = \begin{bmatrix} VO2(k) \\ VO2(k-1) \end{bmatrix}$$

The switching function σ is defined by a linear function having as components a plurality of (two in this embodiment) time-series data VO2(k), VO2(k−1) prior to the present time of the differential output VO2 of the $O_2$ sensor 12, i.e., a linear combination of the time-series data VO2(k), VO2(k−1), more specifically, differential outputs VO2(k), VO2(k−1) in the present and preceding control cycles. The vector X defined in the equation (16) as a vector having the differential outputs VO2(k), VO2(k−1) as its components will hereinafter be referred to as a state quantity X.

The coefficients s1, s2 relative to the components VO2(k), VO2(k−1) of the switching function σ are set in advance to values to meet the condition of the following equation (17):

$$-1 < \frac{s2}{s1} < 1 \tag{17}$$

(when s1=1, −1<s2<1)

In the present embodiment, for the sake of brevity, the coefficient s1 is set to s1=1(s2/s1=s2), and the coefficient s2(constant value) is established to satisfy the condition: −1<s2<1.

Figure 5:
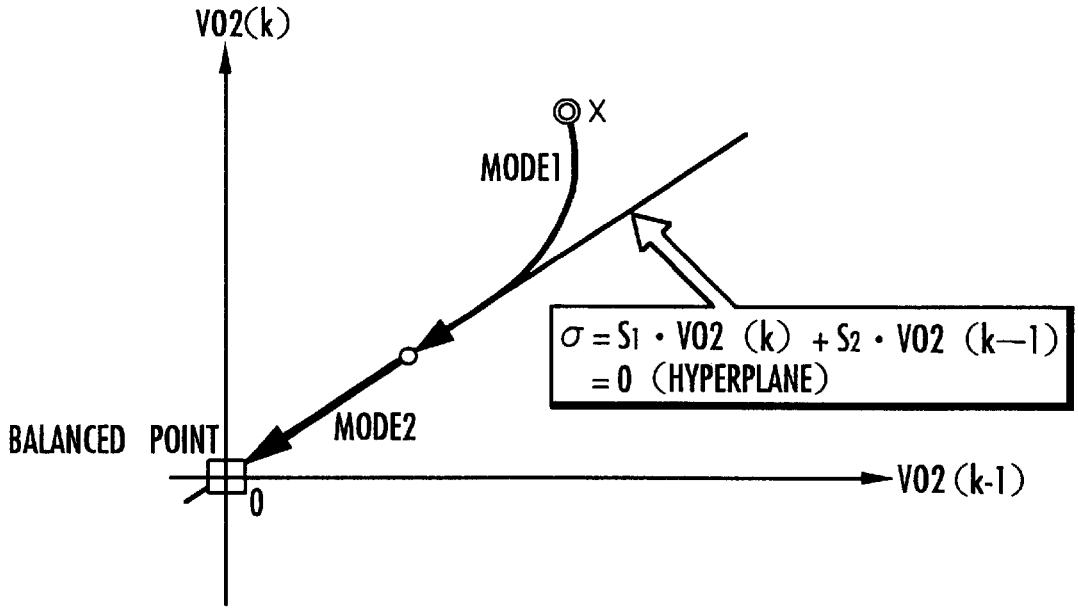
FIG. 5 is a diagram illustrative of a sliding mode control process employed by the exhaust system controller of the air-fuel ratio control apparatus shown in FIG. 1.

With the switching function σ thus defined, the hyperplane for the sliding mode control process is defined by the equation σ=0. Since the state quantity X is of the second degree, the hyperplane σ=0 is represented by a straight line as shown in FIG. 5. At this time, the hyperplane is called also a switching line.

In the present embodiment, the time-series data of the estimated differential output VO2 bar determined by the estimator 24 is actually used as the components of the switching function, as described later on.

The adaptive sliding mode control process performed by the sliding mode controller 25 serves to converge the state quantity X (VO2(k), VO2(k−1)) onto the hyperplane σ=0 according to a reaching control law which is a control law for converging the state quantity X onto the hyperplane σ=0, i.e., for converging the value of the switching function σ to"0", and an adaptive control law (adaptive algorithm) which is a control law for compensating for the effect of a disturbance in converging the state quantity X onto the hyperplane σ=0(model in FIG. 5). While converging the state quantity X onto the hyperplane σ=0 according to an equivalent control input (holding the value of the switching function σ at "0"), the state quantity X is converged to a balanced point on the hyperplane σ=0 where VO2(k)=VO2(k−1)=0, i.e., a point where time-series data VO2/OUT(k), VO2/OUT(k−1) of the output VO2/OUT of the $O_2$ sensor 12 are equal to the target value VO2/TARGET (mode 2 in FIG. 5).

In the normal sliding mode control process, the adaptive control law is omitted in the mode1, and the state quantity X is converged onto the hyperplane σ=0 only according to the reaching control law.

The target combined differential air-fuel ratio kcmd/t to be generated by the sliding mode controller 25 for converging the state quantity X to the balanced point on the hyperplane σ=0 is expressed as the sum of an equivalent control input Ueq which is an input component to be applied to the object equivalent system 18 according to the control law for converging the state quantity X onto the hyperplane σ=0, an input component Urch (hereinafter referred to as "reaching control law input Urch") to be applied to the object equivalent system 18 according to the reaching control law, and an input component Uadp (hereinafter referred to as "adaptive control law input Uadp") to be applied to the object equivalent system 18 according to the adaptive control law (see the following equation (18)).

$$kcmd/t(k) = Ueq(k) + Urch(k) + Uadp(k) \tag{18}$$

The equivalent control input Ueq, the reaching control law input Urch, and the adaptive control law input Uadp are determined on the basis of the model of the object equivalent system 18 expressed by the equation (1), as follows:

The equivalent control input Ueq which is an input component to be applied to the object equivalent system 18 for converging the state quantity X onto the hyperplane σ=0(holding the value of switching function σ at "0") is the target combined differential air-fuel ratio kcmd/t which satisfies the condition: σ((k+1)=σ(k)=0. Using the equations (1), (16), the equivalent control input Ueq which satisfies the above condition is given by the following equation (19):

$$Ueq(k) = \frac{-1}{s1 \cdot b1} \cdot \{[s1 \cdot (a1-1) + s2] \cdot VO2(k+d) + (s1 \cdot a2 - s2) \cdot VO2(k+d-1)\} \tag{19}$$

The equation (19) is a basic formula for determining the equivalent control input Ueq(k) in each control cycle.

According to present embodiment, the reaching control law input Urch is basically determined according to the following equation (20):

$$Urch(k) = \frac{-1}{s1 \cdot b1} \cdot F \cdot \sigma(k+d) \tag{20}$$

Specifically, the reaching control law input Urch(k) in each control cycle is determined in proportion to the value of the switching function σ((k+d) after the dead time d, in view of the dead time d of the object equivalent system 18.

The coefficient F (which determines the gain of the reaching control law) in the equation (20) is established to satisfy the condition expressed by the following equation (21):

$$0<F<2 \tag{21}$$

(Preferably,0<F<1)

The preferable condition expressed by the equation (21) is a condition preferable to prevent the value of the switching function σ from varying in an oscillating fashion (so-called chattering) with respect to "0".

The adaptive control law input Uadp is basically determined according to the following equation (22) (ΔT in the equation (22) represents the period (constant value) of the control cycles of the air-fuel ratio processing controller 15:

$$Uadp(k) = \frac{-1}{s1 \cdot b1} \cdot G \cdot \sum_{i=0}^{k+d} (\sigma(i) \cdot \Delta T) \tag{22}$$

The adaptive control law input Uadp(k) in each control cycle is determined in proportion to an integrated value (which corresponds to an integral of the values of the switching function σ) over control cycles of the product of values of the switching function σ until after the dead time d and the period ΔT of the control cycles, in view of the dead time d.

The coefficient G (which determines the gain of the adaptive control law) in the equation (22) is established to satisfy the condition of the following equation (23):

$$G = J \cdot \frac{2-F}{\Delta T} \tag{23}$$

$$(0 < J < 2)$$

A specific process of deriving conditions for establishing the equations (22), (23) is described in detail in Japanese patent application No. 11-93741 or U.S. Pat. No. 6,082,099, and will not be described in detail below.

The target combined differential air-fuel ratio kcmd/t generated by the sliding mode controller 25 as a control input to be given to the object equivalent system 18 may basically be determined as the sum (Ueq+Urch+Uadp) of the equivalent control input Ueq, the reaching control law input Urch, and the adaptive control law input Uadp determined according to the respective equations (19), (20), (22). However, the differential outputs VO2(k+d), VO2 (k+d−1) of the $O_2$ sensor 12 and the value σ(k+d) of the switching function σ, etc. used in the equations (19), (20), (22) cannot directly be obtained as they are values in the future.

Therefore, the sliding mode controller 25 uses the estimated differential outputs VO2(k+d) bar, VO2(k+d−1) bar determined by the estimator 24, instead of the differential outputs VO2(K+d), VO2(k+d−1) required to calculate the equation (19), and calculates the equivalent control input Ueq(k) in each control cycle according to the following equation (24):

$$Ueq(k) = \frac{-1}{s1 \cdot b1} \cdot \{[s1 \cdot (a1-1) + s2] \cdot \overline{VO2}(k+d) + (s1 \cdot a2 - s2) \cdot \overline{VO2}(k+d-1)\} \tag{24}$$

According to present embodiment, furthermore, the sliding mode controller 25 actually uses time-series data of the estimated differential output VO2 bar sequentially determined by the estimator 24 as described above as a state quantity to be controlled. The sliding mode controller 25 defines a switching function σ bar according to the following equation (25) (the switching function σ bar corresponds to time-series data of the differential output VO2 in the equation (16) which is replaced with time-series data of the estimated differential output VO2 bar), in place of the switching function σ defined by the equation (16):

$$\overline{\sigma}(k) = s1 \cdot \overline{VO2}(k) + s2 \cdot \overline{VO2}(k-1) \tag{25}$$

The sliding mode controller 25 calculates the reaching control law input Urch(k) in each control cycle according to the following equation (26), using the value of the switching function σ bar represented by the equation (25), rather than the value of the switching function σ for determining the reaching control law input Urch according to the equation (20):

$$Urch(k) = \frac{-1}{s1 \cdot b1} \cdot F \cdot \overline{\sigma}(k+d) \tag{26}$$

Similarly, the sliding mode controller 25 calculates the adaptive control law input Uadp(k) in each control cycle according to the following equation (27), using the value of the switching function σ bar represented by the equation (20), rather than the value of the switching function σ for determining the adaptive control law input Uadp according to the equation (22):

$$Uadp(k) = \frac{-1}{s1 \cdot b1} \cdot G \cdot \sum_{i=0}^{k+d} (\overline{\sigma}(i) \cdot \Delta T) \tag{27}$$

The latest identified gain coefficients a1(k) hat, a2(k) hat, b1(k) hat which have been determined by the identifier 23 are basically used as the gain coefficients a1, a1, b1 that are required to calculate the equivalent control input ueq, the reaching control law input Urch, and the adaptive control law input Uadp according to the equations (24), (26), (27).

The sliding mode controller 25 determines the sum of the equivalent control input ueq, the reaching control law input Urch, and the adaptive control law input Uadp determined according to the equations (24), (26), (27), as the target combined differential air-fuel ratio kcmd/t (see the equation (18)). The conditions for establishing the coefficients s1, s2, F, G used in the equations (24), (26), (27) are as described above.

The target combined differential air-fuel ratio kcmd/t determined by the sliding mode controller 25 as described above is a control input to be given to the object equivalent system 18 for converging the estimated differential output VO2 bar from the $O_2$ sensor 12 to "0", and as a result, for converging the output VO2/OUT from the $O_2$ sensor 12 to the target value VO2/TARGET.

The above process is a basic algorithm for generating the target combined differential output kcmd/t in each control cycle by the sliding mode controller 25.

The fuel supply controller 16 will be described below.

Figure 6:
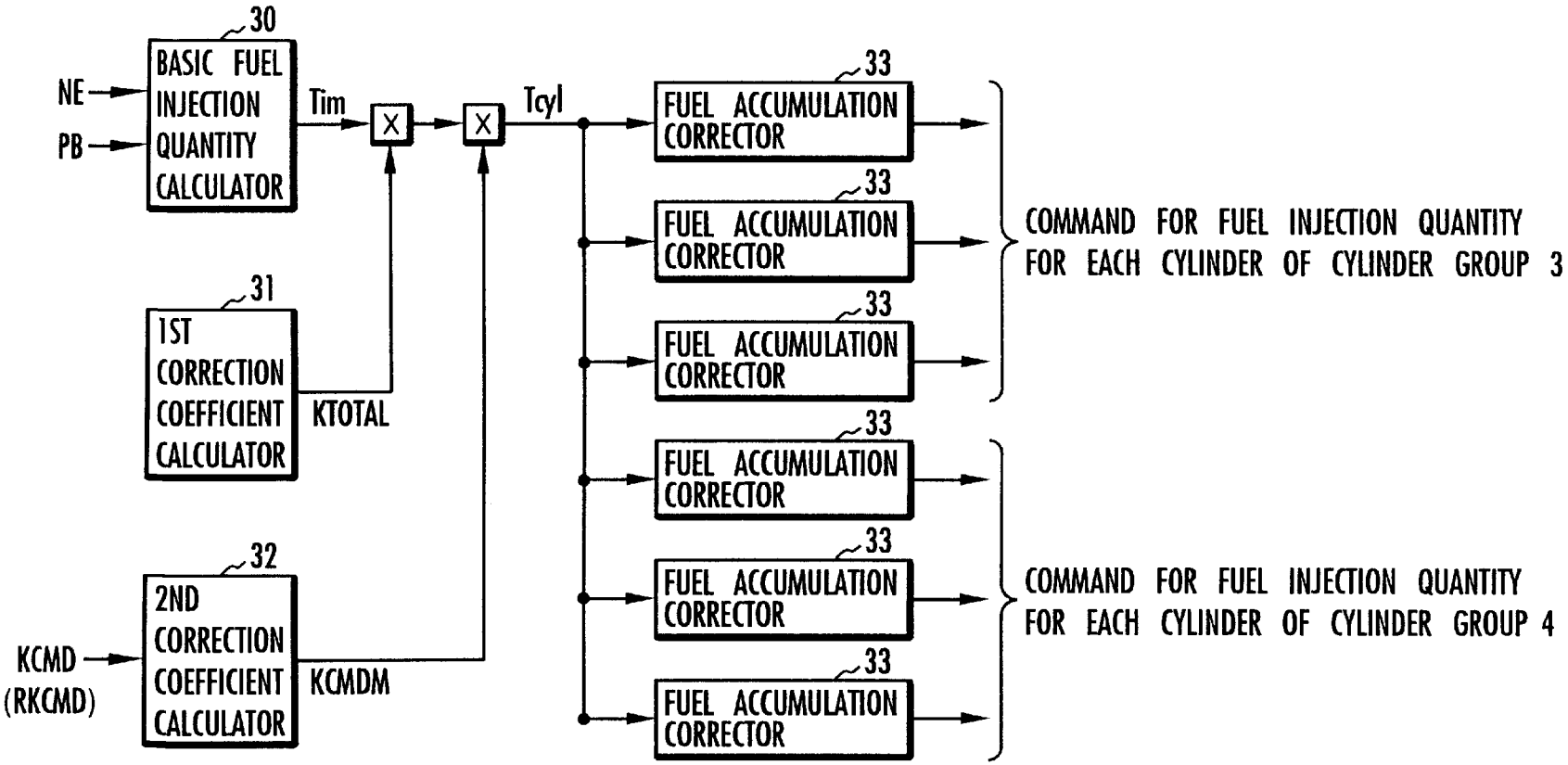
FIG. 6 is a block diagram of a basic arrangement of a fuel supply controller of the air-fuel ratio control apparatus shown in FIG. 1.

As shown in FIG. 6, the fuel supply controller 16 has, as its main functions, a basic fuel injection quantity calculator 30 for determining a basic fuel injection quantity Tim to be injected into the engine 1, a first correction coefficient calculator 31 for determining a first correction coefficient KTOTAL to correct the basic fuel injection quantity Tim, a second correction coefficient calculator 32 for determining a second correction coefficient KCMDM to correct the basic fuel injection quantity Tim, and a plurality of fuel accumulation correctors 33, i.e., as many fuel accumulation correctors 33 as the number of cylinders of the engine 1, for correcting an output fuel injection quantity Tout, which is produced by correcting the basic fuel injection quantity Tim with the first correction coefficient KTOTAL and the second correction coefficient KCMDM, in view of accumulated fuel particles on intake pipe walls, for the respective cylinders of the cylinder groups 3, 4 of the engine 1.

The basic fuel injection quantity calculator 30 determines a reference fuel injection quantity (fuel supply quantity) from the rotational speed NE and intake pressure PB of the engine 1 using a predetermined map, and corrects the determined reference fuel injection quantity depending on the effective opening area of a throttle valve (not shown) of the engine 1, thereby calculating a basic fuel injection quantity Tim. The basic fuel injection quantity Tim is basically a fuel injection quantity such that the ratio between the quantity of air and the basic fuel injection quantity Tim that are introduced into each of the cylinders of the engine 1 per crankshaft angle period (1TDC) of the engine 1, i.e., the air-fuel ratio, becomes a stoichiometric ratio. The basic fuel injection quantity Tim is shared by the cylinder groups 3, 4.

The first correction coefficient KTOTAL determined by the first correction coefficient calculator 31 serves to correct the basic fuel injection quantity Tim in view of an exhaust gas recirculation ratio of the engine 1, i.e., the proportion of an exhaust gas contained in an air-fuel mixture introduced into the engine 1, an amount of purged fuel supplied to the engine 1 when a canister (not shown) is purged, a coolant temperature, an intake temperature, etc. of the engine 1.

The second correction coefficient KCMDM determined by the second correction coefficient calculator 32 serves to correct the basic fuel injection quantity Tim according to a feed-forward control process in order to manipulate the air-fuel ratio of the air-fuel mixture combusted in each of the cylinder groups 3, 4 of the engine 1 into the target air-fuel ratio KCMD generated by the air-fuel ratio processing controller 15. The second correction coefficient KCMDM is determined from the target air-fuel ratio KCMD using a predetermined data table (not shown). The second correction coefficient KCMDM determined using the data table is of a value "1" when the target air-fuel ratio KCMD is equal to the stoichiometric ratio, and becomes greater than the value "1" as the target air-fuel ratio KCMD is of a value representing richer fuel than the stoichiometric ratio. The second correction coefficient KCMDM becomes smaller than the value "1" as the target air-fuel ratio KCMD is of a value representing leaner fuel than the stoichiometric ratio. More specifically, the second correction coefficient KCMDM represents the reciprocal of the ratio of the target air-fuel ratio KCMD to the stoichiometric ratio (target air-fuel ratio KCMD/stoichiometric ratio) as corrected in view of the charging efficiency of an air-fuel mixture due to the cooling effect of fuel injected into the engine 1.

The basic fuel injection quantity Tim, the first correction coefficient KTOTAL, and the second correction coefficient KCMDM are shared by the cylinder groups 3, 4 of the engine 1.

The fuel supply controller 16 multiplies the basic fuel injection quantity Tim by the first correction coefficient KTOTAL and the second correction coefficient KCMDM thus determined thereby to correct the basic fuel injection quantity Tim, and obtains the corrected value of the basic fuel injection quantity Tim as the output fuel injection quantity Tim. The fuel accumulation correctors 33 of the fuel supply controller 16 then correct the output fuel injection quantity Tim in view of accumulated fuel particles on intake pipe walls, for the respective cylinders of the cylinder groups 3, 4 of the engine 1, determines the corrected output fuel injection quantity Tim as a final command value for the fuel injection quantity for each of the cylinders of the cylinder groups 3, 4, and gives the determined final command value to a fuel injector (not shown).

Specific details of processes for calculating the basic fuel injection quantity Tim, the first correction coefficient KTOTAL, and the second correction coefficient KCMDM are disclosed in detail in Japanese laid-open patent publication No. 5-79374 or U.S. Pat. No. 5,253,630, and will not be described below. The correction of the output fuel injection quantity in view of accumulated fuel particles on intake pipe walls as carried out by the fuel accumulation correctors 33 is disclosed in detail in Japanese laid-open patent publication No. 8-21273 and U.S. Pat. No. 5,568,799, for example, and will not be described in detail below.

In the above description of the fuel supply controller 16, the target air-fuel ratio KCMD generated by the air-fuel ratio processing controller 15 at all times is used for controlling the air-fuel ratio of each of the cylinder groups 3, 4. Specifically, the second correction coefficient calculator 32 may use a target air-fuel ratio determined separately from the target air-fuel ratio KCMD sequentially generated by the air-fuel ratio processing controller 15 for controlling the air-fuel ratio in the cylinder groups 3, 4 under certain operating conditions, described later on, of the engine 1, specifically, when the supply of fuel to the engine 1 is cut off or the throttle valve is fully opened. In such a case, the target air-fuel ratio KCMD used in the above control process is forcibly set to the separately determined target air-fuel ratio to control the air-fuel ratio in the cylinder groups 3, 4. Thus, the target air-fuel ratio KCMD used by the second correction coefficient calculator 32 for its processing is actually the actually used target air-fuel ratio RKCMD (usually, RKCMD=KCMD).

Operation of the entire system according to the present embodiment will be described below.

First, a control process carried out by the fuel supply controller 16 will be described below with reference to FIGS. 7 and 8.

The fuel supply controller 16 performs the control process in control cycles in synchronism with a crankshaft angle period (TDC) of the engine 1 as follows:

The fuel supply controller 16 reads outputs from various sensors including sensors for detecting the rotational speed NE and intake pressure PB of the engine 1, the $O_2$ sensor 12 in STEPa.

At this time, the output VO2/OUT of the $O_2$ sensor 12 which is required by the processing carried out by the air-fuel ratio processing controller 15 is given via the fuel supply controller 16 to the air-fuel ratio processing controller 15. Therefore, the read data of the output VO2/OUT, including data obtained in past control cycles, are stored in a time-series fashion in a memory (not shown).

Then, the basic fuel injection quantity calculator 30 corrects a fuel injection quantity corresponding to the rotational speed NE and intake pressure PB of the engine 1 depending on the effective opening area of the throttle valve, thereby calculating a basic fuel injection quantity Tim in STEPb. The first correction coefficient calculator 31 calculates a first correction coefficient KTOTAL depending on the coolant temperature and the amount by which the canister is purged in STEPc.

The fuel supply controller 16 decides whether the target air-fuel ratio KCMD generated by the air-fuel ratio processing controller 15 is to be used or not, i.e., determines ON/OFF of an air-fuel ratio manipulating process, in order to actually manipulate the air-fuel ratio in the cylinder groups 3, 4 of the engine 1, and sets a value of a flag f/prism/on which represents ON/OFF of the air-fuel ratio manipulating process in STEPd. When the value of the flag f/prism/on is "0", it means that the target air-fuel ratio KCMD generated by the air-fuel ratio processing controller 15 is not to be used (OFF), and when the value of the flag f/prism/on is "1", it means that the target air-fuel ratio KCMD generated by the air-fuel ratio processing controller 15 is to be used (ON).

Figure 8:
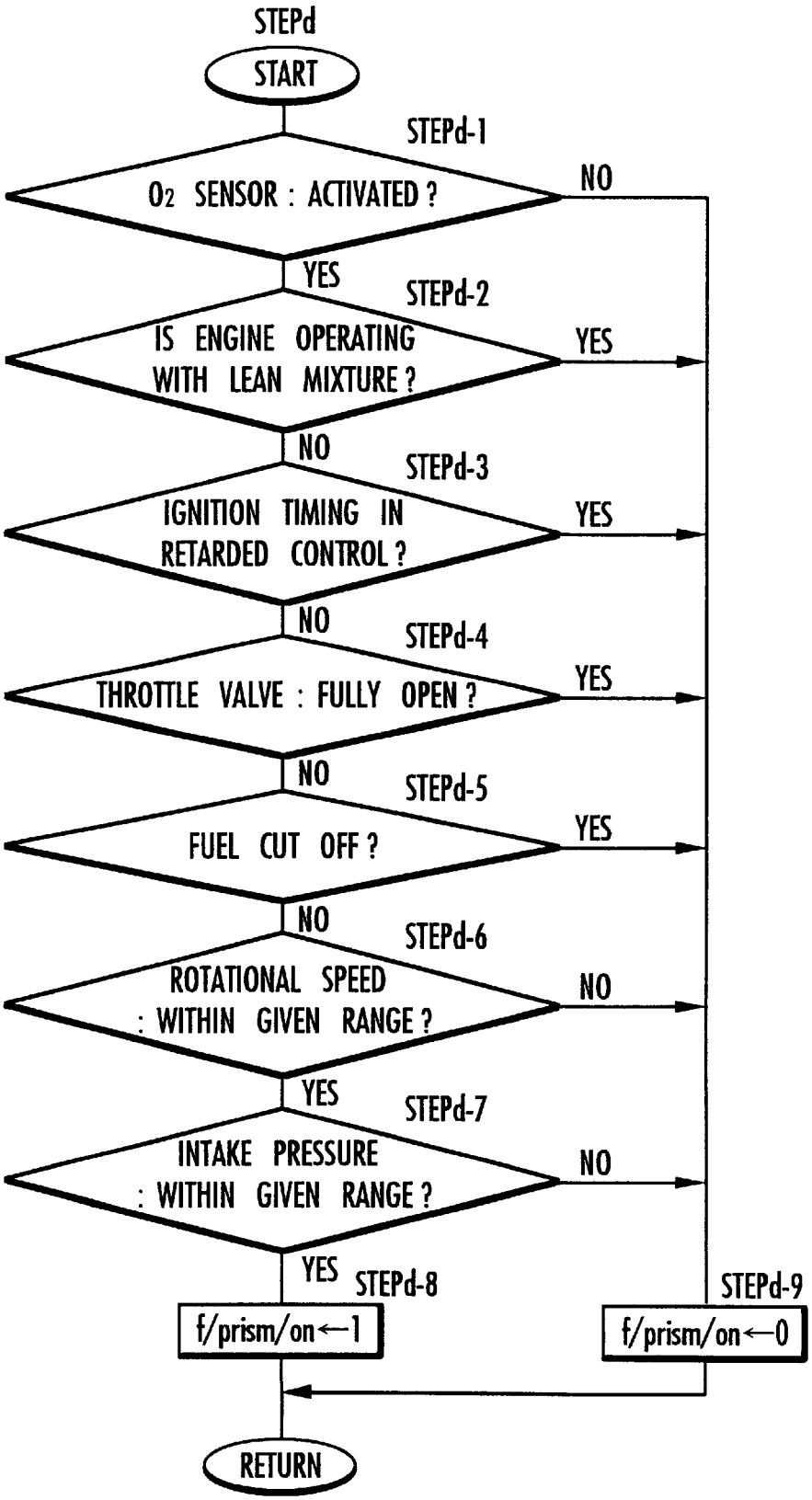
FIG. 8 is a flowchart of a subroutine of the processing sequence shown in FIG. 7.

The deciding subroutine of STEPd is shown in detail in FIG. 8. As shown in FIG. 8, the fuel supply controller 16 decides whether the $O_2$ sensor 12 is activated or not in STEPd-1. The fuel supply controller 16 decides whether the $O_2$ sensor 12 is activated or not based on the output voltage of the $O_2$ sensor 12, for example.

If the $O_2$ sensor 12 is not activated, since detected data from the $O_2$ sensor 12 for use by the air-fuel processing controller 15 is not accurate enough, the value of the flag f/prism/on is set to"0" in STEPd-9.

Then, the fuel supply controller 16 decides whether the engine 1 is operating with a lean air-fuel mixture or not in STEPd-2. The fuel supply controller 16 decides whether the ignition timing of the engine 1 is retarded for early activation of the catalytic converters 9, 10, 11 immediately after the start of the engine 1 or not in STEPd-3. The fuel supply controller 16 decides whether the throttle valve of the engine 1 is fully open or not in STEPd-4. The fuel supply controller 16 decides whether the supply of fuel to the engine 1 is being stopped or not in STEPd-5. If either one of the conditions of these steps is satisfied, then since it is not preferable or possible to manipulate the air-fuel ratio of the engine 1 using the target air-fuel ratio KCMD generated by the air-fuel ratio * processing controller 15, the value of the flag f/prism/on is set to"0" in STEPd-9.

The fuel supply controller 16 then decides whether the rotational speed NE and the intake pressure PB of the engine 1 fall within respective given ranges or not respectively in STEPd-6, STEPd-7. If either one of the rotational speed NE and the intake pressure PB does not fall within its given range, then since it is not preferable or possible to manipulate the air-fuel ratio of the engine 1 using the target air-fuel ratio KCMD generated by the air-fuel ratio processing controller 15, the value of the flag f/prism/on is set to "0" in STEPd-9.

If the conditions of STEPd-1, STEPd-6, STEPd-7 are satisfied, and the conditions of STEPd-2, STEPd-3, STEPd-4, STEPd-5 are not satisfied (the engine 1 is in normal operation in these cases), then the value of the flag f/prism/on is set to "1" to use the target air-fuel ratio KCMD generated by the air-fuel ratio processing controller 15 for manipulating the air-fuel ratio of the engine 1 in STEPd-8.

Figure 7:
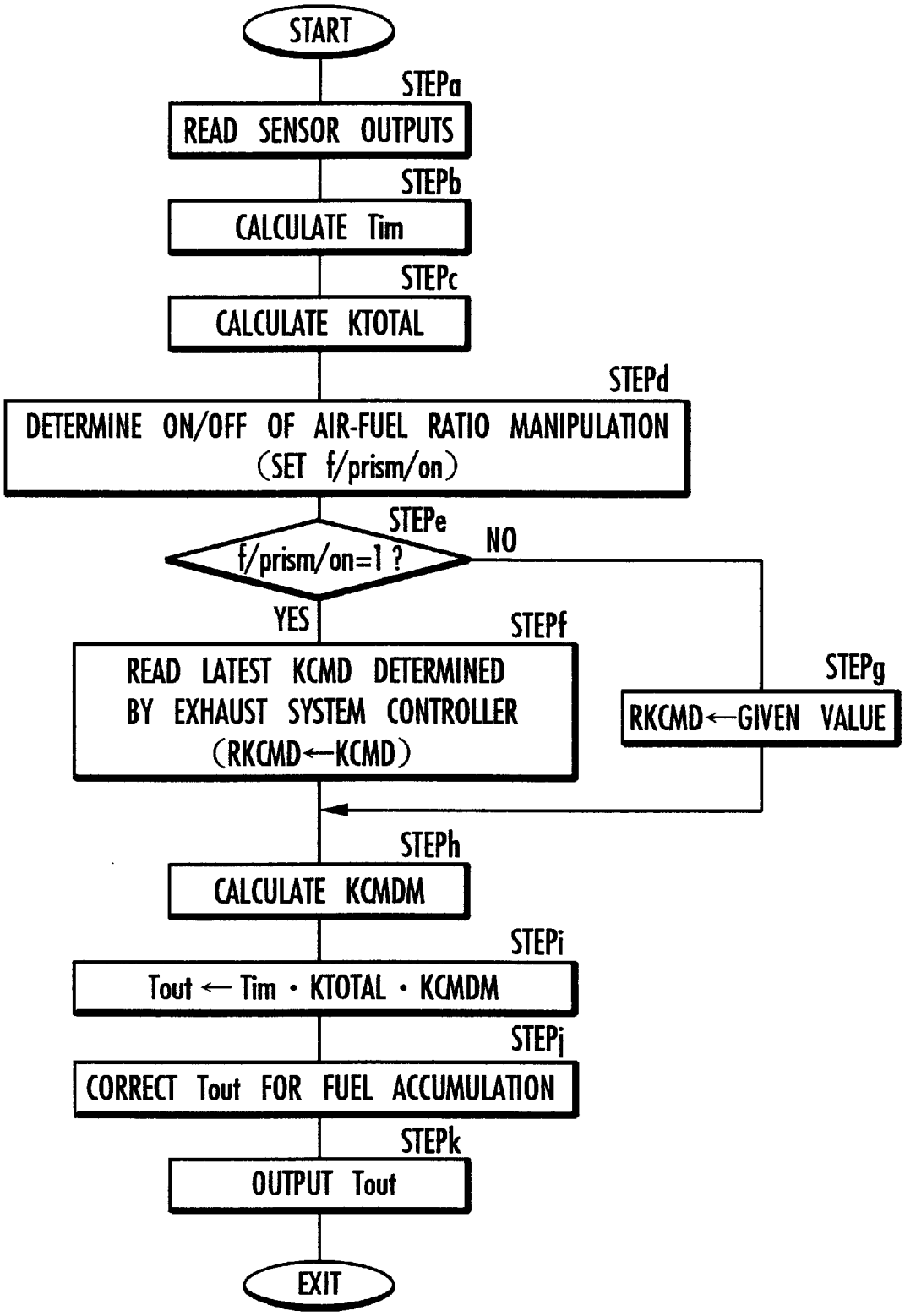
FIG. 7 is a flowchart of a processing sequence of the fuel supply controller of the air-fuel ratio control apparatus shown in FIG. 1.

In FIG. 7, after the value of the flag f/prism/on has been set as described above, the fuel supply controller 16 determines the value of the flag f/prism/on in STEPe. If f/prism/on=1, then the fuel supply controller 16 reads the latest target air-fuel ratio KCMD generated by the air-fuel ratio processing controller 15 as the actually used target air-fuel ratio RKCMD in the present control cycle in STEPf. If f/prism/on=0, then the fuel supply controller 16 sets a value determined from the rotational speed NE and intake pressure PB of the engine 1 using a predetermined map, for example, as the actually used target air-fuel ratio RKCMD in the present control cycle in STEPg.

The value of the actually used target air-fuel ratio RKCMD determined by the fuel supply controller 16 in the processing in STEPe–STEPg is stored in a time-series fashion in a memory (not shown) in the fuel supply controller 16.

The second correction coefficient calculator 32 calculates in STEPh a second correction coefficient KCMDM depending on the actually used target air-fuel ratio RKCMD determined in STEPf or STEPg.

Then, the fuel supply controller 16 multiplies the basic fuel injection quantity Tim, determined as described above, by the first correction coefficient KTOTAL and the second correction coefficient KCMDM, determining an output fuel injection quantity Tout for each of the cylinder groups 3, 4 in STEPi. The output fuel injection quantity Tout is then corrected for accumulated fuel particles on intake pipe walls of the cylinders of the cylinder groups 3, 4 by the fuel accumulation correctors 33 in STEPj. The corrected output fuel injection quantity Tout is applied as a final fuel injection quantity command value to the nonillustrated fuel injectors of the engine 1 in STEPk.

In the engine 1, the fuel injectors inject fuel into the respective cylinders of the cylinder groups 3, 4 according to the output fuel injection quantity Tout.

The above control of the fuel injection of the engine 1 is carried out in successive cycles synchronous with the crankshaft angle period (TDC) of the engine 1 for controlling, according to a feed-forward control process, the air-fuel ratio of the air-fuel mixture combusted in the cylinder groups 3, 4 at the actually used target air-fuel ratio RKCMD, which usually is equal to the target air-fuel ratio KCMD generated by the air-fuel ratio processing controller 15. That is, the air-fuel ratio of the air-fuel mixture combusted in the cylinder groups 3, 4 is manipulated into the actually used target air-fuel ratio RKCMD according to a feed-forward control process.

Figure 9:
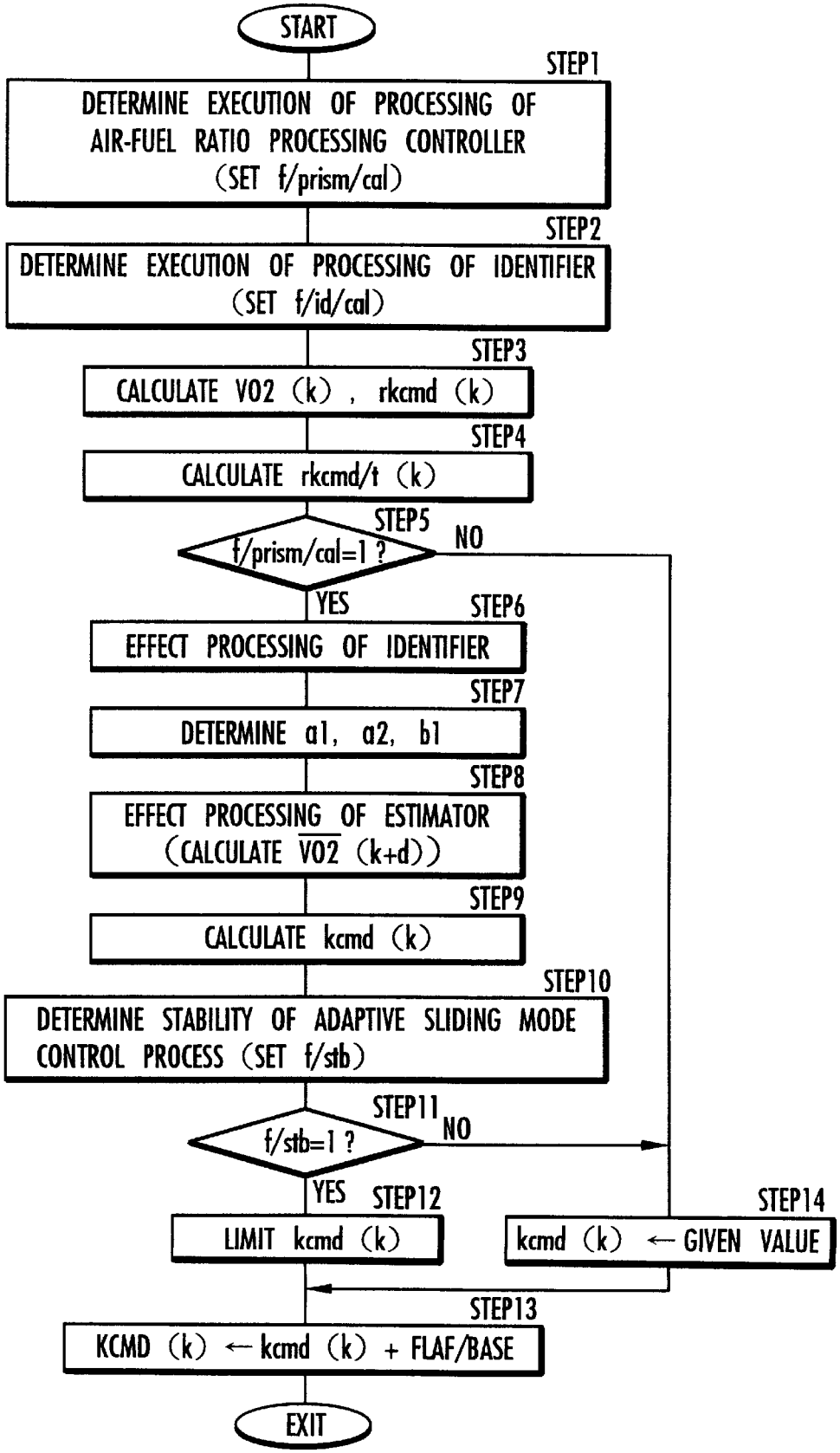
FIG. 9 is a flowchart of a processing sequence of the exhaust system controller of the air-fuel ratio control apparatus shown in FIG. 1.

Concurrent with the above air-fuel ratio manipulation for the engine 1, i.e., the above control of the fuel injection quantity, the air-fuel ratio processing controller 15 executes a main routine shown in FIG. 9 in control cycles of a constant period.

As shown in FIG. 9, the air-fuel ratio processing controller 15 decides whether its own processing (the processing of the identifier 23, the estimator 24, and the sliding mode controller 25) is to be executed or not, and sets a value of a flag f/prism/cal indicative of whether the processing is to be executed or not in STEP1. When the value of the flag f/prism/cal is "0", it means that the processing of the air-fuel ratio processing controller 15 is not to be executed, and when the value of the flag f/prism/cal is "1", it means that the processing of the air-fuel ratio processing controller 15 is to be executed.

Figure 10:
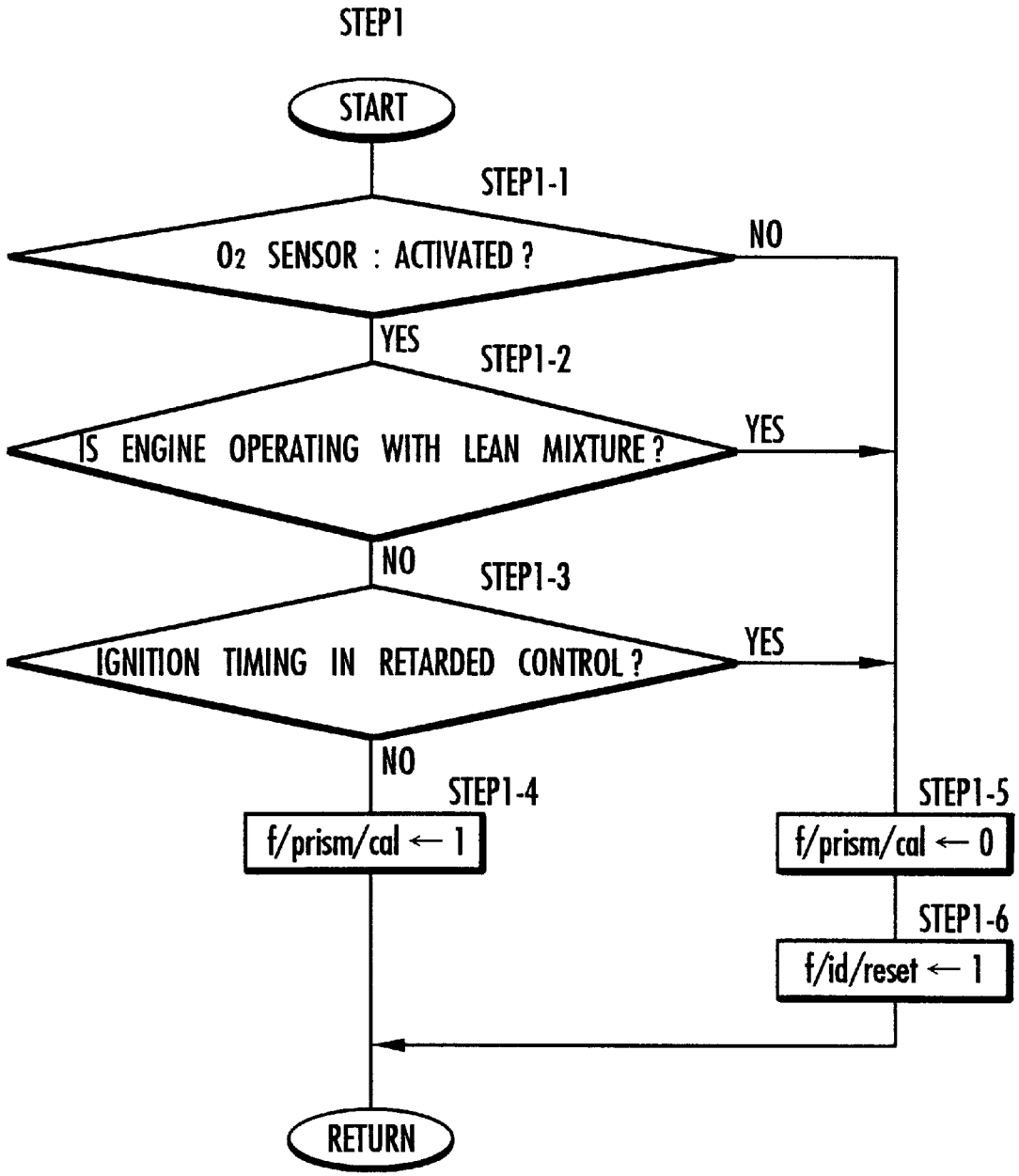
FIG. 10 is a flowchart of a subroutine of the processing sequence shown in FIG. 9.

The deciding subroutine in STEP1 is shown in detail in FIG. 10. As shown in FIG. 10, the air-fuel ratio processing controller 15 decides whether the $O_2$ sensor 12 is activated or not in STEP1-1. If the $O_2$ sensor 12 is not activated, since detected data from the $O_2$ sensor 12 for use by the air-fuel ratio processing controller 15 is not accurate enough, the value of the flag f/prism/cal is set to "0" in STEP1-5.

Then, in order to initialize the identifier 23 as described later on, the value of a flag f/id/reset indicative of whether the identifier 23 is to be initialized or not is set to "1" in STEP1-6. When the value of the flag f/id/reset is "1", it means that the identifier 23 is to be initialized, and when the value of the flag f/id/reset is "0", it means that the identifier 23 is not to be initialized.

The air-fuel ratio processing controller 15 decides whether the engine 1 is operating with a lean air-fuel mixture or not in STEP1-2. The air-fuel ratio processing controller 15 decides whether the ignition timing of the engine 1 is retarded for early activation of the catalytic converters 9, 10, 11 immediately after the start of the engine 1 or not in STEP1-3. If the conditions of these steps are satisfied, then since the target air-fuel ratio KCMD calculated to convert the output VO2/OUT of the $O_2$ sensor 12 to the target value VO2/TARGET is not used for the fuel control for the engine 1, the value of the flag f/prism/cal is set to "0" in STEP1-5, and the value of the flag f/id/reset is set to "1" in order to initialize the identifier 23 in STEP1-6.

If the condition of STEP1-1 is satisfied and the conditions of STEP1-2, STEP1-3 are not satisfied, then the value of the flag f/prism/cal is set to "1" in STEP1-4.

By thus setting the flag f/prism/cal, even in a situation where the target air-fuel ratio KCMD generated by the air-fuel ratio processing controller 15 is not used by the fuel supply controller 16 (see FIG. 8), when the supply of fuel to the engine 1 is being cut off or when the throttle valve is being fully open, the flag f/prism/cal is set to "1". When the supply of fuel to the engine 1 is being cut off or when the throttle valve is being fully open, therefore, the air-fuel ratio processing controller 15 performs the operating processes of the identifier 23, the estimator 24, and the sliding mode controller 25, or specifically performs the process of determining the target combined differential air-fuel ratio kcmd/t in order to converge the output VO2/OUT of the $O_2$ sensor 12 to the target value VO2/TARGET. This is because such an operating situation of the engine 1 is basically temporary.

In FIG. 9, after the above deciding subroutine, the air-fuel ratio processing controller 15 decides whether a process of identifying (updating) the gain coefficients a1, a2, b1 with the identifier 23 is to be executed or not, and sets a value of a flag f/id/cal indicative of whether the process of identifying (updating) the gain coefficients a1, a2, b1 is to be executed or not in STEP2. When the value of the flag f/id/cal is "0", it means that the process of identifying (updating) the gain coefficients a1, a2, b1 is not to be executed, and when the value of the flag f/id/cal is "1", it means that the process of identifying (updating) the gain coefficients a1, a2, b1 is to be executed.

The deciding subroutine of STEP2 is carried out as follows: The air-fuel ratio processing controller 15 decides whether the throttle valve of the engine 1 is fully open or not, and also decides whether the supply of fuel to the internal combustion engine 1 is being stopped or not. If either one of these conditions is satisfied, then since it is impossible to identify the gain coefficients a1, a2, b1 appropriately, the value of the flag f/id/cal is set to "0". If neither one of these conditions is satisfied, then the value of the flag f/id/cal is set to "1" to identify (update) the gain coefficients a1, a2, b1 with the identifier 23.

The air-fuel ratio processing controller 15 calculates the latest differential output VO2(k) (=VO2/OUT−VO2/TARGET) of the $O_2$ sensor 12 with the subtractor 22 in STEP3.

Specifically, the subtractor 22 selects a latest one of the time-series data of the output of VO2/OUT of the $O_2$ sensor 12 which have been read by the fuel supply controller 16 and stored in the non-illustrated memory in STEPa shown in FIG. 7, and calculate the differential output VO2(k).

In STEP3, the subtractor 28 calculates the actually used target differential air-fuel ratio rkcmd(k) (=RKCMD−FLAF/BASE) corresponding to the actually used target air-fuel ratio RKCMD that is presently used by the fuel supply controller 16 for controlling the air-fuel ratio in each of the cylinder groups 3, 4.

Specifically, the subtractor 28 selects a latest one of the time-series data of the actually used target air-fuel ratio RKCMD which is stored in the non-illustrated memory in each control cycle by the fuel supply controller 16, and calculates the actually used target differential air-fuel ratio rkcmd. The actually used target air-fuel ratio RKCMD which is presently used by the fuel supply controller 16 corresponds to the target air-fuel ratio KCMD(k−1) determined in the preceding control cycle by the air-fuel ratio processing controller 15, and is usually equal to the target air-fuel ratio KCMD(k−1).

The differential output VO2 and the actually used target differential air-fuel ratio rkcmd that are calculated in STEP3 are stored, together with those calculated in the past, in a time-series manner in the non-illustrated memory in the air-fuel ratio processing controller 15.

Then, in STEP4, the filter 29 calculates the actually used target combined differential air-fuel ratio rkcmd/t(k) in the present control cycle.

Specifically, the filter 29 selects time-series data rkcmd(k), rkcmd(k−1), rkcmd(k−dD), rkcmd(k−dD−1) of the present and past values of the actually used target differential air-fuel ratio rkcmd, from the time-series data of the actually used target differential air-fuel ratio rkcmd thus stored, and calculates the right side of the equation (7) using those selected data for thereby calculating the actually used target combined differential air-fuel ratio rkcmd/t(k).

The actually used target combined differential air-fuel ratio rkcmd which is calculated in STEP4 is stored, together with those calculated in the past, in a time-series manner in the non-illustrated manner in the air-fuel ratio processing controller 15.

Then, in STEP5, the air-fuel ratio processing controller 15 determines the value of the flag f/prism/cal set in STEP1. If f/prism/cal=0, i.e., if the processing of the air-fuel ratio processing controller 15 is not to be executed, then the air-fuel ratio processing controller 15 forcibly sets the target differential air-fuel ratio kcmd(k) in the present control cycle to a predetermined value in STEP14. The predetermined value may be a predetermined fixed value (e.g.,"0") or a value kcmd(k−1) of the target differential air-fuel ratio kcmd determined in the preceding control cycle, for example.

After the target differential air-fuel ratio kcmd(k) is set to the predetermined value, the adder 27 adds the reference air-fuel ratio FLAF/BASE to the target differential air-fuel ratio kcmd(k) of the predetermined value, thus determining the target air-fuel ratio KCMD(k) in the present control cycle in STEP13. Thereafter, the processing in the present control cycle is finished.

If f/prism/cal=1 in STEP5, i.e., if the processing of the air-fuel ratio processing controller 15 is to be executed, then the air-fuel ratio processing controller 15 effects the processing of the identifier 23 in STEP6.

Figure 11:
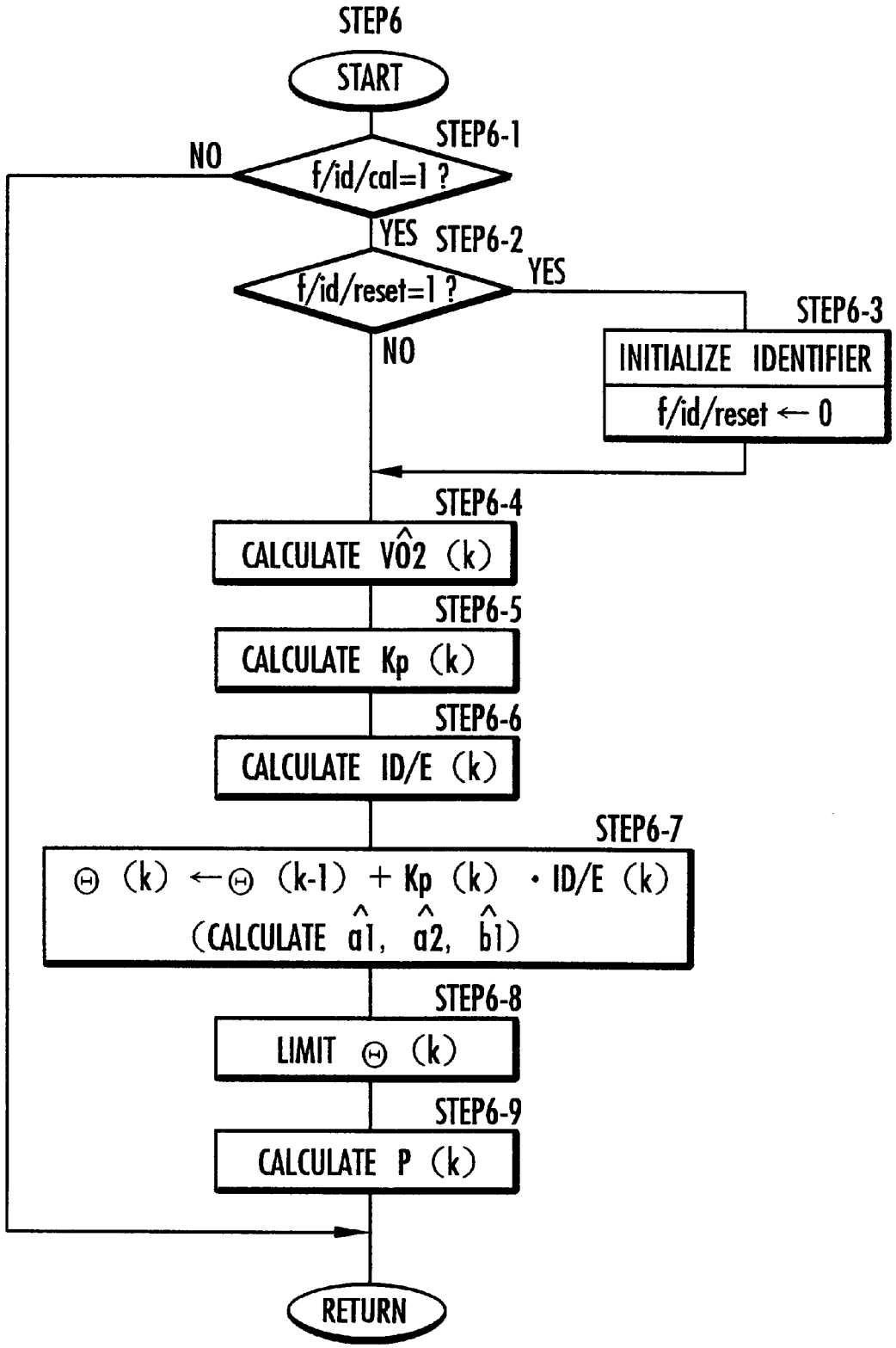
FIG. 11 is a flowchart of another subroutine of the processing sequence shown in FIG. 9.

The processing of the identifier 23 is shown in detail in FIG. 11.

The identifier 23 determines the value of the flag f/id/cal set in STEP2 in STEP6-1. If the value of the flag f/id/cal is "0", i.e., if the throttle valve of the engine 1 is fully open or the supply of fuel to the internal combustion engine 1 is being stopped, then since the process of identifying the gain coefficients a1, a2, b1 with the identifier 23 is not carried out, control immediately goes back to the main routine shown in FIG. 9.

If the value of the flag f/id/cal is "1", then the identifier 23 determines the value of the flag f/id/reset set in STEP1 with respect to the initialization of the identifier 23 in STEP6-2. If the value of the flag f/id/reset is "1", the identifier 23 is initialized in STEP6-3. When the identifier 23 is initialized, the identified gain coefficients a1 hat, a2 hat, b1 hat are set to predetermined initial values (the identified gain coefficient vector Θ is initialized), and the elements of the matrix P (diagonal matrix) according to the equation (13) are set to predetermined initial values. The value of the flag f/id/reset is reset to "0".

Then, the identifier 23 calculates the identified differential output VO2(k) hat from the model of the object equivalent system 18 (see the equation (8)) which is expressed using the present identified gain coefficients a1(k−1) hat, a2(k−1) hat, b1(k−1) hat (the identified gain coefficients determined in the preceding control cycle) in STEP-4. Specifically, the identifier 23 calculates the identified differential output VO2(k) hat according to the equation (9), using the past data VO2(k−1), VO2(k−2) of the differential output VO2 which are calculated in each control cycle in STEP3, the past data rkcmd/t(k−d) of the actually used target combined differential air-fuel ratio rkcmd/t which are calculated in each control cycle in STEP4, and the identified gain coefficients a1(k−1) hat, a2(k−1) hat, b1 (k−1) hat.

The identifier 23 then calculates the vector KP(k) to be used in determining the new identified gain coefficients a1 hat, a2 hat, b1 hat according to the equation (12) in STEP6-5. Thereafter, the identifier 23 calculates the identified error ID/E(k) (see the equation (10)), in STEP6-6.

The identified error ID/E(k) obtained in STEP6-6 may basically be calculated according to the equation (10). In the present embodiment, however, a value (=VO2 −VO2 hat) calculated according to the equation (10) from the differential output VO2 calculated in each control cycle in STEP3 (see FIG. 9), and the identified differential output VO2 hat calculated in each control cycle in STEP6-4 is filtered with predetermined frequency-pass characteristics (specifically, low-pass characteristics) to calculate the identified error ID/E(k).

The above filtering is carried out for the following reasons: The frequency characteristics of changes in the output VO2/OUT of the $O_2$ sensor 12 which is the output quantity from the object equivalent system 18 with respect to changes in the target combined air-fuel ratio KCMD/T which is the input quantity to the object equivalent system 18 are generally of a high gain at low frequencies because of the effect of the catalytic converters 9, 10, 11 included in the object system 17 as a basis of the object equivalent system 18 in particular.

Therefore, it is preferable to attach importance to the low-frequency behavior of the object equivalent system 18 in appropriately identifying the gain coefficients a1, a2, b1 of the model of the object equivalent system 18 depending on the actual behavior of the object equivalent system 18 at low frequencies. According to the present embodiment, therefore, the identified error ID/E(k) is determined by filtering the value (=VO2 −VO2 hat) obtained according to the equation (10) with low-pass characteristics.

The low-pass characteristics as the frequency-pass characteristics of the above filtering process are by way of example only. More generally, based on the actual behavior of the object system 17, the frequency characteristics (which may be affected by not only the characteristics of the catalytic converters 9, 10, 11, but also the engine 1) of changes in the output quantity from the object equivalent system 18 with respect to changes in the input quantity to the object equivalent system 18 may be confirmed via experimentation in advance, and the filtering process may be carried out which has such frequency-pass characteristics that its frequency characteristics are of a relatively high gain.

Both the differential output VO2 and the identified differential output VO2 hat may be filtered with the same frequency-pass characteristics. For example, after the differential output VO2 and the identified differential output VO2 hat have separately been filtered, the equation (10) may be calculated to determine the identified error ID/E(k). The above filtering is carried out by a moving average process which is a digital filtering process.

After the identifier 23 has determined the identified error ID/E(k), the identifier 23 calculates a new identified gain coefficient vector Θ2846 (k), i.e., new identified gain coefficients a1(k) hat, a2(k) hat, b1(k) hat, according to the equation (11) using the identified error ID/E(k) and KP(k) calculated in SETP6-5 in STEP6-7.

After having calculated the new identified gain coefficients a1(k) hat, a2(k) hat, b1(k) hat, the identifier 23 limits the values of the gain coefficients a1 hat, a2 hat, b1 hat to meet predetermined conditions in STEP6-8. The identifier 23 updates the matrix P(k) according to the equation (13) for the processing of a next control cycle in STEP6-9, after which control returns to the main routine shown in FIG. 9.

The process of limiting the identified gain coefficients a1 hat, a2 hat, b1 hat in STEP6-8 comprises a process of limiting the combination of the values of the identified gain coefficients a1 hat, a2 hat, b1 hat to a certain combination, i.e., a process of limiting a point (a1 hat, a2 hat) to a predetermined region on a coordinate plane having a1 hat, a2 hat as components thereof, and a process of limiting the value of the identified gain coefficient b1 hat to a predetermined range. According to the former process, if the point (a1(k) hat, a2(k) hat) on the coordinate plate determined by the identified gain coefficients a1(k) hat, a2(k) hat calculated in STEP6-7 deviates from the predetermined region on the coordinate plane, then the values of the identified gain coefficients a1(k) hat, a2(k) hat are forcibly limited to the values of a point in the predetermined region. According to the latter process, if the value of the identified gain coefficient b1 hat calculated in STEP6-7 exceeds the upper or lower limit of the predetermined range, then the value of the identified gain coefficient b1 hat is forcibly limited to the upper or lower limit of the predetermined range.

The above process of limiting the identified gain coefficients a1 hat, a2 hat, b1 hat serves to keep stable the target combined differential output kcmd/t generated by the sliding mode controller 25.

Specific details of the process of limiting the identified gain coefficients a1 hat, a2 hat, b1 hat are disclosed in Japanese laid-open patent publication No. 11-153051 or U.S. patent application Ser. No. 09/153300, and hence will not be described below.

The processing subroutine of STEP6 in FIG. 9 for the identifier 23 has been described above.

In FIG. 9, after the processing of the identifier 23 has been carried out, the air-fuel ratio processing controller 15 determines the gain coefficients a1, a2, b1 in STEP7.

More specifically, if the value of the flag f/id/cal established in STEP2 is "1", i.e., if the gain coefficients a1, a2, b1 have been identified by the identifier 23, then the gain coefficients a1, a2, b1 are set to the respective identified gain coefficients a1(k) hat, a2(k) hat, b1(k) hat (limited in STEP6-8) determined by the identifier 23 in STEP6. If f/id/cal=0, i.e., if the gain coefficients a1, a2, b1 have not been identified by the identifier 23, then the gain coefficients a1, a2, b1 are set to respective predetermined values. The predetermined values to which the gain coefficients a1, a2, b1 are to be set if f/id/cal=0, i.e., if the throttle valve of the internal combustion engine 1 is fully open or if the supply of fuel to the internal combustion engine 1 is being stopped, may be predetermined fixed values. However, if the condition in which f/id/cal=0 is temporary, i.e., if the identifying process carried out by the identifier 23 is temporarily interrupted, then the gain coefficients a1, a2, b1 may be set to the identified gain coefficients a1 hat, a2 hat, b1 hat determined by the identifier 23 immediately before the flag f/id/cal becomes 0.

Then, the air-fuel ratio processing controller 15 effects a processing operation of the estimator 24 in the main routine shown in FIG. 9, i.e., calculates the estimated differential output VO2(k+d) bar which is an estimated value of the differential output VO2 of the $O_2$ sensor 12 after the dead time d of the object equivalent system 18 from the present control cycle in STEP8.

Specifically, the estimator 24 calculates the coefficients $\alpha 1$, $\alpha 2$, $\beta$ (j) (j=1, 2, . . . , d) to be used in the equation (15), using the gain coefficients a1, a2, b1 determined in STEP7 (these values are basically the identified gain coefficients a1(k) hat, a2(k) hat, b1(k) hat which have been limited in STEP6-8 shown in FIG. 11) according to the definitions in the equation (14).

Then, the estimator 24 calculates the estimated differential output VO2(k+d) bar (estimated value of the differential output VO2 after the dead time d from the time of the present control cycle) according to the equation (15), using the two time-series data VO2(k), VO2(k−1), from before the present control cycle, of the differential output VO2 of the $O_2$ sensor 12 which are calculated in each control cycle in STEP3 shown in FIG. 9, the time-series data rkcmd/t(j) (j=1, . . . , d) of the present and past values of the actually used target combined differential air-fuel ratio rkcmd/t calculated in each control cycle in STEP 4, and the coefficients $\alpha 1$, $\alpha 2$, $\beta$(j) (j=1, 2, . . . , d) calculated as described above.

The estimated differential output VO2(k+d) bar which has been calculated as described above is limited to a predetermined allowable range in order that its value will be prevented from being excessively large or small. If its value is in excess of the upper or lower limit of the predetermined allowable range, it is forcibly set to the upper or lower limit of the predetermined allowable range. In this manner, the value of the estimated differential output VO2(k+d) bar is finally determined. Usually, however, the value calculated according to the equation (15) becomes the estimated differential output VO2(k+d) bar.

After the estimator 24 has determined the estimated differential output VO2(k+d) bar for the $O_2$ sensor 12, the sliding mode controller 25 and the target differential air-fuel ratio calculator 26 calculate the target differential air-fuel ratio kcmd(k) in the present control cycle in STEP9.

Figure 12:
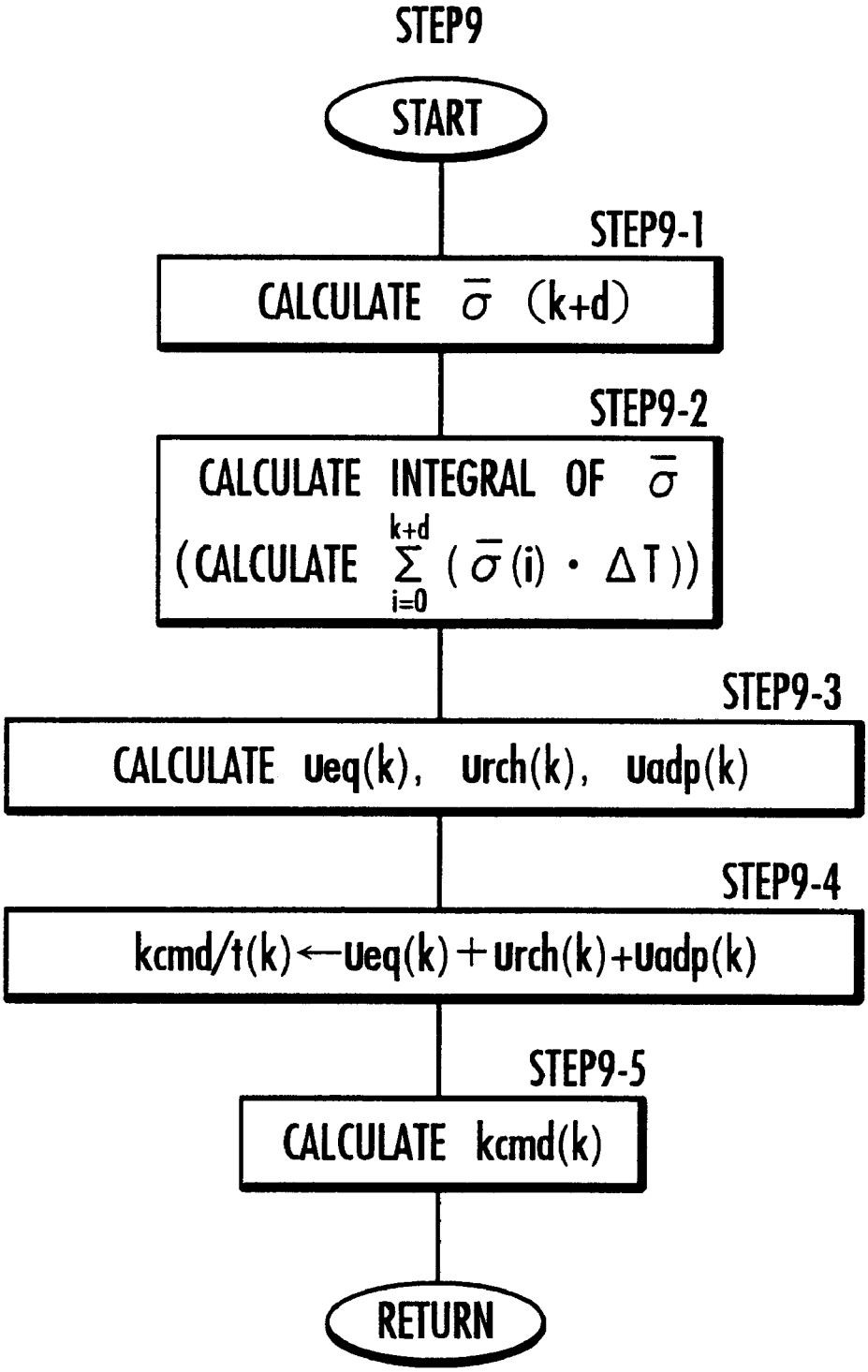
FIG. 12 is a flowchart of still another subroutine of the processing sequence shown in FIG. 9.

The calculating subroutine of STEP9 is shown in detail in FIG. 12.

The sliding mode controller 25 calculates the target combined differential air-fuel ratio kcmd/t(k) in STEP9-1 through STEP9-4.

Specifically, the sliding mode controller 25 calculates a value $\sigma$(k+d) bar (corresponding to an estimated value, after the dead time d, of the switching function $\sigma$ defined according to the equation (16)) of the switching function $\sigma$ bar defined according to the equation (25) after the dead time d from the present control cycle in STEP9-1.

At this time, the value of the switching function $\sigma$(k+d) bar is calculated according to the equation (25), using the present value VO2(k+d) bar and the preceding value VO2 (k+d−1) bar (more accurately, their limited values) of the estimated differential output VO2 bar determined by the estimator 24 in STEP8.

If the value of the switching function $\sigma$(k+d) bar is excessively large, then the value of the reaching control law input Urch determined depending on the value of the switching function $\sigma$ bar tends to be excessively large and the adaptive control law input Uadp tends to change abruptly, making the target combined differential air-fuel ratio kcmd/t (the control input to the object equivalent system 18) determined by the sliding mode controller 25 inappropriate in converging the output VO2/OUT of the $O_2$ sensor 12 stably to the target value VO2/TARGET. According to the present embodiment, therefore, the value of the switching function $\sigma$ bar is determined to fall within a predetermined allowable range, and if the value of the $\sigma$ bar determined according to the equation (25) exceeds the upper or lower limit of the predetermined allowable range, then the value of the $\sigma$ bar is forcibly set to the upper or lower limit of the predetermined allowable range.

Then, the sliding mode controller 25 accumulatively adds the product $\sigma$(k+d) bar·$\Delta$T of the value of the switching function $\sigma$(k+d) bar calculated in each control cycle and the period $\Delta$T (constant period) of the control cycles of the air-fuel ratio processing controller 15, i.e., adds the product $\sigma$(k+d) bar·$\Delta$T of the $\sigma$(k+d) bar calculated in the present control cycle and the period AT to the sum determined in the preceding control cycle, thereby calculating an integrated value (hereinafter expressed by $\Sigma\sigma$ bar) of the $\sigma$ bar which is the calculated result of the term $\Sigma$($\sigma$ bar·$\Delta$T) in the equation (27) in STEP9-2.

In order to prevent the adaptive control law input Uadp, determined depending on the integrated value $\Sigma\sigma$ bar, from becoming excessively large, the integrated value $\Sigma\sigma$ bar is determined to fall within a predetermined allowable range. If the integrated value $\Sigma\sigma$ bar exceeds the upper or lower limit of the predetermined allowable range, then the integrated value $\Sigma\sigma$ bar is forcibly set to the upper or lower limit of the predetermined allowable range.

The integrated value $\Sigma\sigma$ bar remains to be the present value (the value determined in the preceding control cycle) if the flag f/prism/on set in STEPd in FIG. 7 is "0", i.e., if the target air-fuel ratio KCMD generated by the air-fuel ratio processing controller 15 is not used by the fuel supply controller 16.

Then, the sliding mode controller 25 calculates, STEP9-3, the equivalent control input Ueq(k), the reaching control law input Urch(k), and the adaptive control law input Uadp(k) corresponding to the present control cycle according to the respective equations (24), (26), (27), using the present value VO2(k+d) bar and the preceding value VO2(k+d−1) bar of the estimated differential output VO2 bar determined by the estimator 24 in STEP8, the value $\sigma$(k+d) bar of the switching function $\sigma$ bar and the integrated value $\Sigma\sigma$ bar which have been determined respectively in STEP9-1, STEP9-2 in the present control cycle, and the gain coefficients a1, a2, b1 determined in STEP7 (these values are basically the identified gain coefficients a1(k) hat, a2(k) hat, b1 hat determined by the identifier 23 in STEP6 in the present control cycle).

The sliding mode controller 25 adds the equivalent control input Ueq(k), the reaching control law input Urch(k), and the adaptive control law input Uadp(k) determined in STEP9-4 according to the equation (18), thus calculating a target combined differential air-fuel ratio kcmd/t(k) in the present control cycle, i.e., a control input to be given to the object equivalent system 18 for converging the output VO2/OUT of the $O_2$ sensor 12 to the target value VO2/TARGET in STEP9-4.

Then, the target differential air-fuel ratio calculator 26 calculates the target differential air-fuel ratio kcmd(k) in the present control cycle according to the equation (5) in STEP9-5.

Specifically, the target differential air-fuel ratio calculator 26 calculates the right side of the equation (5) from the target combined differential air-fuel ratio kcmd/t(k) determined by the sliding mode controller 25 in STEP9-4 and the time-series data kcmd(k−1), kcmd(k−dD), kcmd(k−dD−1) of the past values of the target differential air-fuel ratio kcmd determined in the past control cycles by the target differential air-fuel ratio calculator 26 itself, thus determining the target differential air-fuel ratio kcmd(k) in the present control cycle.

Details of the processing in STEP9 have been described above.

In FIG. 9, the air-fuel ratio processing controller 15 carries out a process of determining the stability of the adaptive sliding mode control process carried out by the sliding mode controller 25, more specifically, the stability of a controlled state (hereinafter referred to as "SLD controlled state") of the output VO2/OUT of the $O_2$ sensor 12 based on the adaptive sliding mode control process, and sets a value of a flag f/stb indicative of whether the SLD controlled state is stable or not in STEP10.

Figure 13:
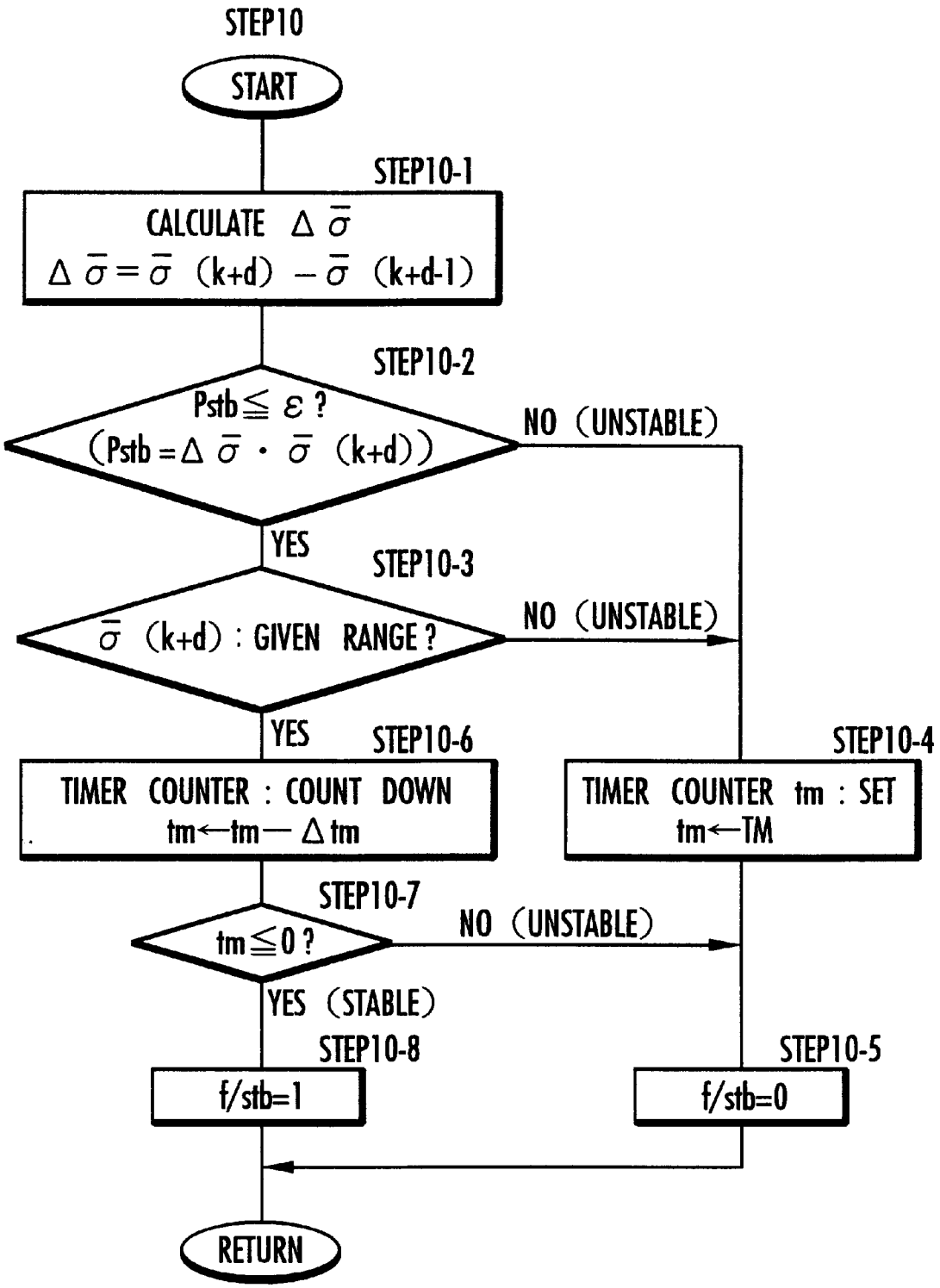
FIG. 13 is a flowchart of yet another subroutine of the processing sequence shown in FIG. 9.

The process of determining the stability of the adaptive sliding mode control process is performed according to a flowchart shown in FIG. 13.

As shown in FIG. 13, the air-fuel ratio processing controller 15 calculates a difference Δσ bar (corresponding to a rate of change of the switching function σ bar) between the present value σ(k+d) bar and the preceding value σ(k+d−1) bar of the switching function σ bar calculated in STEP9-1 by the sliding mode controller 25 in STEP10-1.

Then, the air-fuel ratio processing controller 15 decides whether or not a product Δσ bar·σ(k+d) bar (corresponding to the time-differentiated function of a Lyapunov function σ $bar^2/2$ relative to the σ bar) of the difference Δσ bar and the present value σ(k+d) bar of the switching function σ bar is equal to or smaller than a predetermined value ε (>0) in STEP10-2.

The product Δσ bar·σ(k+d) bar (hereinafter referred to as "stability dete3019 rmining parameter Pstb") will be described below. When the stability determining parameter Pstb is Pstb>0, the value of the switching function σ bar is basically changing away from "0". When the stability determining parameter Pstb is Pstb≦0, the value of the switching function σ bar is basically converged to or converging to "0". Generally, in order to converge the controlled quantity stably to the target value in the sliding mode control process, it is necessary that the value of the switching function be stably converged to "0". Therefore, it can be determined whether the SLD controlled state is stable or unstable depending on whether or not the value of the stability determining parameter Pstb is equal to or smaller than "0".

However, if the stability of the SLD controlled state is judged by comparing the value of the stability determining parameter Pstb with "0", then the determined stability is affected merely when the switching function σ bar contains slight noise.

According to the present embodiment, the predetermined value ε to be compared with the stability determining parameter Pstb is of a positive value slightly greater than "0".

If Pstb>ε in STEP10-2, then the SLD controlled state is judged as being unstable, and the value of a timer counter tm (count-down timer) is set to a predetermined initial value TM (the timer counter tm is started) in order to inhibit the processing operation of the fuel supply controller 16 using the target air-fuel ratio KCMD(k) (=kcmd(k)+FLAF/BASE) which corresponds to the target differential air-fuel ratio kcmd(k) calculated in STEP9, for a predetermined period in STEP10-4. Thereafter, the value of the flag f/stb is set to "0" (the flag f/stb=0 represents that the SLD controlled state is unstable) in STEP10-5. Thereafter, control returns to the main routine shown in FIG. 9.

If Pstb≦ε in STEP10-2, then the air-fuel ratio processing controller 15 decides whether the present value σ(k+d) bar of the switching function σ bar determined by the sliding mode controller 25 in STEP9-1 falls within a predetermined range or not in STEP10-3.

If the present value σ(k+d) bar of the switching function σ bar does not fall within the predetermined range, then since the present value σ(k+d) bar of the switching function σ bar is spaced widely apart from "0", the target combined differential air-fuel ratio kcmd/t(k) or the target differential air-fuel ratio kcmd(k) determined in STEP9 may possibly be inappropriate in converging the output VO2/OUT of the $O_2$ sensor 12 stably to the target value VO2/TARGET. Therefore, if the present value σ(k+d) bar of the switching function σ bar does not fall within the predetermined range in STEP10-3, then the SLD controlled state is judged as being unstable, and the processing of STEP10-4 and STEP10-5 is executed to start the timer counter tm and set the value of the flag f/stb to "0".

Because the value of the switching function σ bar is limited in the processing of STEP9-1 that is carried out by the sliding mode controller 25, the judging process of STEP10-3 may be dispensed with.

If the present value σ(k+d) bar of the switching function σ bar falls within the predetermined range in STEP10-3, then the sliding mode controller 25 counts down the timer counter tm for a predetermined time Δtm in STEP10-6. The sliding mode controller 25 then decides whether or not the value of the timer counter tm is equal to or smaller than "0", i.e., whether a time corresponding to the initial value TM has elapsed from the start of the timer counter tm or not, in STEP10-7.

If tm>0, i.e., if the timer counter tm is still measuring time and its set time has not yet elapsed, then the SLD controlled state tends to be unstable as no substantial time has elapsed since the SLD controlled state was judged as being unstable in STEP10-2 or STEP10-3. Therefore, if tm>0 in STEP10-7, then the value of the flag f/stb is set to "0" in STEP10-5.

If tm≦0 in STEP10-7, i.e., if the set time of the timer counter tm has elapsed, then the SLD controlled state is judged as being stable, and the value of the flag f/stb is set to "1" (the flag f/stb=1 represents that the SLD controlled state is stable) in STEP10-8.

According to the above processing sequence, if the SLD controlled state is judged as being unstable, then the value of the flag f/stb is set to "0", and if the SLD controlled state is judged as being stable, then the value of the flag f/stb is set to "1".

The above process of determining the stability of the SLD controlled state is illustrated by way of example. However, the stability of the SLD controlled state may be determined by another process. For example, the frequency with which the value of the stability determining parameter Pstb is greater than the predetermined value $\epsilon$ in each predetermined period longer than the control cycles may be determined. If the frequency is in excess of a predetermined value, then the SLD controlled state may be judged as being unstable. Otherwise, the SLD controlled state may be judged as being stable.

Referring back to FIG. 9, after a value of the flag f/stb indicative of the stability of the SLD controlled state has been set, the air-fuel ratio processing controller 15 determines the value of the flag f/stb in STEP11. If the value of the flag f/stb is "1", i.e., if the SLD controlled state is judged as being stable, then the air-fuel ratio processing controller 15 limits the target differential air-fuel ratio kcmd(k) to its value determined in STEP9 in the present control cycle in STEP12.

Specifically, the air-fuel ratio processing controller 15 determines whether the value of the target differential air-fuel ratio kcmd(k) falls within a predetermined allowable range or not. If the value of the target differential air-fuel ratio kcmd(k) exceeds the upper or lower limit of the predetermined allowable range, then the air-fuel ratio processing controller 15 forcibly limits the value of the target differential air-fuel ratio kcmd(k) to the upper or lower limit of the predetermined allowable range.

The adder 27 adds the reference air-fuel ratio FLAF/BASE to the limited target differential air-fuel ratio kcmd(k) (which is usually the target differential air-fuel ratio kcmd(k) determined in STEP9), thereby determining the target air-fuel ratio KCMD(k) in the present control cycle in STEP13. The processing sequence of the air-fuel ratio processing controller 15 in the present control cycle is now finished.

If f/stb=0 in STEP11, i.e., if the SLD controlled state is unstable in STEP10, then the air-fuel ratio processing controller 15 performs the processing in STEP14 to set the target differential air-fuel ratio kcmd(k) in the present control cycle to a predetermined value (e.g., "0"). Then, after the air-fuel ratio processing controller 15 determines the target air-fuel ratio KCMD(k), the processing sequence of the air-fuel ratio processing controller 15 in the present control cycle is finished.

The target differential air-fuel ratio kcmd finally determined in each control cycle in STEP12 or STEP14 is stored as time-series data in a memory (not shown) in the air-fuel ratio processing processor 15 in order for the target differential air-fuel ratio calculator 26 to determine a new target differential air-fuel ratio kcmd(k) in each control cycle. The target air-fuel ratio KCMD determined in STEP13 is stored as time-series data in the air-fuel ratio processing controller 15 for use in the processing operation of the fuel supply controller 16.

Details of the processing sequence of the air-fuel ratio control apparatus have been described above.

Operation of the air-fuel ratio control apparatus will be summarized as follows:

The air-fuel ratio processing controller 15 sequentially determines the target air-fuel ratio KCMD for the cylinder groups 3, 4 in order to converge (set) the output VO2/OUT of the $O_2$ sensor 12 downstream of the catalytic converters 9, 10, 11 to the target value VO2/TARGET. The fuel supply controller 16 adjusts the fuel injection quantity for the cylinder groups 3, 4 according to a feed-forward control process depending on the target air-fuel ratio KCMD for thereby manipulating the air-fuel ratio of the air-fuel mixture combusted in the cylinder groups 3, 4 into the target air-fuel ratio KCMD. In this manner, the output VO2/OUT of the $O_2$ sensor 12 is converted to the target value VO2/TARGET. As a result, the catalytic converters 9, 10, 11 as a whole can have an optimum purifying capability regardless of their deterioration.

At this time, the air-fuel ratio processing controller 15 regards the object system 17 as being equivalent to the object equivalent system 18 (see FIG. 3) which is a 1-input, 1-output system, and defines the combined differential air-fuel ratio kact/t (=KACTT−FLAF/BASE) as the single input quantity to the object equivalent system 18 according to the filtering process of the mixed model type represented by the equation (3). For determining the target air-fuel ratio KCMD for the cylinder groups 3, 4, the air-fuel ratio processing controller 15 regards the object equivalent system 18 as a system to be controlled, and determines the target combined differential air-fuel ratio kcmd/t as the control input to the object equivalent system 18 which is required to converge the output VO2/OUT of the $O_2$ sensor 12 to the target value VO2/TARGET. Based on the characteristics of filtering process of the mixed model type, the air-fuel ratio processing controller 15 uses the target air-fuel ratio KCMD commonly for the cylinder groups 3, 4, and determines the correlation between the target air-fuel ratio KCMD and the target combined differential air-fuel ratio kcmd/t according to the equation (4), and determines the target air-fuel ratio KCMD indirectly from the target combined differential air-fuel ratio kcmd/t.

Since the object equivalent system 18 is a 1-input, 1-output system, the model of the object equivalent system 18 can be of a relatively simple arrangement as indicated by the equation (1) in order to determine the target combined differential air-fuel ratio kcmd/t, and an algorithm for determining the target combined differential air-fuel ratio kcmd/t using the model can also be of a relatively simple arrangement. Therefore, the air-fuel ratio processing controller 15 does not require a complex algorithm and model for determining the target air-fuel ratio KCMD for each of the cylinder groups 3, 4, but can determine the target air-fuel ratio KCMD for the cylinder groups 3, 4 which is appropriate for converging the output VO2/OUT of the $O_2$ sensor 12 to the target value VO2/TARGET according to a relatively simple model and algorithm.

In order for the air-fuel ratio processing controller 15 to determine the target combined differential air-fuel ratio kcmd/t, the object equivalent system 18 as an object to be controlled is modeled with a response delay element and a dead time element due to the engine 1, the catalytic converters 9, 10, 11 and the auxiliary exhaust pipes 6, 7. According to the algorithm constructed on the basis of the model of the object equivalent system 18, the estimator 24 sequentially determines, in each control cycle, the estimated differential output VO2 bar which is an estimated value of the differential output VO2 from the $O_2$ sensor 12 after the dead time d of the object equivalent system 18.

The sliding mode controller 25 of the air-fuel ratio processing controller 15 determines the target combined differential air-fuel ratio kcmd/t in order to converge the estimated differential output VO2 bar to "0" and hence converge the output VO2/OUT of the $O_2$ sensor 12 to the target value VO2/TARGET, according to the algorithm of the adaptive sliding mode control process which is highly stable against the effect of a disturbance.

Therefore, the air-fuel ratio processing controller 15 can determine the target combined differential air-fuel ratio kcmd/t suitable for converging the output VO2/OUT of the $O_2$ sensor 12 to the target value VO2/TARGET and hence the target air-fuel ratio KCMD suitable for the cylinder groups 3, 4, while compensating for the dead time d of the object equivalent system 18 and the effect of a disturbance. As a result, the control process of converging the output VO2/OUT of the $O_2$ sensor 12 to the target value VO2/TARGET can be performed highly stably.

The identifier 23 of the air-fuel ratio processing controller 15 sequentially identifies, on a real-time basis, the identified values of the gain coefficients a1, a2, b1, which are parameters of the object equivalent system 18 used by the estimator 24 and the sliding mode controller 25 in their operating processes, i.e., the identified gain coefficients a1 hat, a2 hat, b1 hat.

Therefore, the estimated differential output VO2 bar of the $O_2$ sensor 12 can be determined accurately depending on the actual behavior of the object system 17 as a basis for the object equivalent system 18, and the target combined differential air-fuel ratio kcmd/t required to converge the output VO2/OUT of the $O_2$ sensor 12 to the target value VO2/TARGET can also be determined appropriately depending on the actual behavior of the object system 17.

As a consequence, the output VO2/OUT of the $O_2$ sensor 12 can be converged to the target value VO2/TARGET extremely highly stably and quickly, allowing the catalytic converters 9, 10, 11 to achieve an optimum purifying capability reliably.

In the present embodiment, the estimator 24 determines the estimated differential output VO2 bar according to the equation (15), using the target air-fuel ratio actually used by the fuel supply controller 16 to manipulate the air-fuel ratio in the cylinder groups 3, 4, i.e., the actually used target combined differential air-fuel ratio rkcmd/t determined by the actually used target air-fuel ratio RKCMD, rather than the target combined differential air-fuel ratio kcmd/t generated by the sliding mode controller 25. Therefore, the estimated differential output VO2 bar is determined depending on the actually manipulated state of the air-fuel ratio in the cylinder groups 3, 4, and hence is highly reliable.

In the present embodiment, the identifier 23 determines the identified differential output VO2 hat required to determine the identified gain coefficients al hat, a2 hat, b1 hat according to the equation (9), using the actually used target combined differential air-fuel ratio rkcmd/t, rather than the target combined differential air-fuel ratio kcmd/t generated by the sliding mode controller 25. Therefore, the identified gain coefficients al hat, a2 hat, b1 hat which are parameters of the model of the object equivalent system 18 can be determined depending on the actually manipulated state of the air-fuel ratio in the cylinder groups 3, 4, and hence are highly reliable.

In the present embodiment, inasmuch as the model of the object equivalent system 18 is constructed as a discrete time model, the algorithm of the processing sequences of the estimator 24, the sliding mode controller 25, and the identifier 23 can easily be constructed.

Figure 14:
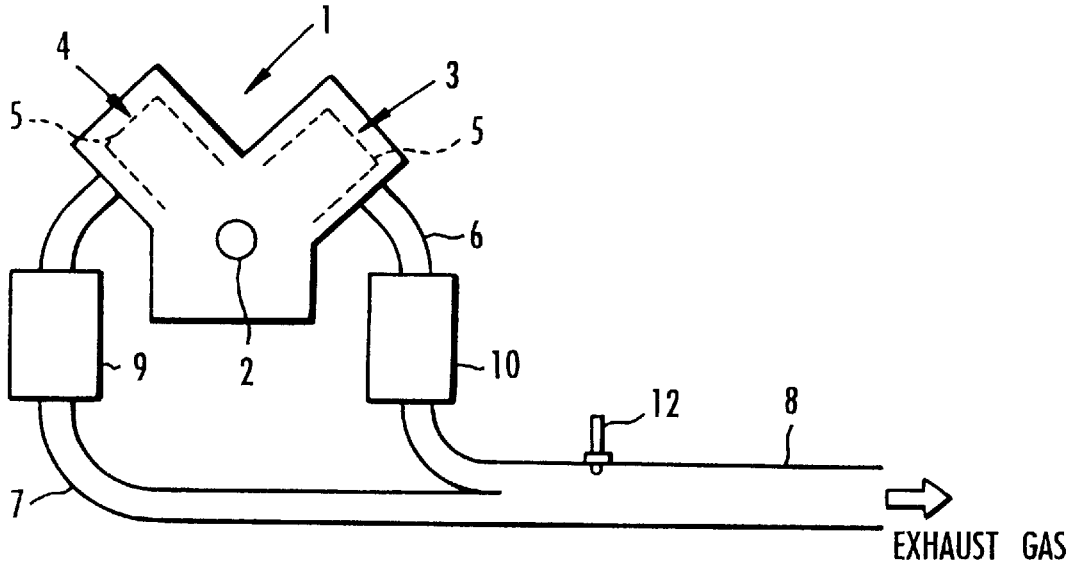
FIG. 14 is a block diagram of an exhaust system of a V-type engine as a multicylinder internal combustion engine.
Figure 15:
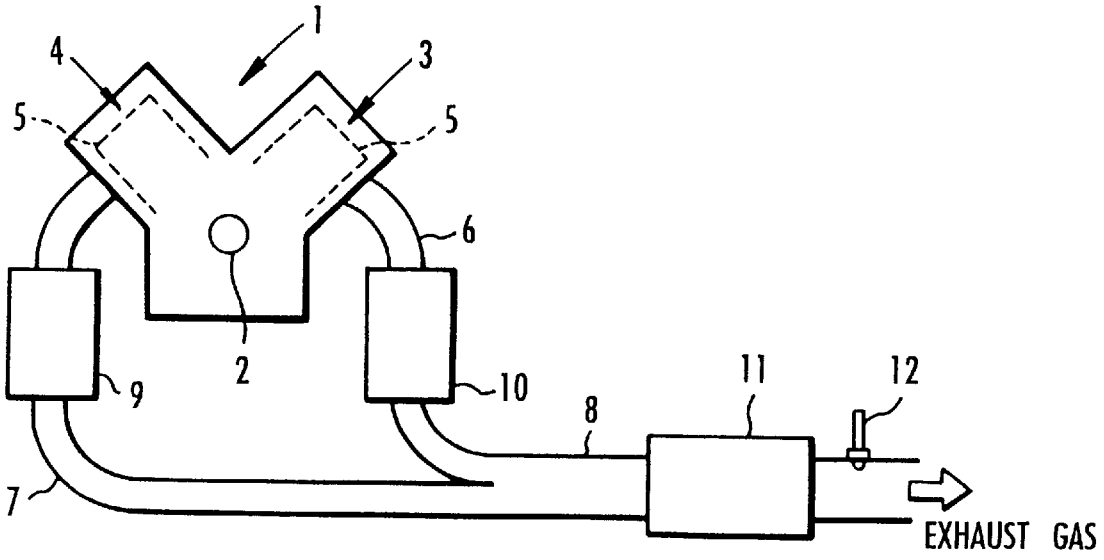
FIG. 15 is a block diagram of another exhaust system of a V-type engine as a multicylinder internal combustion engine.
Figure 17:
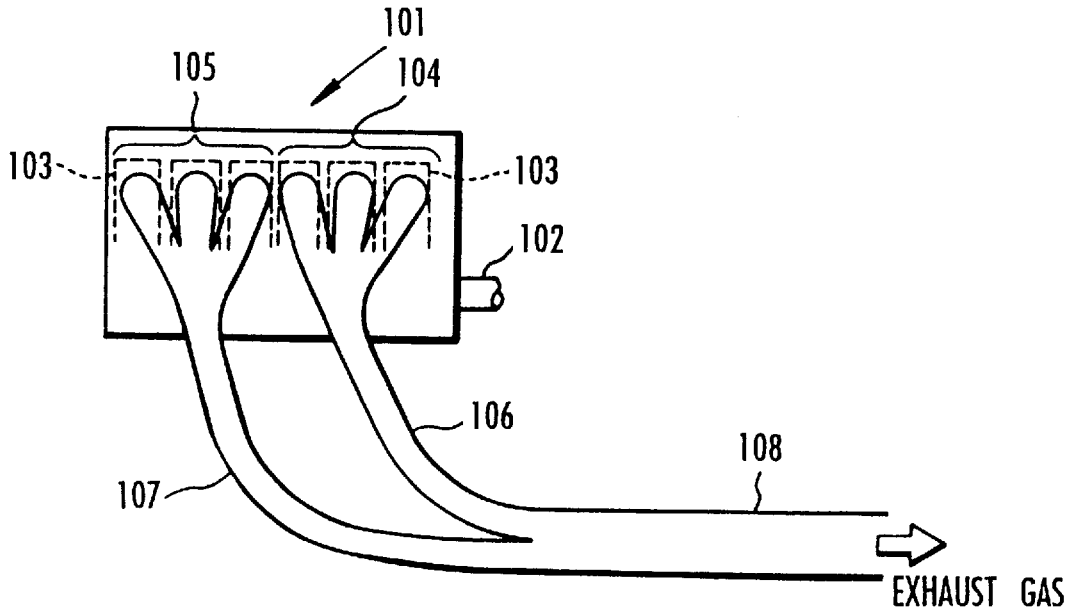
FIG. 17 is a block diagram of an exhaust system of an in-line 6-cylinder engine as a multicylinder internal combustion engine.

The air-fuel ratio control apparatus according to the present invention is not limited to the above embodiment, but may be modified as follows:

In the above embodiment, the air-fuel ratio control apparatus for the engine 1 has been described with the engine 1 being a V-type 6-cylinder engine having the exhaust system arrangement shown in FIG. 15. However, the engine 1 may be a V-type type having the exhaust system arrangement shown in FIG. 14 or 16, or an in-line 6-cylinder engine shown in FIG. 17. Furthermore, a system to which the present invention is applied can be constructed for a V-type 8-cylinder engine. In this case, the fuel supply controller 16 has as many fuel accumulation correctors 33 as eight cylinders.

In the above embodiment, in view of the fact that the target air-fuel ratio KCMD generated by the air-fuel ratio processing controller 15 may not occasionally be used for the fuel supply controller 16 to manipulate the air-fuel ratio in the cylinder groups 3, 4, the identifier 23 determines the identified differential output VO2 hat required to determine the identified gain coefficients al hat, a2 hat, b1 hat according to the equation (9), using the actually used target combined differential air-fuel ratio rkcmd/t, rather than the target combined differential air-fuel ratio kcmd/t generated by the sliding mode controller 25. Usually, however, since the actually used target combined differential air-fuel ratio rkcmd/t is equal to the target combined differential air-fuel ratio kcmd/t, the identifier 23 may determine the identified differential output VO2 hat according to the equation (8), using the target combined differential air-fuel ratio kcmd/t. For increasing the reliability of the identified gain coefficients a1 hat, a2 hat, b1 hat, however, it is preferable to determine the identified differential output VO2 hat according to the equation (9) as in the above embodiment.

Similarly, in the above embodiment, the estimator 24 determines the estimated differential output VO2 bar of the $O_2$ sensor 12 according to the equation (15), using the actually used target combined differential air-fuel ratio rkcmd/t, rather than the target combined differential air-fuel ratio kcmd/t. However, the estimator 24 may determine the estimated differential output VO2 bar according to the equation (14), using the target combined differential air-fuel ratio kcmd/t. According to the equation (14), the estimated differential output VO2(k+d) bar can be determined from the time-series data VO2(k), VO2(k−1) of the present and past values of the differential output VO2 of the $O_2$ sensor 12 and the time-series data kcmd/t(k−j) (j=1, 2, . . . , d) of the past values of the target combined differential air-fuel ratio kcmd/t determined by the sliding mode controller 25. For increasing the reliability of the estimated differential output VO2 bar, however, it is preferable to determine the estimated differential output VO2 bar according to the equation (15) as in the above embodiment.

If the target combined differential air-fuel ratio kcmd/t determined by the sliding mode controller 25 is directly used in both the identifier 23 and the estimator 24, the filter 29 and the subtractor 28 shown in FIG. 4 may be dispensed with, and their processing operation may be omitted.

If the dead time d of the object equivalent system 18, i.e., a shorter one of the cylinder-group-3-side dead time dA and the cylinder-group-4-side dead time dB, is sufficiently shorter than the period of the control cycles of the air-fuel ratio processing controller 15, then the estimator 24 may be dispensed with. In this case, the processing sequence of the estimator 24 of the air-fuel ratio processing controller 15 in the above embodiment is dispensed with, i.e., the processing in STEP8 shown in FIG. 9 is dispensed with. The sliding mode controller 25 may determine the equivalent control input Ueq, the reaching control law input Urch, and the adaptive control law input Uadp according to the equations (19), (20), (22) where d=0, and determine the sum of the determined control law inputs as the target combined differential air-fuel ratio kcmd/t.

In the above embodiment, since the cylinder-group-3-side dead time dA is larger than the cylinder-group-4-side dead time dB, and the difference dD (dA−dB) between cylinder-group-3-side dead time dA and the cylinder-group-4-side dead time dB is dD>0, the target differential air-fuel ratio calculator 26 determines the target differential air-fuel ratio kcmd according to the equation (5). If the difference dD between cylinder-group-3-side dead time dA and the cylinder-group-4-side dead time dB is substantially "0", however, the target differential air-fuel ratio calculator 26 may determine the target differential air-fuel ratio kcmd according to the equation (6).

In the above embodiment, the sliding mode controller 25 determines the target combined differential air-fuel ratio kcmd/t according to the adaptive sliding mode control process. However, the sliding mode controller 25 may determine the target combined differential air-fuel ratio kcmd/t according to an ordinary sliding mode control process which does not employ an adaptive algorithm. In this case, the sliding mode controller 25 may calculate the sum of the equivalent control input Ueq and the reaching control law input Urch as the target combined differential air-fuel ratio kcmd/t.

In the above embodiment, the algorithm of the sliding mode control process is used to determine the target combined differential air-fuel ratio kcmd/t. However, any of various other feedback control processes including an adaptive control process, an optimum control process, an H∞ control process, etc. may be used.

In the above embodiment, the values of the gain coefficients a1, a2, b1 which are parameters to be set of the model of the object equivalent system 18 are identified on a real-time basis by the identifier 23. However, the gain coefficients a1, a2, b1 may be of predetermined values or may be set using a map from the rotational speed and intake pressure of the engine 1.

In the above embodiment, the model of the object equivalent system 18 for the estimator 24 to determine the estimated differential output VO2 bar and the model of the object equivalent system 18 for the sliding mode controller 25 to determine the target combined differential air-fuel ratio kcmd/t are identical to each other. However, they may be different from each other.

In the above embodiment, the model of the object equivalent system 18 is constructed as a discrete time system. However, the model of the object equivalent system 18 may be constructed as a continuous time system, and an algorithm for determining the estimated differential output VO2 bar of the $O_2$ sensor 12 may be constructed on the basis of the model as a continuous time system and an algorithm of a feedback control process for determining the target combined differential air-fuel ratio kcmd/t may be constructed on the basis of the model as a continuous time system.

In the above embodiment, the $O_2$ sensor 12 is employed as an exhaust gas sensor. However, the exhaust gas sensor may comprise any of various other types of sensors insofar as it can detect the concentration of a certain component of an exhaust gas downstream of the catalytic converter. For example, if carbon monoxide (CO) in an exhaust gas downstream of the catalytic converter is to be controlled, then the exhaust gas sensor may comprise a CO sensor. If nitrogen oxide (NOx) in an exhaust gas downstream of the catalytic converter is to be controlled, the exhaust gas sensor may comprise an NOx sensor. If hydrocarbon (HC) in an exhaust gas downstream of the catalytic converter is to be controlled, the exhaust gas sensor may comprise an HC sensor. When a three-way catalytic converter is employed, then even if the concentration of any of the above gas components is detected, it may be controlled to maximize the purifying performance of the three-way catalytic converter. If a catalytic converter for oxidation or reduction is employed, then purifying performance of the catalytic converter can be increased by directly detecting a gas component to be purified.

Although a certain preferred embodiment of the present invention has been shown and described in detail, it should be understood that various changes and modifications may be made therein without departing from the scope of the appended claims.

What is claimed is:

1. An apparatus for controlling the air-fuel ratio of a multicylinder internal combustion engine having all cylinders divided into a plurality of cylinder groups and an exhaust system including a plurality of auxiliary exhaust passages for discharging exhaust gases produced when an air-fuel mixture of air and fuel is combusted from said cylinder groups, respectively, a main exhaust passage joining said auxiliary exhaust passages together at downstream sides thereof, an exhaust gas sensor mounted in said main exhaust passage for detecting the concentration of a given component in the exhaust gases flowing through said main exhaust passage, and a catalytic converter connected to at least one of said auxiliary exhaust passages and said main exhaust passage upstream of said exhaust gas sensor, said apparatus comprising:

target air-fuel ratio data generating means for sequentially generating target air-fuel ratio data representing the air-fuel ratio of the air-fuel mixture combusted in each of said cylinder groups so as to converge an output from said exhaust gas sensor to a predetermined target value;

air-fuel ratio manipulating means for manipulating the air-fuel ratio of the air-fuel mixture combusted in each of said cylinder groups depending on said target air-fuel ratio data;

said exhaust system including a system which comprises an object exhaust system disposed upstream of said exhaust gas sensor and including said auxiliary exhaust passages and said catalytic converter, said air-fuel ratio manipulating means, and said multicylinder internal combustion engine, said system being equivalent to a system for generating an output of said exhaust gas sensor from a target combined air-fuel ratio determined by combining the values of target air-fuel ratios for all the cylinder groups, respectively, according to a filtering process of the mixed model type; and target combined air-fuel ratio data generating means for sequentially generating target combined air-fuel ratio data representing said target combined air-fuel ratio which is required to converge the output from said exhaust gas sensor to said predetermined target value with the equivalent system serving as an object system to be controlled;

said target air-fuel ratio data generating means comprising means for sequentially generating said target air-fuel ratio data from the target combined air-fuel ratio data generated by said target combined air-fuel ratio data generating means according to a predetermined converting process determined based on characteristics of said filtering process of the mixed model type, said target air-fuel ratio of the air-fuel mixture combusted in each of said cylinder groups being shared by said cylinder groups.

2. An apparatus according to claim 1, wherein said filtering process of the mixed model type comprises a filtering process for obtaining said target combined air-fuel ratio in each given control cycle by combining a plurality of time-series values of the target air-fuel ratio for each of said cylinder groups in a control cycle earlier than the control cycle, according to a linear function having said time-series values as components thereof.

3. An apparatus according to claim 2, wherein said target air-fuel ratio data generating means comprises means for generating said target air-fuel ratio data in each given control cycle from the target combined air-fuel ratio data generated by said target combined air-fuel ratio data generating means, according to a predetermined operating process determined by said linear function.

4. An apparatus according to claim 1, wherein said air-fuel ratio manipulating means comprises means for manipulating the air-fuel ratio of the air-fuel mixture combusted in each of said cylinder groups according to a feed-forward control process performed on the target air-fuel ratio data generated by said target air-fuel ratio data generating means.

5. An apparatus according to claim 1, wherein said target combined air-fuel ratio data generating means comprises means for generating said target combined air-fuel ratio data in order to converge the output of said exhaust gas sensor to said predetermined target value according to an algorithm of a feedback control process constructed based on a predetermined model of said object system which is defined as a system for generating data representing the output of said exhaust gas sensor with at least a response delay from the target combined air-fuel ratio data.

6. An apparatus according to claim 5, wherein said algorithm of the feedback control process performed by said target combined air-fuel ratio data generating means comprises an algorithm of a sliding mode control process.

7. An apparatus according to claim 6, wherein said sliding mode control process comprises an adaptive sliding mode control process.

8. An apparatus according to claim 6, wherein said algorithm of the sliding mode control process employs, as a switching function for the sliding mode control process, a linear function having, as components, a plurality of time-series data of the difference between the output of said exhaust gas sensor and said predetermined target value.

9. An apparatus according to claim 5, wherein said model comprises a model which expresses a behavior of said object system with a discrete time system.

10. An apparatus according to claim 9, wherein said model comprises a model which expresses data representing the output of said exhaust gas sensor in each given control cycle with data representing the output of said exhaust gas sensor in a past control cycle prior to the control cycle and said target combined air-fuel ratio data.

11. An apparatus according to claim 9, further comprising identifying means for sequentially identifying a value of a parameter to be set of said model using the target combined air-fuel ratio data generated in the past by said target combined air-fuel ratio data generating means and the data representing the output of said exhaust gas sensor, wherein said algorithm of the feedback control process performed by said target combined air-fuel ratio data generating means comprises an algorithm for generating new target combined air-fuel ratio data using the value of said parameter identified by said identifying means.

12. An apparatus according to claim 11, wherein said air-fuel ratio manipulating means comprises means for manipulating the air-fuel ratio of the air-fuel mixture combusted in each of said cylinder groups depending on a target air-fuel ratio other than the target air-fuel ratio represented by said target air-fuel ratio data generated by said target air-fuel ratio data generating means, depending on operating conditions of said multicylinder internal combustion engine, further comprising filter means for sequentially determining actually used target combined air-fuel ratio data as target combined air-fuel ratio data corresponding to an actual target air-fuel ratio by effecting a filtering process identical to said filtering process of the mixed model type on data representing the actual target air-fuel ratio that is actually used by said air-fuel ratio manipulating means to manipulate the air-fuel ratio in each of said cylinder groups, wherein said identifying means comprises means for identifying the value of the parameter of said model using said actually used target combined air-fuel ratio data determined by said filter means instead of said target combined air-fuel ratio data generated by said target combined air-fuel ratio data generating means.

13. An apparatus according to claim 1, further comprising estimating means for sequentially generating data representing an estimated value of the output of said exhaust gas sensor after a dead time according to an algorithm constructed based on a predetermined model of said object system which is defined as a system for generating data representing the output of said exhaust gas sensor with a response delay and said dead time from the target combined air-fuel ratio data, wherein said target combined air-fuel ratio data generating means comprises means for generating said target combined air-fuel ratio data in order to converge the output of said exhaust gas sensor to said predetermined target value according to an algorithm of a feedback control process constructed using the data generated by said estimating means.

14. An apparatus according to claim 13, wherein the algorithm performed by said estimating means comprises an algorithm for generating the data representing the estimated value of the output of said exhaust gas sensor using the data representing the output of said exhaust gas sensor and said combined air-fuel ratio data generated in the past by said target combined air-fuel ratio data generating means.

15. An apparatus according to claim 14, wherein said air-fuel ratio manipulating means comprises means for manipulating the air-fuel ratio of the air-fuel mixture combusted in each of said cylinder groups depending on a target air-fuel ratio other than the target air-fuel ratio represented by said target air-fuel ratio data generated by said target air-fuel ratio data generating means, depending on operating conditions of said multicylinder internal combustion engine, further comprising filter means for sequentially determining actually used target combined air-fuel ratio data as target combined air-fuel ratio data corresponding to an actual target air-fuel ratio by effecting a filtering process identical to said filtering process of the mixed model type on data representing the actual target air-fuel ratio that is actually used by said air-fuel ratio manipulating means to manipulate the air-fuel ratio in each of said cylinder groups, wherein said estimating means comprises means for generating the data representing the estimated value of the output of said exhaust gas sensor using said actually used target combined air-fuel ratio data determined by said filter means instead of said target combined air-fuel ratio data generated by said target combined air-fuel ratio data generating means.

16. An apparatus according to claim 14, wherein said model of said object system comprises a model which expresses a behavior of said object system with a discrete time system.

17. An apparatus according to claim 15, wherein said model of said object system comprises a model which expresses a behavior of said object system with a discrete time system.

18. An apparatus according to claim 16 or 17, wherein said model of said object system comprises a model which expresses the data representing the output of said exhaust gas sensor in each given control cycle, with the data representing the output of said exhaust gas sensor in a past control cycle prior to the control cycle, and said target combined air-fuel ratio data in a control cycle which is earlier than the control cycle by a dead time of said object system.

19. An apparatus according to claim 16, further comprising identifying means for sequentially identifying values of parameters to be set of said model of said object system, using said target combined air-fuel ratio data determined in the past by said target combined air-fuel ratio data generating means and the data representing the output of said exhaust gas sensor, wherein the algorithm performed by said estimating means comprises an algorithm for using the values of said parameters identified by said identifying means in order to generate the data representing the estimated value of the output of said exhaust gas sensor.

20. An apparatus according to claim 17, further comprising identifying means for sequentially identifying values of parameters to be set of said model of said object system, using said actually used combined air-fuel ratio data determined in the past by said filter means and the data representing the output of said exhaust gas sensor, wherein the algorithm performed by said estimating means comprises an algorithm for using the values of said parameters identified by said identifying means in order to generate the data representing the estimated value of the output of said exhaust gas sensor.

21. An apparatus according to claim 19 or 20, wherein said algorithm of the feedback control process performed by said target combined air-fuel ratio data generating means comprises an algorithm constructed based on said model of said object system, for generating said target combined air-fuel ratio data using the values of said parameters identified by said identifying means.

22. An apparatus according to any one of claims 13 through 15, wherein said algorithm of the feedback control process performed by said target combined air-fuel ratio data generating means comprises an algorithm for generating said target combined air-fuel ratio data in order to converge the estimated value of the output of said exhaust gas sensor which is represented by the data generated by said estimating means to said predetermined target value.

23. An apparatus according to any one of claims 13 through 15, wherein said algorithm of the feedback control process performed by said target combined air-fuel ratio data generating means comprises an algorithm of a sliding mode control process.

24. An apparatus according to claim 23, wherein said sliding mode control process comprises an adaptive sliding mode control process.

25. An apparatus according to claim 23, wherein said algorithm of the sliding mode control process employs, as a switching function for the sliding mode control process, a linear function having, as components, a plurality of time-series data of the difference between the estimated value of the output of said exhaust gas sensor which is represented by the data generated by said estimating means and said predetermined target value.

* * * * *